US007887981B2

(12) United States Patent
Inagaki et al.

(10) Patent No.: US 7,887,981 B2
(45) Date of Patent: Feb. 15, 2011

(54) ELECTROPHOTOGRAPHIC PHOTORECEPTOR, METHOD OF PRODUCING THE SAME, PROCESS CARTRIDGE, AND IMAGE-FORMING APPARATUS

(75) Inventors: Tomotake Inagaki, Kanagawa (JP); Kazuyuki Tada, Kanagawa (JP); Tomomasa Sato, Kanagawa (JP); Naoki Morita, Kanagawa (JP); Kenji Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 839 days.

(21) Appl. No.: 11/802,505

(22) Filed: May 23, 2007

(65) Prior Publication Data

US 2008/0102390 A1 May 1, 2008

(30) Foreign Application Priority Data

Oct. 27, 2006 (JP) ..... 2006-292797

(51) Int. Cl.
*G03G 5/00* (2006.01)

(52) U.S. Cl. ..... 430/66; 430/127; 399/159

(58) Field of Classification Search ..... 430/66, 430/127; 399/159
See application file for complete search history.

(56) References Cited

U.S. PATENT DOCUMENTS

| | | | | |
|---|---|---|---|---|
| 5,298,617 | A | 3/1994 | Nukada et al. | |
| 5,302,479 | A | 4/1994 | Daimon et al. | |
| 5,459,004 | A | 10/1995 | Katsumi et al. | |
| 2004/0033428 | A1* | 2/2004 | Niimi | 430/59.5 |
| 2004/0120730 | A1* | 6/2004 | Niimi et al. | 399/159 |
| 2006/0099525 | A1* | 5/2006 | Yu et al. | 430/58.05 |
| 2007/0042281 | A1* | 2/2007 | Orito et al. | 430/59.5 |

FOREIGN PATENT DOCUMENTS

| | | |
|---|---|---|
| JP | A-47-030330 | 11/1972 |
| JP | A-04-189873 | 7/1992 |
| JP | A-4-324451 | 11/1992 |
| JP | A-05-043813 | 2/1993 |
| JP | A-05-098181 | 4/1993 |
| JP | A-05-140472 | 6/1993 |
| JP | A-05-140473 | 6/1993 |
| JP | A-05-263007 | 10/1993 |
| JP | A-05-279591 | 10/1993 |
| JP | A-08-176293 | 7/1996 |
| JP | A-08-208820 | 8/1996 |

(Continued)

OTHER PUBLICATIONS

Oct. 28, 2010 Japanese Office Action issued in Japanese Patent Application No. 2006-292797 (with translation).

*Primary Examiner*—Mark A Chapman
(74) *Attorney, Agent, or Firm*—Oliff & Berridge, PLC

(57) ABSTRACT

The electrophotographic photoreceptor of the present invention includes a cylindrical support, a photosensitive layer and an outermost surface layer that are layered onto the cylindrical support in this sequence from the cylindrical support side. The outermost surface layer includes a charge transport material and a curable resin. The proportion of the content of the curable resin in the outermost surface layer increases in the layer thickness direction with distance from the photosensitive layer side. The process cartridge and electrophotographic apparatus of the present invention are provided with the electrophotographic photoreceptor.

14 Claims, 15 Drawing Sheets

FOREIGN PATENT DOCUMENTS

| | | |
|---|---|---|
| JP | A-2002-006527 | 1/2002 |
| JP | A-2002-40683 | 2/2002 |
| JP | A-2002-082469 | 3/2002 |
| JP | A-2003-186234 | 7/2003 |
| JP | A-2004-29134 | 1/2004 |
| JP | A-2004-258270 | 9/2004 |
| JP | A-2005-316225 | 11/2005 |
| JP | A-2006-138956 | 6/2006 |
| JP | A-2006-227400 | 8/2006 |

* cited by examiner

ELECTROPHOTOGRAPHIC PHOTORECEPTOR, METHOD OF PRODUCING THE SAME, PROCESS CARTRIDGE, AND IMAGE-FORMING APPARATUS

CROSS-REFERENCE TO RELATED APPLICATION

This application claims priority under 35 U.S.C 119 from Japanese Patent Application No. 2006-292797 filed Oct. 27, 2006.

BACKGROUND

1. Technical Field

The present invention relates to an electrophotographic photoreceptor, a method of producing the same, a process cartridge provided with the electrophotographic photoreceptor, and an image-forming apparatus.

2. Related Art

A xerographic image forming apparatus is provided with an electrophotographic photoreceptor (sometimes referred to below as "photoreceptor"), charging device, exposing device, developing device and a transfer unit, and forms images by an electrophotographic process using the devices.

The xerographic image forming apparatuses has been advancing from the view point of high-speed image forming and life time of the image forming apparatus by developing the technology employed in each of the components and systems. Along with this trend, there are even greater demands than before for the applicability to high speed processing, and for the high reliability, of each of the subsystems.

In particular, the demands for high speed applicability and high reliability are even greater for photoreceptors that are used for writing images thereon, and cleaner for cleaning the photoreceptors, since they both receive considerably stress from the sliding motion therebetween, and image defects readily occur due to scratches, abrasion, and other such defects.

There are also strong demands for higher image qualities. Considering such demands, toners that have smaller size particles, tighter particle distributions, increased sphericity and the like are being sought. As a method of producing toners that meet these qualities, chemical toners, which are manufactured in a solution containing water as a main component thereof, has been actively developed. As a result of this, it has recently become possible to obtain photo-like quality images.

Furthermore, it has been demanded strongly to increase longevity of image-forming apparatuses. In order to realize such increases in longevity of image-forming apparatuses, increased durability of photoreceptors is being sought, and photoreceptors with protective layers that use cross-linking resin materials are proposed.

SUMMARY

A first aspect of the present invention is an electrophotographic photoreceptor having a cylindrical support, a photosensitive layer and an outermost surface layer that are layered on or above the cylindrical support in this sequence; the outermost surface layer comprising a charge transport material and a curable resin; and the proportion of the content of the curable resin in the outermost surface layer increasing toward a surface, which is a far side from the photosensitive layer, of the outermost surface layer.

BRIEF DESCRIPTION OF THE DRAWINGS

Exemplary embodiments of the present invention will be described in detail based on the following figures, wherein.

DETAILED DESCRIPTION

The electrophotographic photoreceptor of the present exemplary embodiment, includes a cylindrical support; a photosensitive layer and an outermost surface layer that are layered onto the cylindrical support in this sequence from the cylindrical support side. The outermost surface layer includes a charge transport material and a curable resin. The proportion of the content of the curable resin in the outermost surface layer increases toward a surface, which is a far side from the photosensitive layer, of the outermost surface layer.

Figure 1:
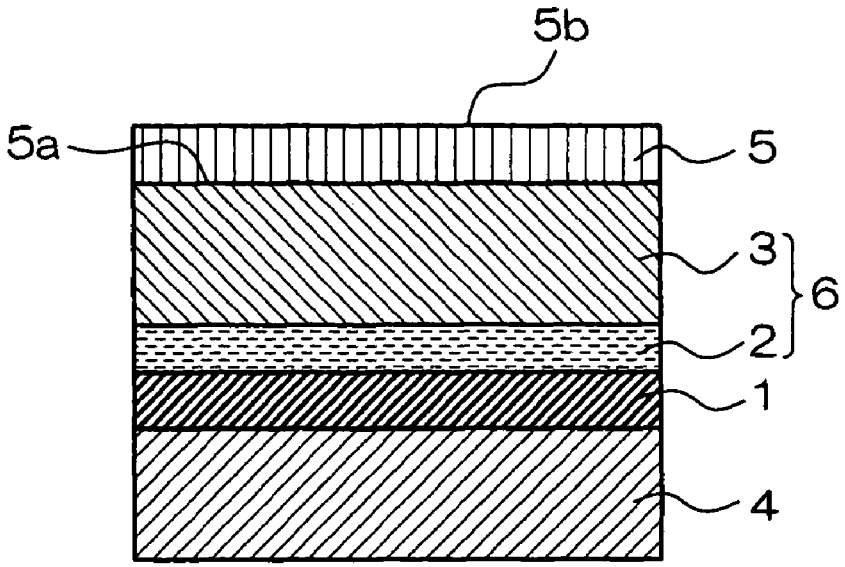
FIG. 1 is a cross sectional view of an electrophotographic photoreceptor in accordance with an preferable exemplary embodiment.
Figure 2:
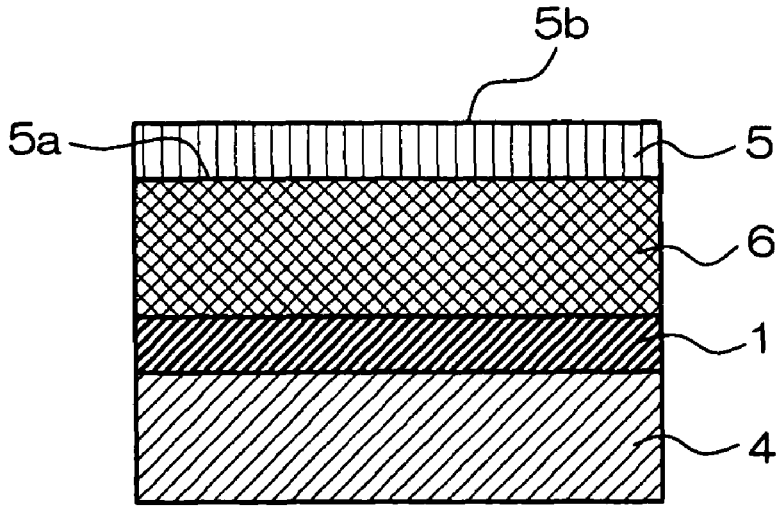
FIG. 2 is a cross sectional view of an electrophotographic photoreceptor in accordance with an another preferable exemplary embodiment.

FIGS. 1 and 2 are cross sectional views of an electrophotographic photoreceptor in accordance with an preferable exemplary embodiment.

In FIG. 1, an undercoat layer 1 is arranged on a cylindrical support 4, and on or above the undercoat layer 1, a charge-generating layer 2 and a charge-transporting layer 3 are arranged, and an outermost surface layer 5 is formed on the top. In this exemplary embodiment, the undercoat layer 1 may or may not be arranged.

In FIG. 1, a photosensitive layer 6 is a construction in which the functions of the charge-generating layer 2 and the charge transport layer 3 are separated, however, the functions of charge-generating and of charge transport may be within a single layer, such as in FIG. 2, as a single layered photosensitive layer 6. A configuration with the functions of the charge-generating layer 2 and the charge transport layer 3 separated is preferable, since then the functions may be separated into the respective layers, and more varied functionality may be exhibited. There are no particular limitations to the configuration of the layers of the present exemplary embodiment of the present invention as long as there is at least a photosensitive layer 6 and an outermost surface layer 5 provided on or above the photosensitive layer 6.

Here, "the interface of the photosensitive layer 6 (including the charge transport layer 3) with the outermost surface layer 5" refers to the interface 5*a*, and the "surface of the outermost surface layer 5 on the far side from the photosensitive layer 6" refers to the external surface 5*b*.

In the outermost surface layer 5 of the present exemplary embodiment, the proportion of the content of a curable resin is high at the external surface 5*b* of the outermost surface layer 5. There is more charge transport material contained at the interface 5*a* than at the external surface 5*b*.

In the present exemplary embodiment, "ghosting" means the phenomenon of exposure history (exposure image) from the print exposure of a previous cycle remaining for the following cycle. When the history from the previous cycle results in print image output that is denser than a reference image density then it is called a positive ghost, and when it results in output that is less dense than a reference image density it is called a negative ghost, and in each case it appears prominently with intermediate gradation images. Normally ghosting evaluation is carried out by visional evaluation, comparing the printed image with reference images.

The outermost surface layer 5 of the present exemplary embodiment may be formed on the surface of the photosensitive layer 6 on the cylindrical support 4 by ejecting from liquid droplet discharge head(s) of two or more outermost surface layer 5 coating liquids that have different proportions of content of charge transport material and curable resin, and by either controlling the ejecting amount of the outermost surface layer 5 coating liquids from the liquid droplet discharge head(s) and/or controlling the scanning velocity in the axial direction of the liquid droplet discharge head(s).

Also, in the present exemplary embodiment, a providing a process cartridge or an electrophotographic apparatus has the above electrophotographic photoreceptor.

First, detailed explanation will be given below of the outermost surface layer 5 and the method of producing the outermost surface layer 5, and then, explanation of the electrophotographic photoreceptor using the outermost surface layer 5, and after that explanation will be given of the process cartridge and the image-forming apparatus provided with the electrophotographic photoreceptor.

<Outermost Surface Layer 5>

The outermost surface layer 5 according to the present exemplary embodiment includes at least a charge transport material and a curable resin.

1. Curable Resin

As the curable resin, a resin that hardens due to an external stimulus, such as having thermosetting ability, light curability (including ultraviolet light and the like), radiation curability or the like, may be used.

Specifically, for the curable resin, examples that may be mentioned include: phenol resins, epoxy resins, urethane resins, urea resins, siloxane resins, and the like. Amongst these particularly preferable examples are resins with phenolic hydroxyl group(s) having charge transport properties. Specifically novolac type phenol resins, resol type phenol resins, epoxy resins which have a phenolic hydroxyl group or the like is preferable, and phenol derivatives (for example, resol type phenol resins) which have at least a methylol group are more preferable.

Phenol derivatives which have a methylol group include: resorcin, bisphenol and the like; substituted phenols containing one hydroxyl group, such as phenol, cresol, xylenol, p-alkylphenol, p-phenylphenol, and the like; substituted phenols containing two hydroxyl groups, such as catechol, resorcinol, and hydroquinone; bisphenols, such as bisphenol A and Bisphenol Z; biphenols; monomers of monomethylol phenols, dimethylol phenols, and trimethylol phenols that are the reaction products of reacting compounds with phenolic hydroxyl group(s) together with formaldehyde, paraformaldehyde or the like, using an acid or an alkali catalyst; mixtures of such monomers; oligomers made from these monomers; and monomer and oligomer mixtures. Here, oligomer refers to relatively large molecules with between 2 and 20 repeating units in their molecule structure, and smaller molecules are referred to as monomers.

Acid catalysts which may be used for the above reaction include, for example, acid catalysts which may be used include, for example, inorganic acid catalysts, such as sulfuric acid, phosphoric acid, and the like, organic acid catalysts p-toluene sulfonic acid, benzoic acid, fumaric acid, maleic acid and the like; alkali catalysts which may be used include, for example, alkali metal or an alkaline earth metal hydroxide compounds, such as NaOH, KOH, and $Ca(OH)_2$, and amine based catalysts. As amine based catalysts there are ammonia, hexamethylenetetramine, trimethylamine, triethylamine, triethanolamine, and the like, but catalysts are not limited thereto. It is preferable that, when a basic catalyst is used, inactivation or removal is carried out by acid neutralization or contacting with adsorbents, such as silica gel, or an ion exchange resin, or the like. Moreover, a catalyst may be used in coating liquid production, in order to promote curing. The above catalysts may be used when curing, but it is preferable that the addition amount of such a catalyst is below 5 wt % with respect to the total amount of solids in the outermost surface layer.

In the outermost surface layer 5 according to the present exemplary embodiment, the proportion of the content of curable resin increases in the layer thickness direction from the photosensitive layer side to the external surface 5*b*. As long as there is a general trend for the proportion of the content of curable resin to increase when going from the photosensitive layer side to the external surface 5*b*, there may be a small region in which there is temporarily a decrease thereof.

If the sum of the curable resin and the above charge transport material by weight in the outermost surface layer 5 is defined as 100%, then the proportion of the content of the curable resin at the external surface 5*b* of the outermost surface layer 5 is preferably 55 wt % or more, more preferably from 55 wt % to 90 wt %, and even more preferably from 60 wt % to 80 wt %.

Furthermore, at the interface 5*a* of the outermost surface layer 5, the proportion of the content of the curable resin is preferably 45 wt % or less, more preferably from 10 wt % to 45 wt %, and even more preferably from 20 wt % to 40 wt %.

The difference between the proportions of content of the curable resin at the external surface 5*b* and at the interface 5*a* is preferably 10 wt % to 80 wt %, more preferably 20 wt % to 75 wt %, and even more preferably 30 wt % to 70 wt %.

Figure 3A:
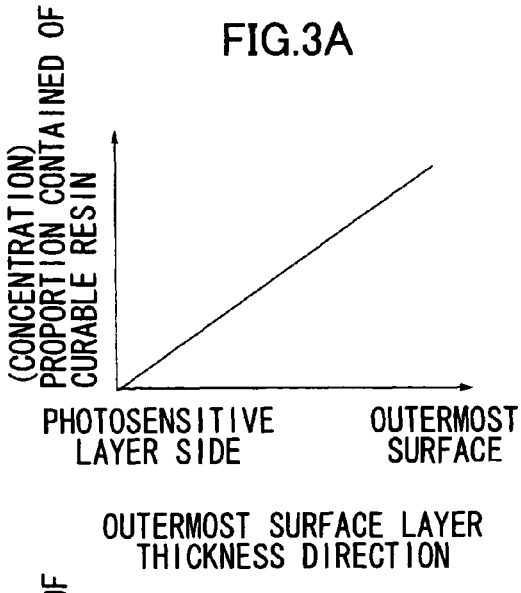
FIGS. 3A to 3E are graphs explaining a change in the proportion of the content of a curable resin in the layer thickness direction of an outermost surface layer 5.
Figure 3B:
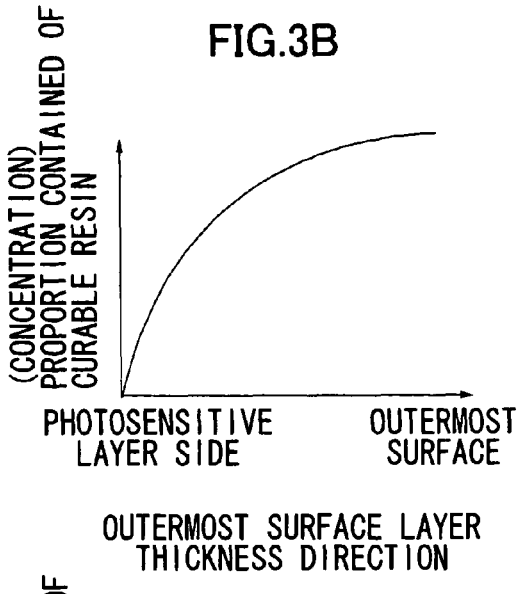
Figure 3C:
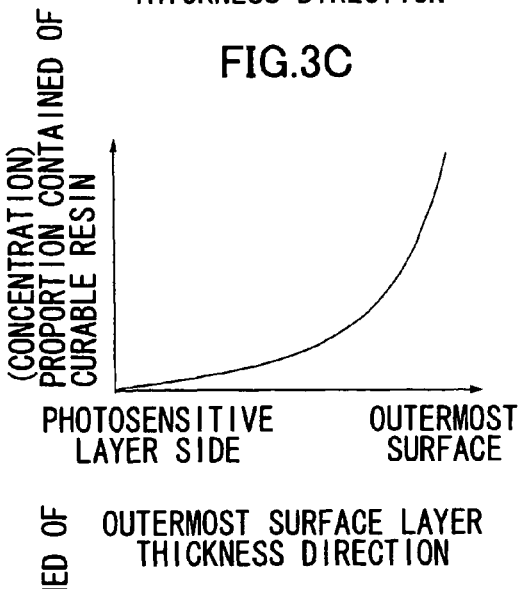

In the present exemplary embodiment, as long as the proportion of the content of the curable resin of the outermost surface layer 5 increases in the layer thickness direction with the distance from the photosensitive layer side, that is to say toward the external surface 5*b*, the proportion of the content of the curable resin may be as in the case shown in FIG. 3A where there is a first order linear increase, or it may be, as in the cases shown in FIG. 3B and FIG. 3C, where there is a curved increase.

Figure 3D:
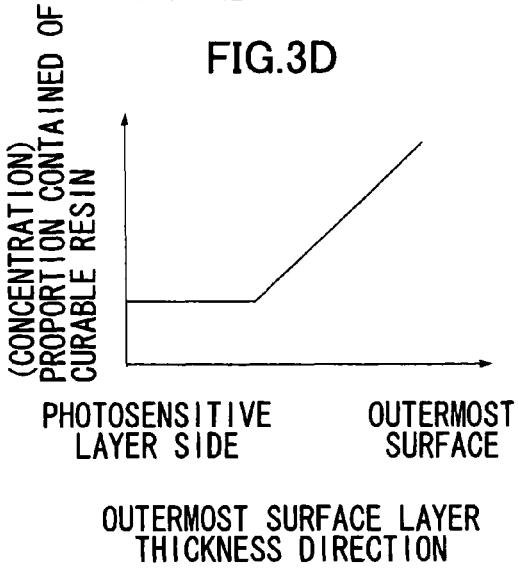
Figure 3E:
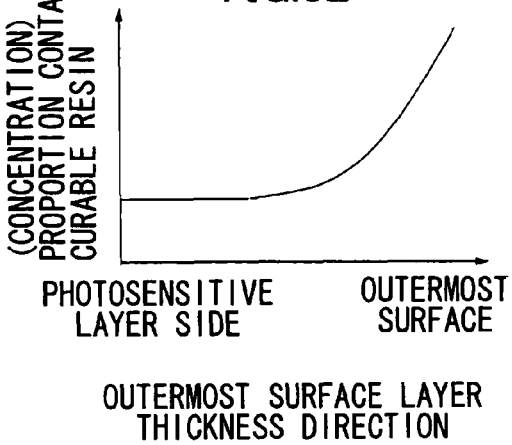

Furthermore, if an outermost surface layer 5 that is thinner than the target thickness if formed in advance, by dip coating or the like, and then inkjet coating with a coating liquid that has a different concentration of curable resin is carried out, the concentration gradients as shown in FIGS. 3D and 3E are formed, and these embodiments are also suitable. That is to say, the part where the proportion of the content of the curable resin increases in the layer thickness direction from the photosensitive layer side to the surface of the outermost surface layer 5, may be only a portion of the outermost surface layer 5 in the layer thickness direction.

2. Charge Transport Material

There are no particular limitations to materials that may be used as the charge transport material, as long as they have charge transport functionality, and they may be used as applicable. For example, hydrazone based compounds, benzidine based compounds, amine based compounds, stilbene based compounds or the like, which are low molecular weight compounds that have superior charge transport functionality may be used, and charge transport materials that have structures that can undertake a cross-linking reaction are favorably applied, since they can form an outermost surface layer 5 having high mechanical strength over long periods of use.

Examples that may be given of substances for a cross-linkable charge-transporting substance include those represented by the Formulas (I) to (V) below, and for specific examples of the structure thereof, the following, for example, may be used.

$$F—((X^1)_n—R^1\text{-}A)_m \qquad \text{Formula (I)}$$

In Formula (I): F represents an organic group that has a hole-transporting ability; $R^1$ represents an alkylene group; m represents an integer of 1 to 4; $X^1$ represents an oxygen atom or a sulfur atom; n is 0 or 1; and A represents a hydroxyl group, a carboxyl group or a thiol group.

$$F—[(X^2)_{n1}—(R^2)_{n2}\text{-}(Z^2)_{n3}\text{-}G]_{n4} \qquad \text{Formula (II)}$$

In Formula (II): F represents an organic group that has a hole-transporting ability; $X^2$ represents an oxygen or a sulfur atom; $R^2$ represents an alkylene group; $Z^2$ represents an alkylene group, an oxygen atom, a sulfur atom, NH, or COO; G represents an epoxy group; n1, n2 and n3 are each independently 0 or 1; and n4 represents an integer from 1 to 4.

Formula (III)

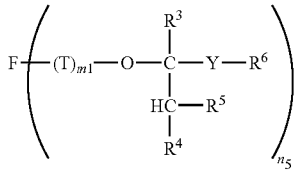

In Formula (III): F represents an n5 valency organic group that has a hole-transporting ability; T represents a divalent group; Y represents an oxygen atom or a sulfur atom; $R^3$, $R^4$ and $R^5$ each independently represents a hydrogen atom or a monovalent organic group; $R^6$ represents a monovalent organic group; m1 is 1 or 0; and n5 represents an integer from 1 to 4, wherein $R^5$ and $R^6$ may link together to form a hetero ring with Y as the hetero atom.

Formula (IV)

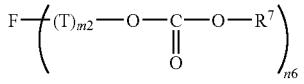

In Formula (IV): F represents an n6 valency organic group that has a hole-transporting ability; $T^2$ represents a divalent group; $R^7$ represents a monovalent organic group; m2 is 1 or 0; and n6 represents an integer from 1 to 4.

Formula (V)

In Formula (V): F represents an n7 valency organic group that has a hole-transporting ability; $T^3$ represents a divalent alkylene group; $R^0$ represents a monovalent organic group; and n7 represents an integer from 1 to 4.

Specific examples of compounds are shown below, but there is no limitation to these.

Specific Examples Represented by Formula (I)

I-1

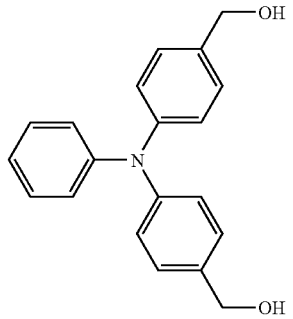

-continued
I-2
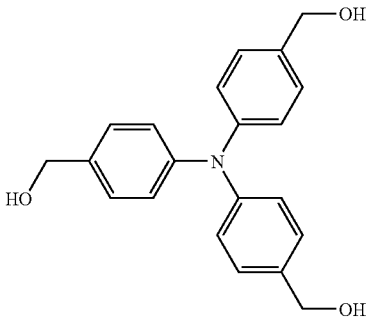
I-3
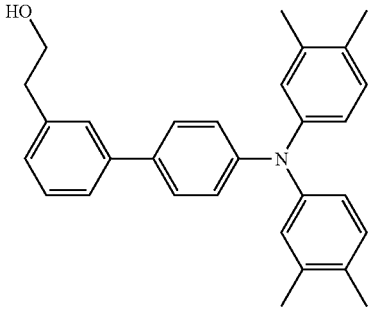
I-4
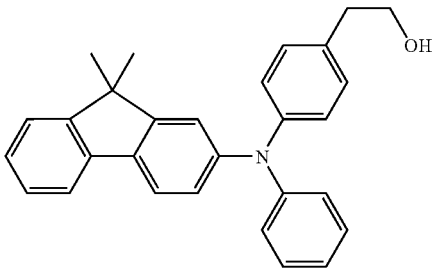
I-5
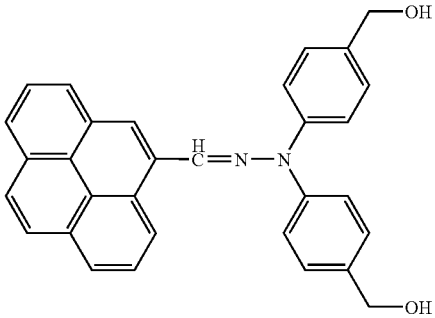
I-6
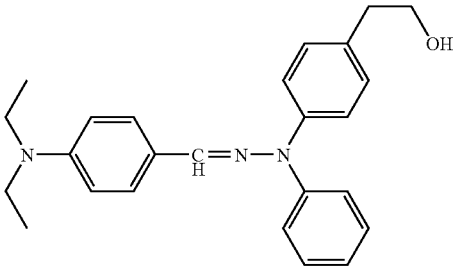
-continued
I-8
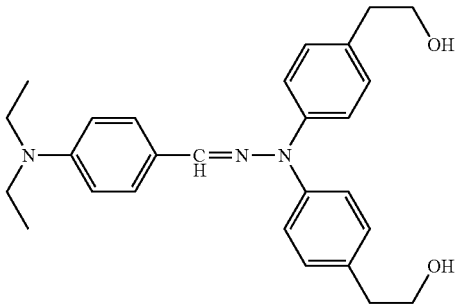
I-9
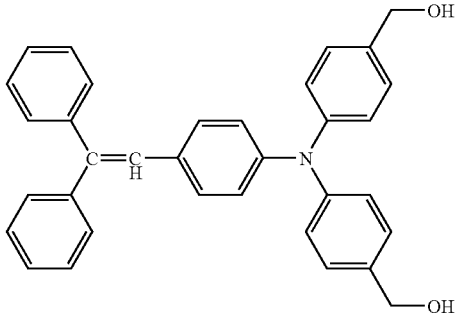
I-10
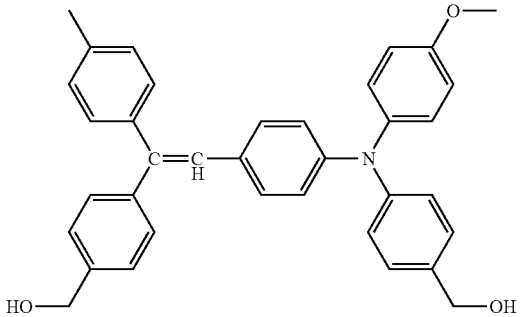
I-11
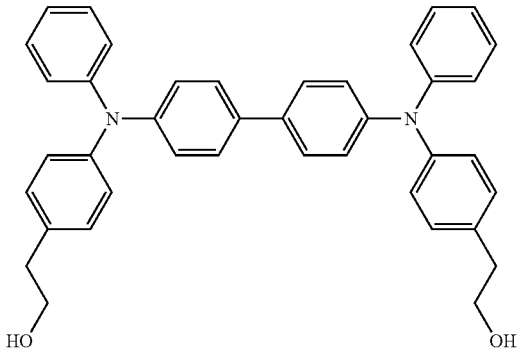

-continued
I-12
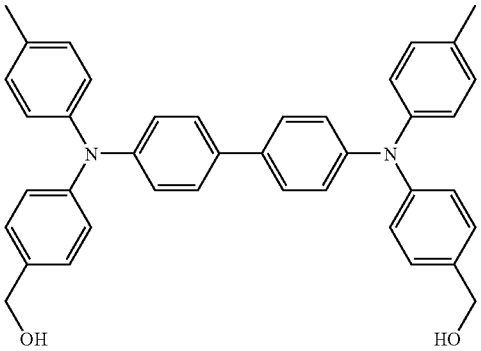
I-13
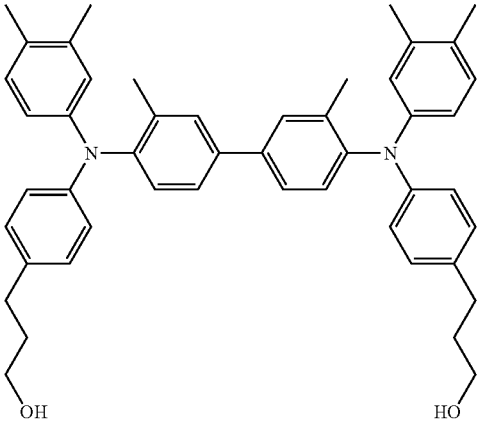
I-14
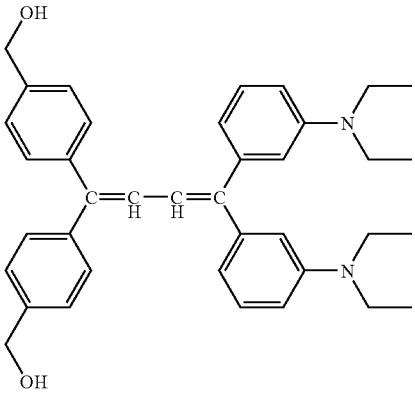
I-15
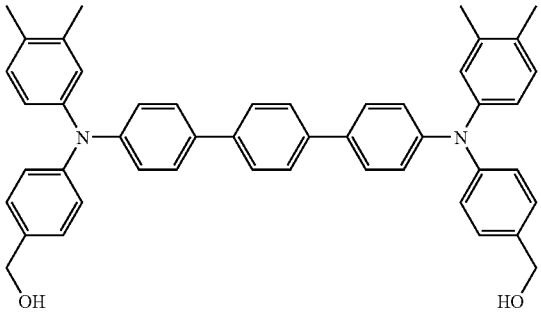
-continued
I-16
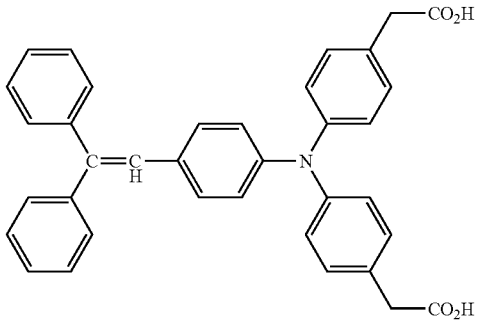
I-17
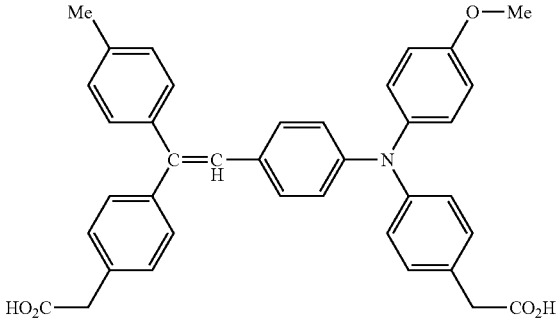
1-18
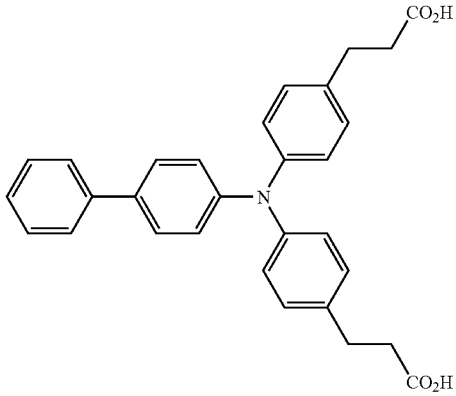
I-19
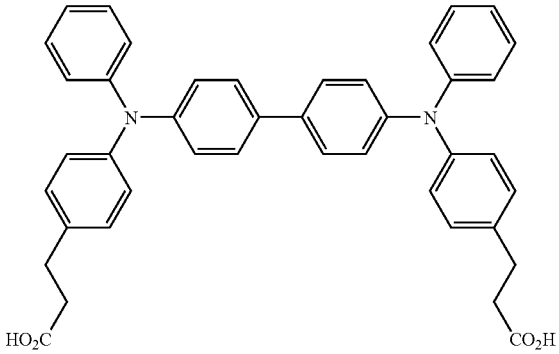

-continued
I-20
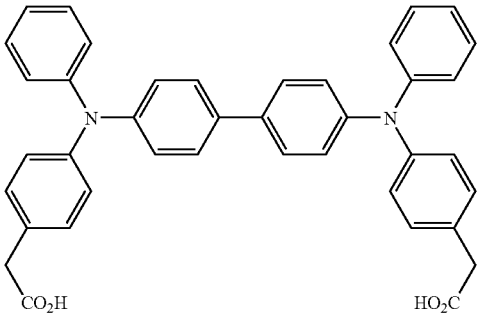
I-21
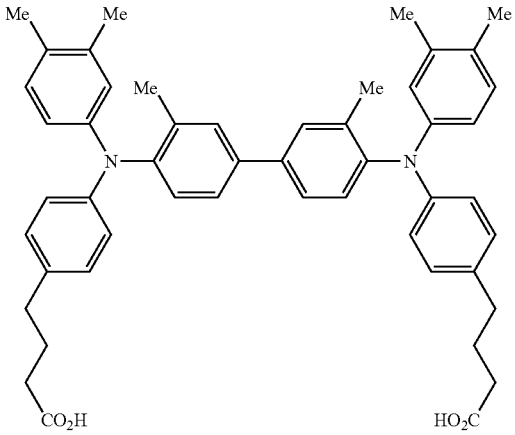
I-22
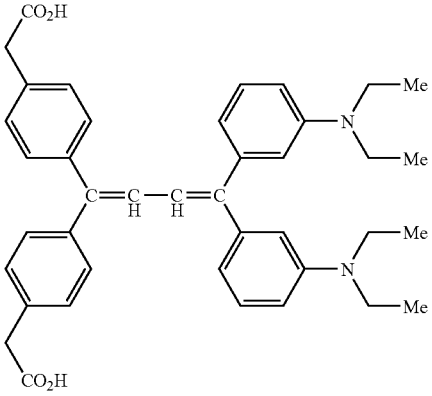
I-23
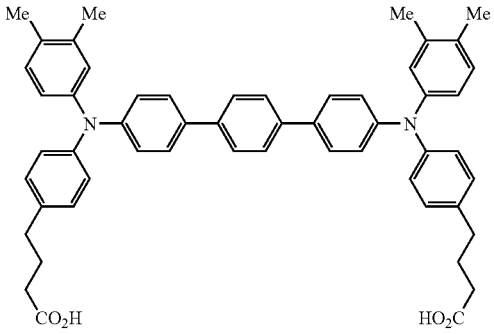
-continued
I-24
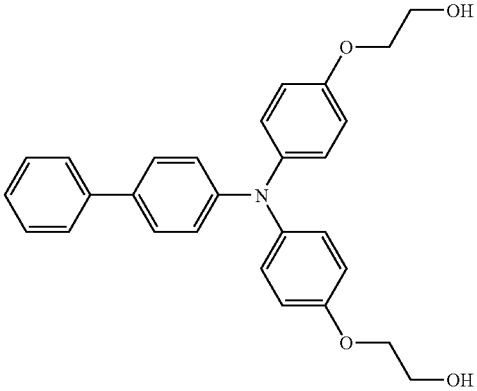
I-25
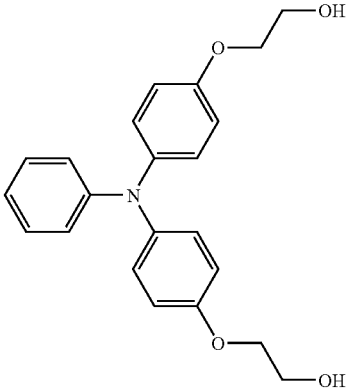
I-26
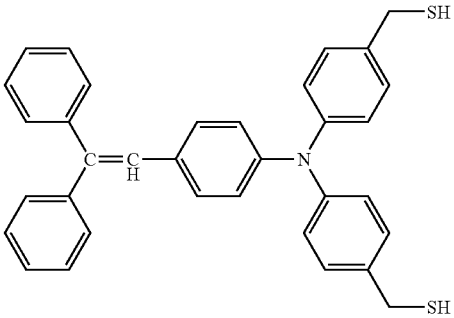
I-27
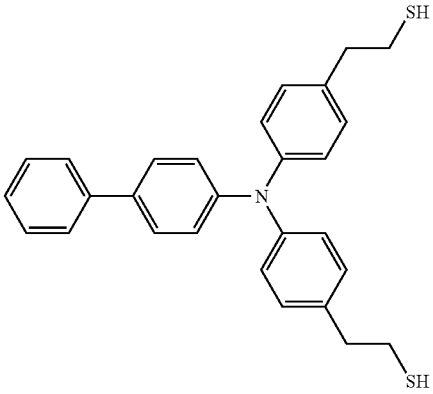

-continued
I-28
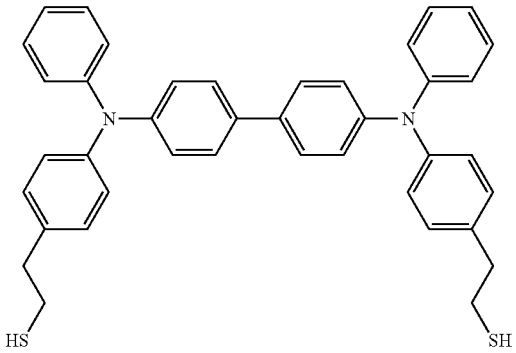
I-29
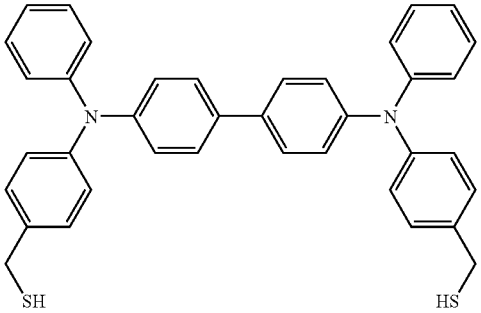
I-30
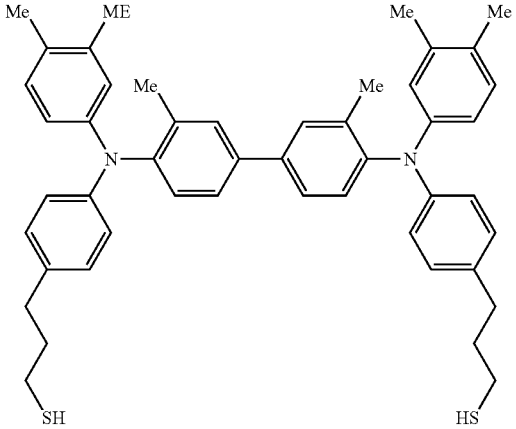
Specific Examples Represented by Formula (II)
II-1
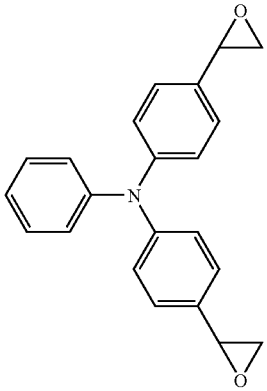
-continued
II-2
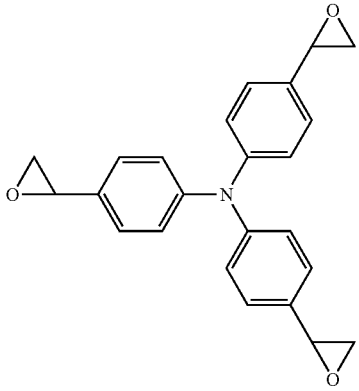
II-3
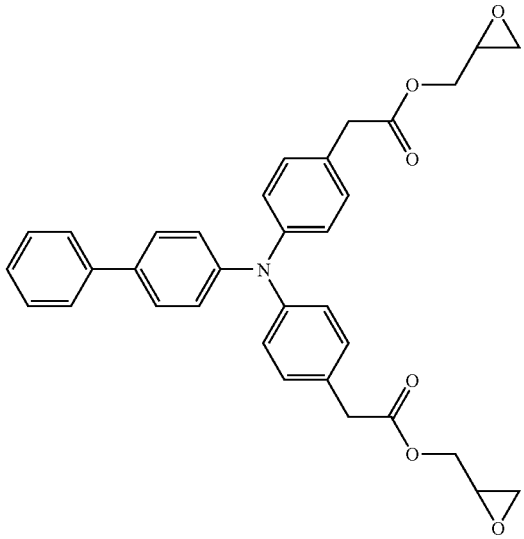
II-4
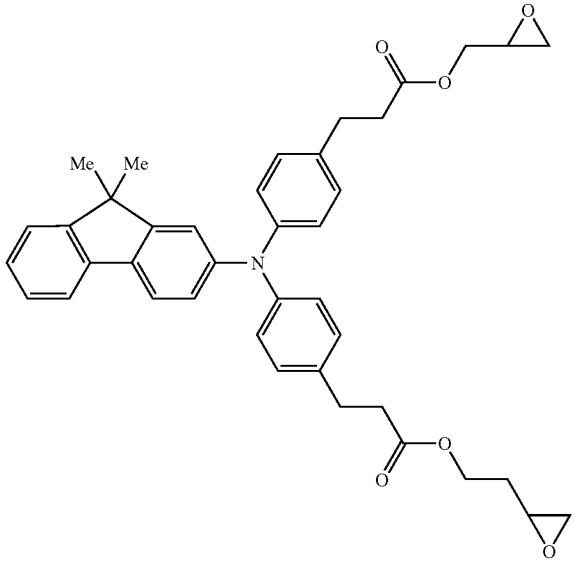

-continued
II-5
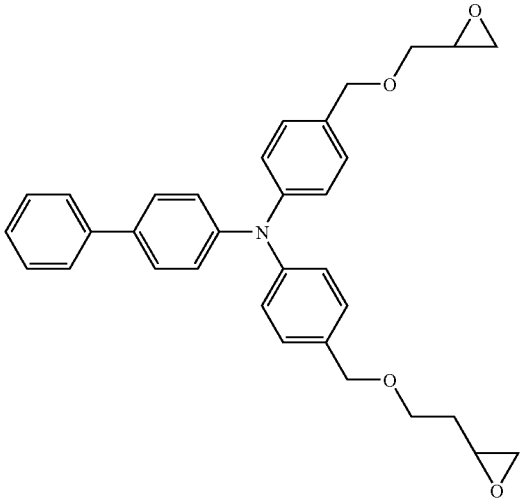
II-6
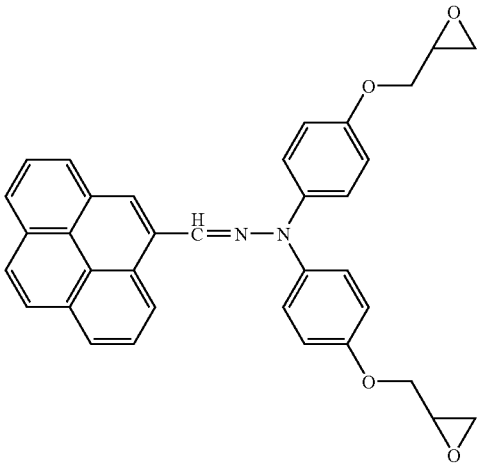
II-7
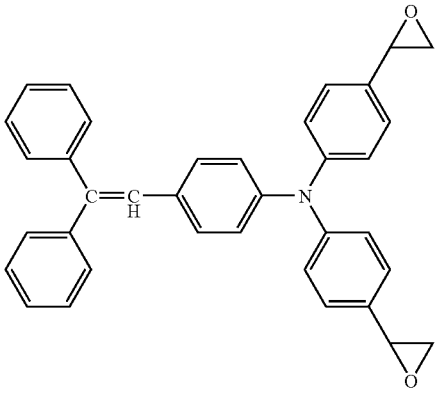
-continued
II-8
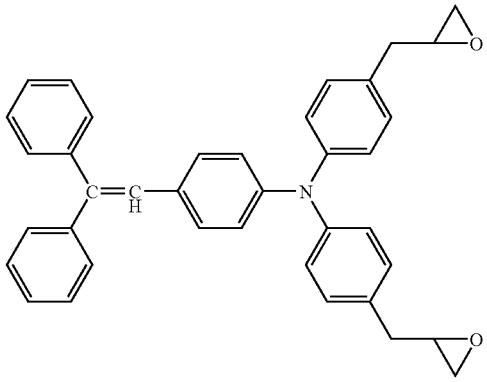
II-9
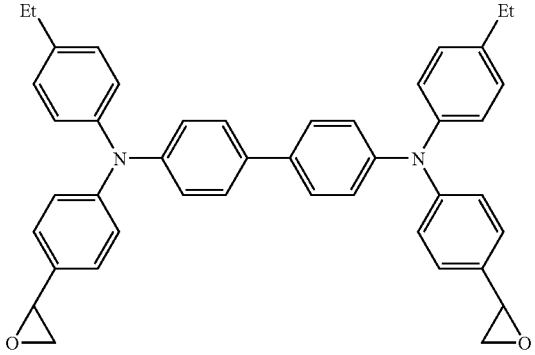
II-10
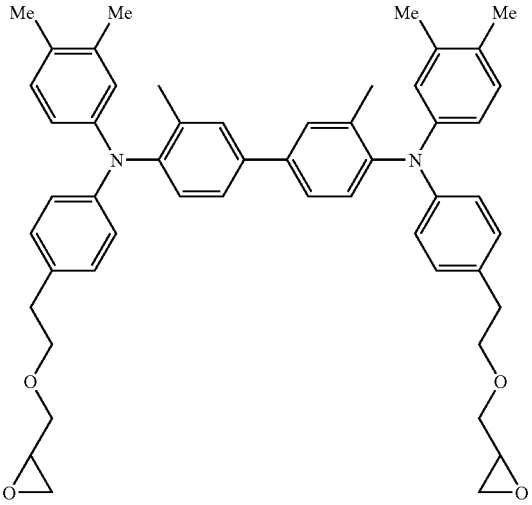

-continued
II-11
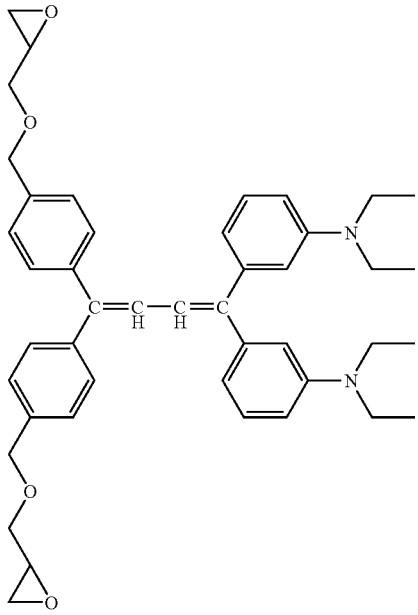
II-12
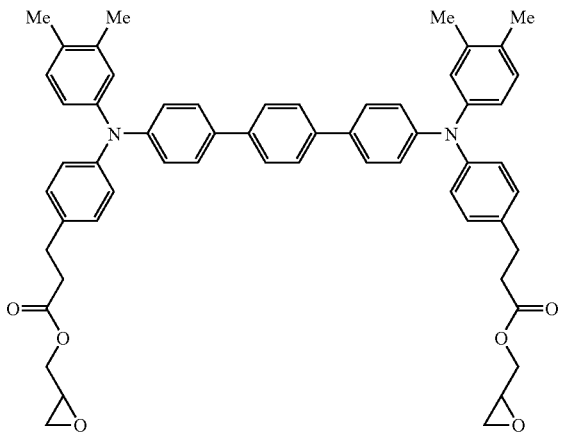
II-13
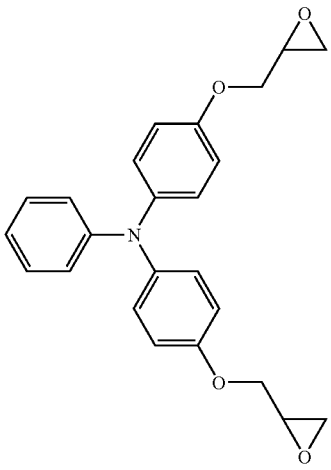
-continued
II-14
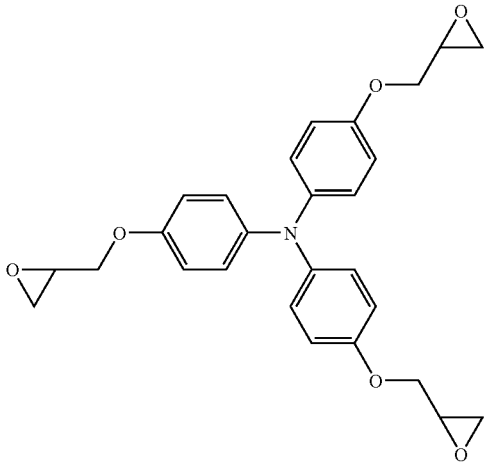
II-15
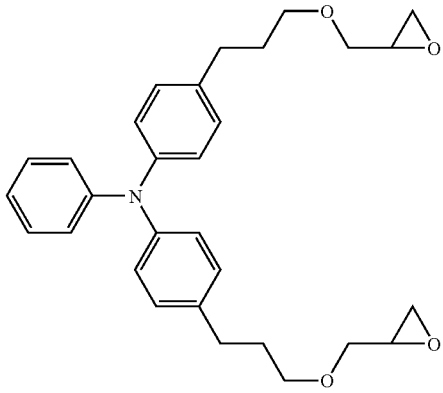
II-16
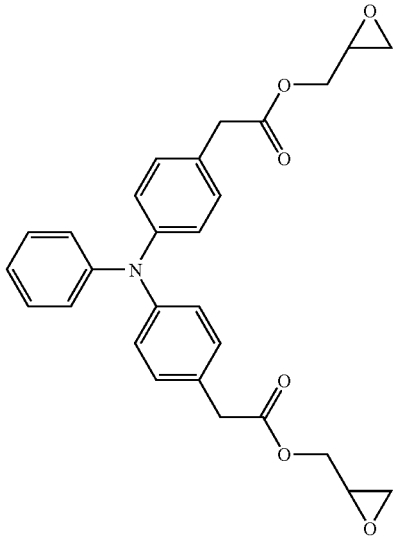

-continued
II-17
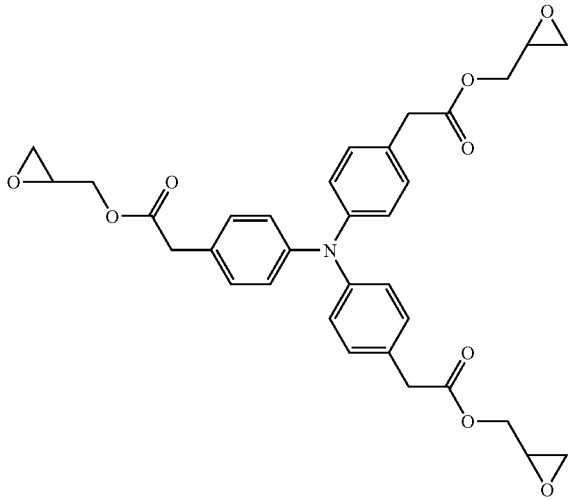
II-18
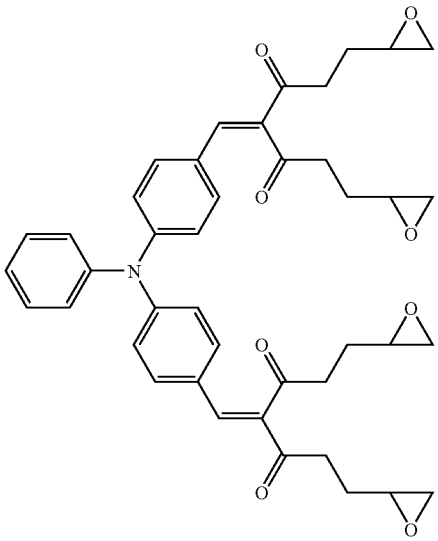
II-19
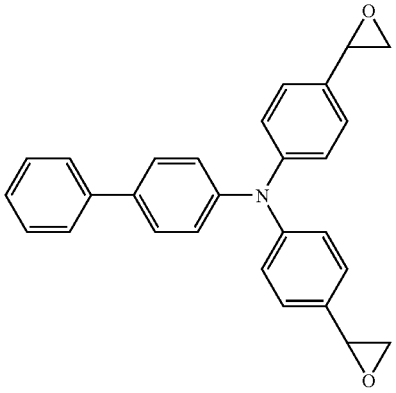
-continued
II-20
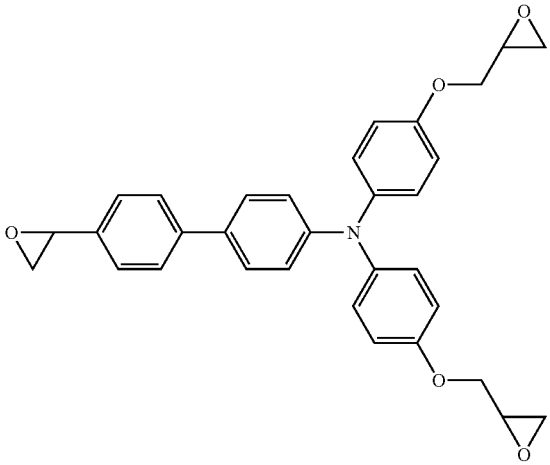
II-21
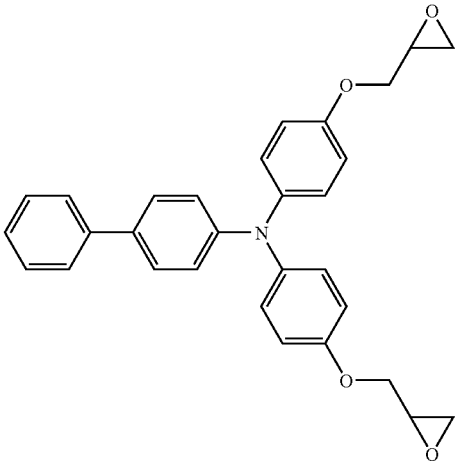
II-22
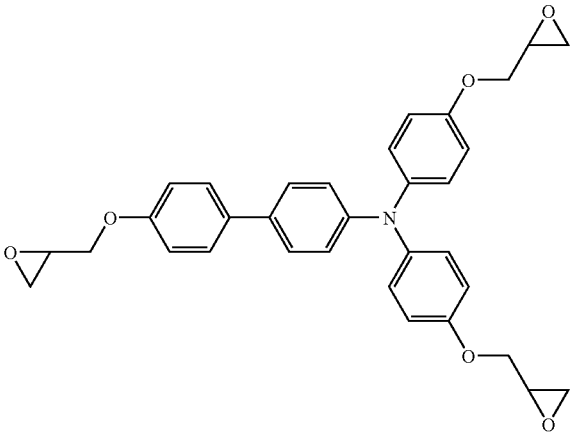

-continued
II-23
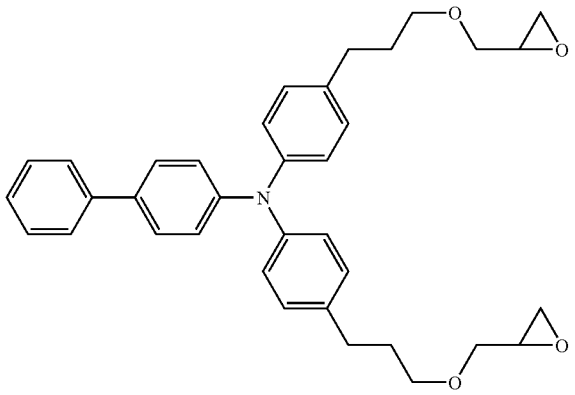
II-24
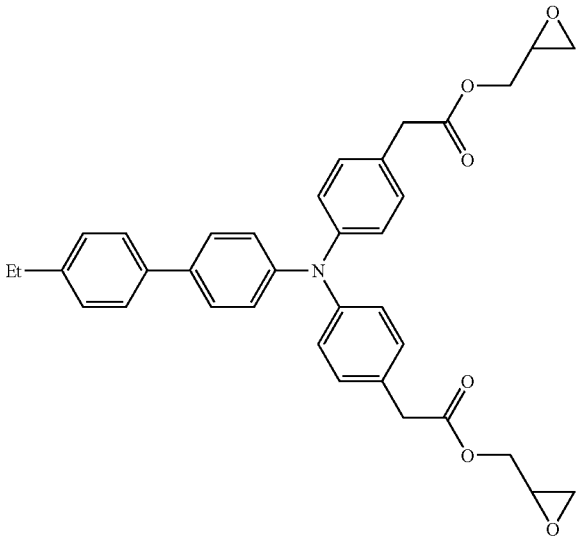
II-25
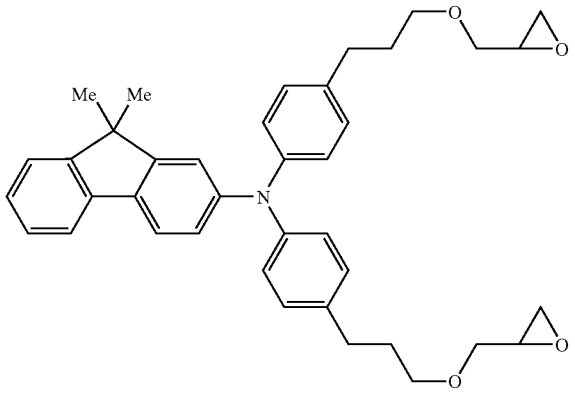
-continued
II-26
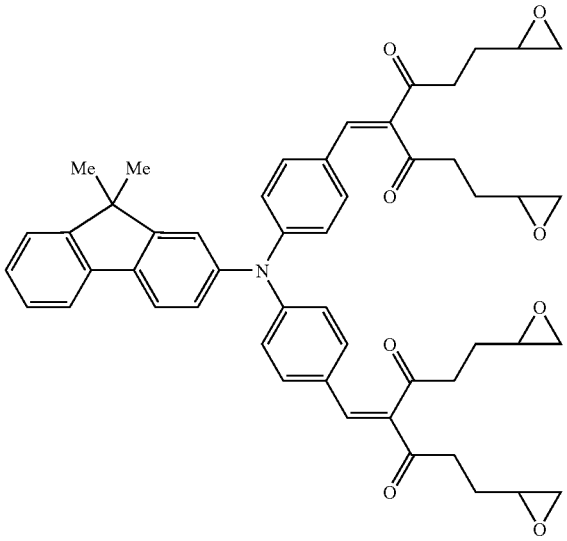
II-27
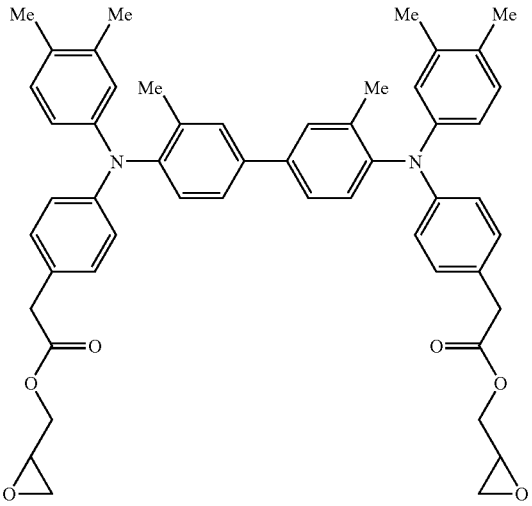
II-28
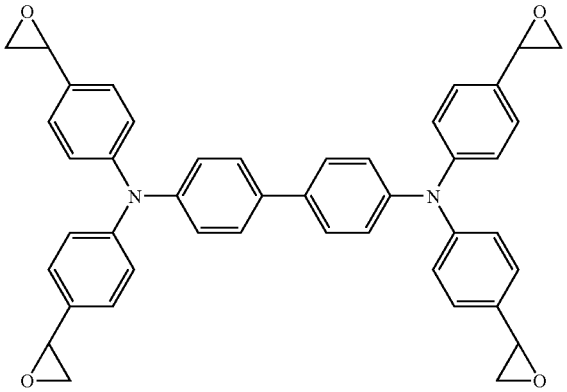

-continued
II-29
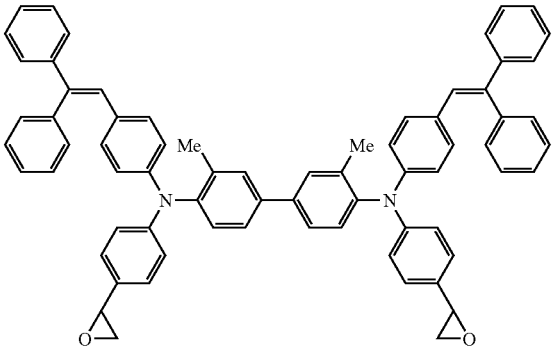
II-30
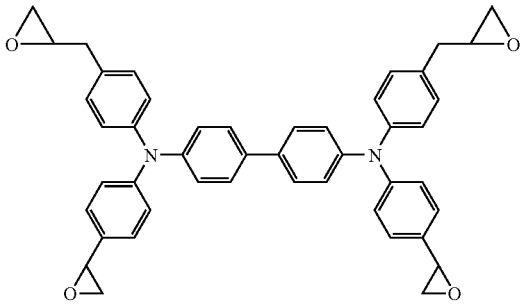
II-31
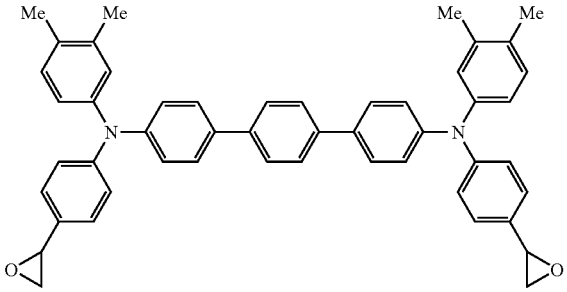
II-32
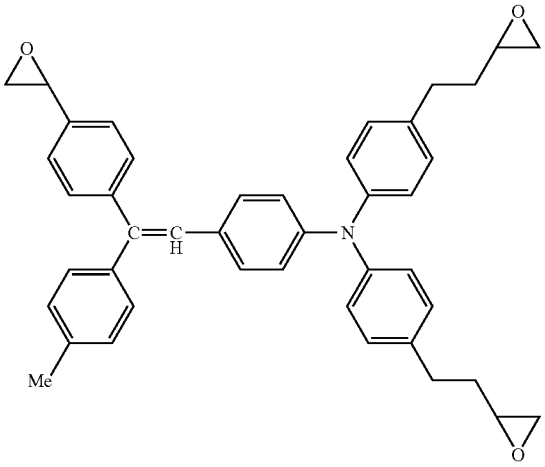
-continued
II-33
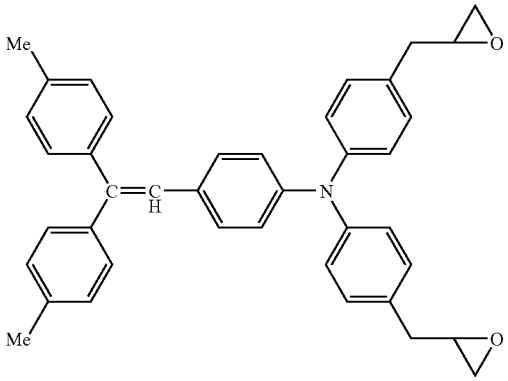
II-34
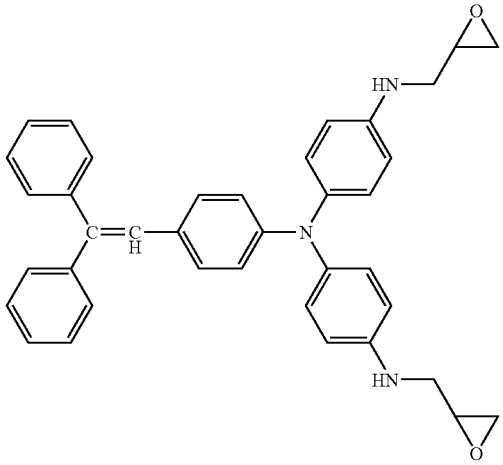
II-35
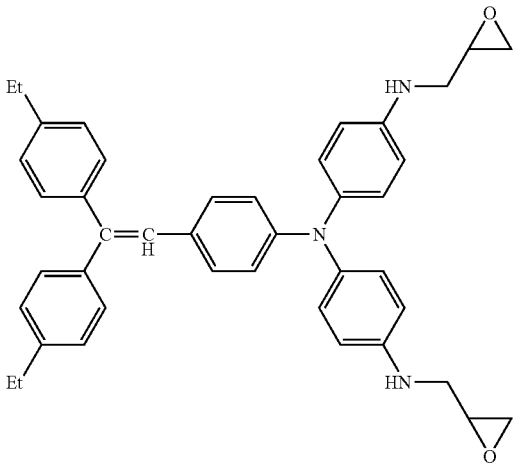

-continued
II-36
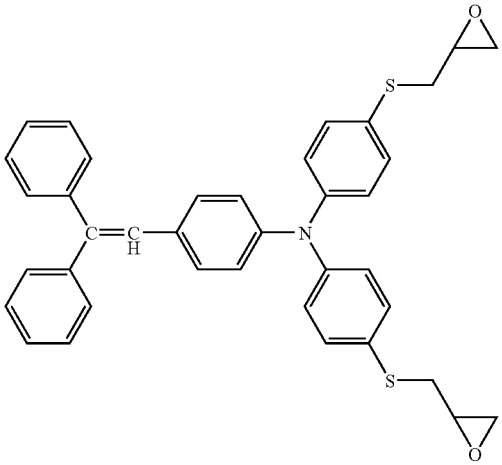
II-37
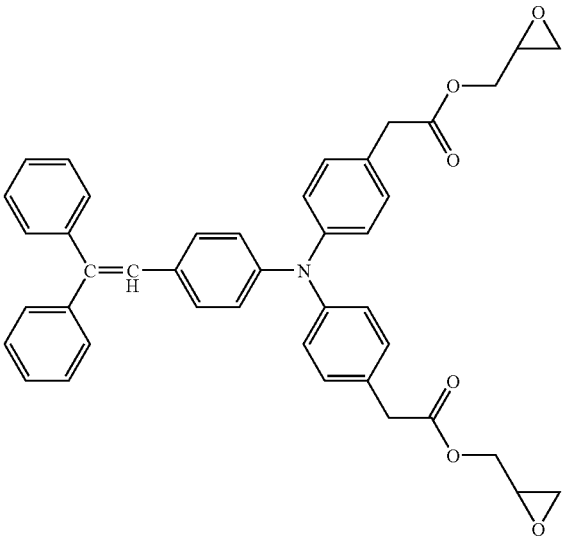
II-38
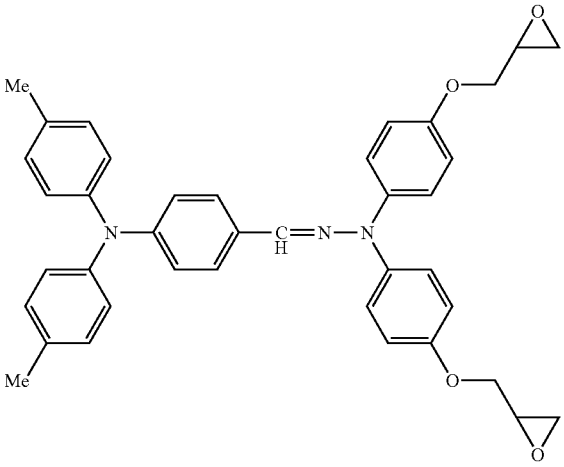
-continued
II-39
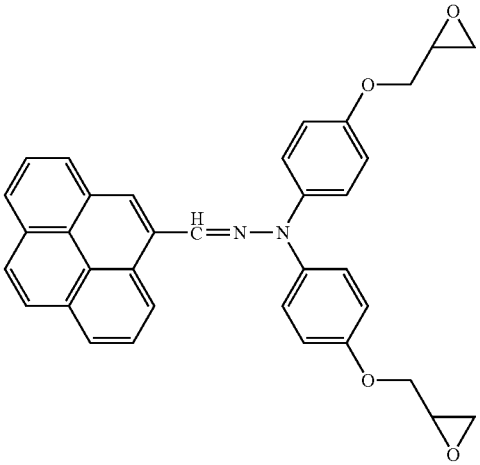
II-40
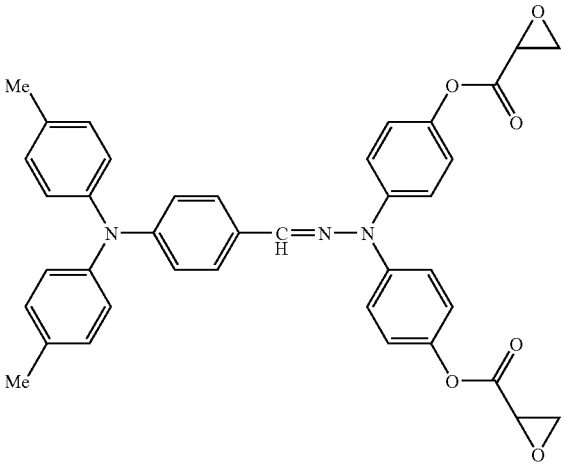
II-41
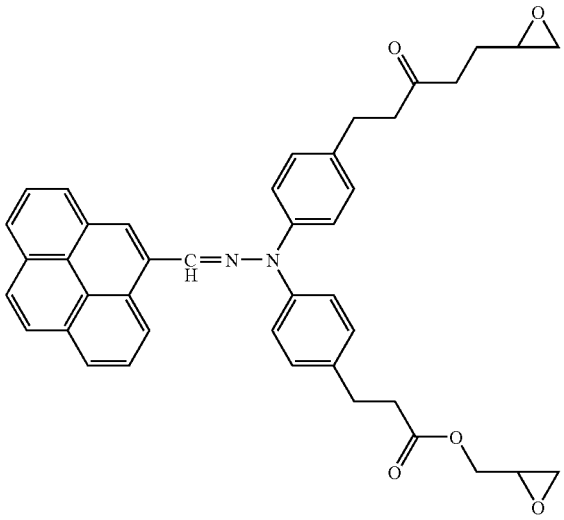

-continued
II-42
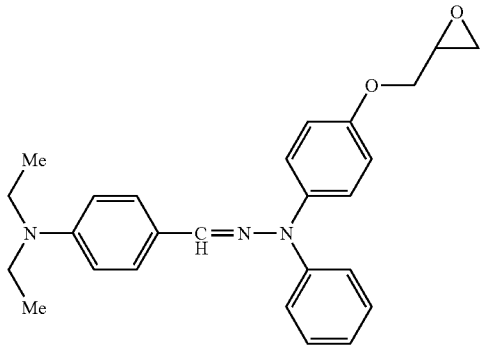
II-43
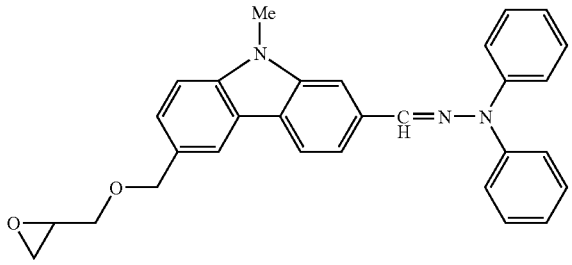
II-44
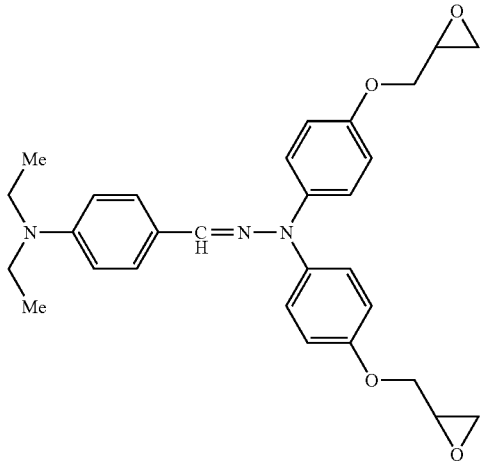
-continued
II-45
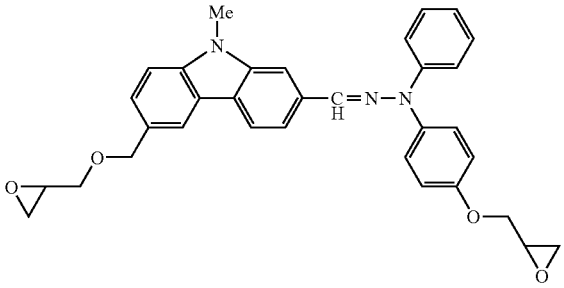
II-46
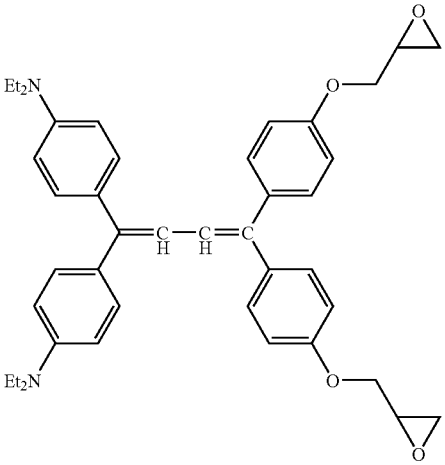
II-47
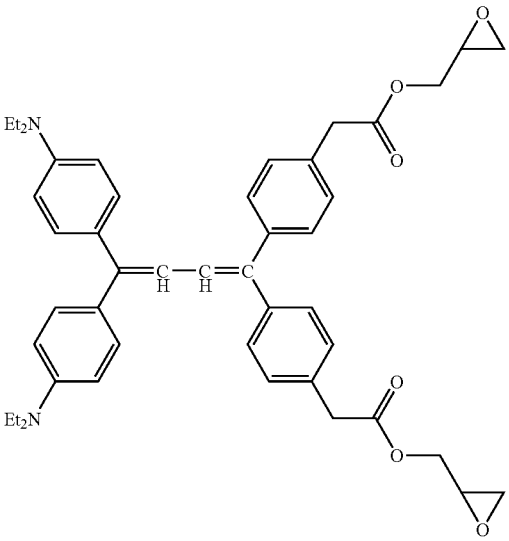

Specific Examples Represented by Formula (III)
III-1
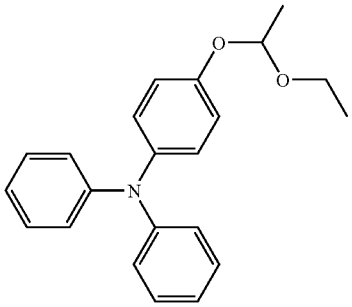
III-2
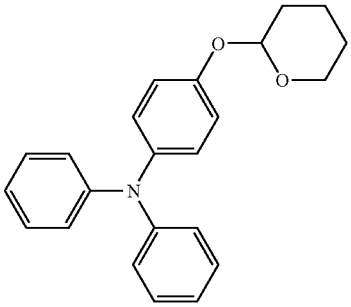
III-3
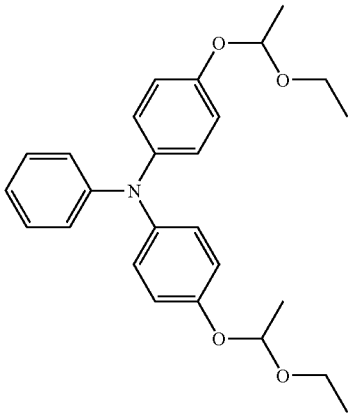
III-4
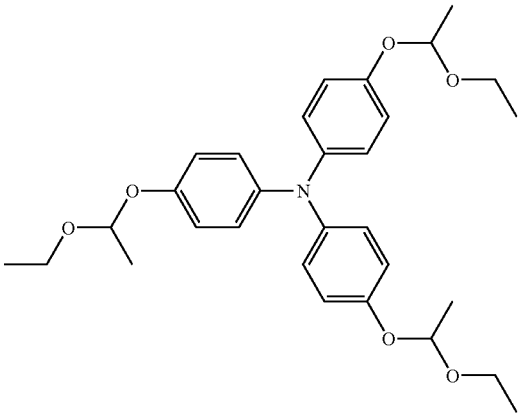
III-5
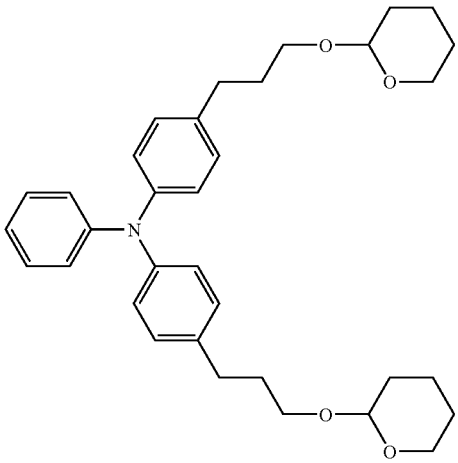
III-6
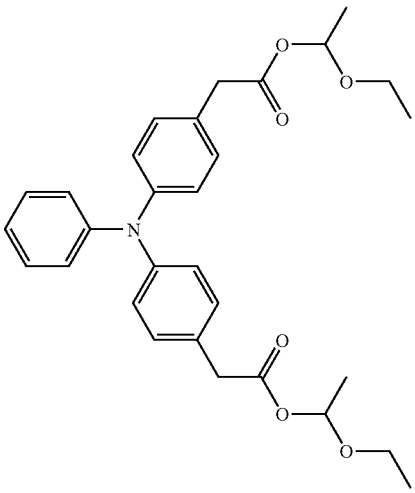

-continued
III-7
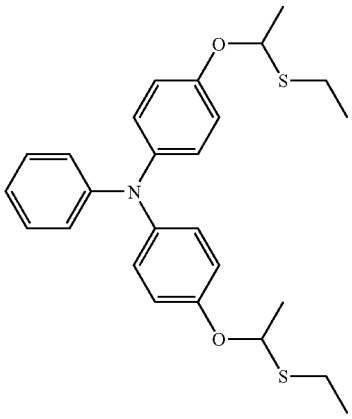
III-8
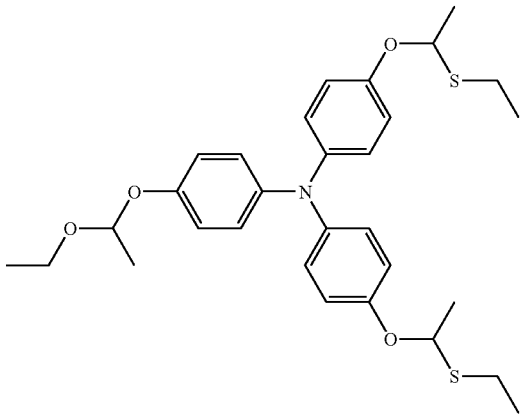
III-9
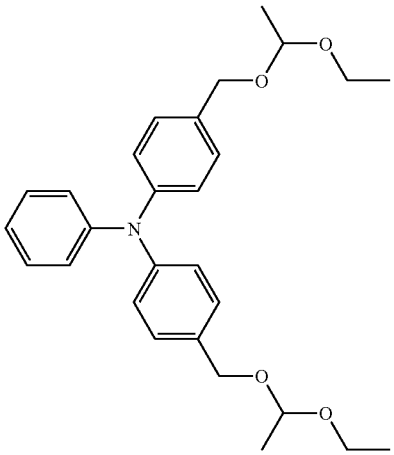
III-10
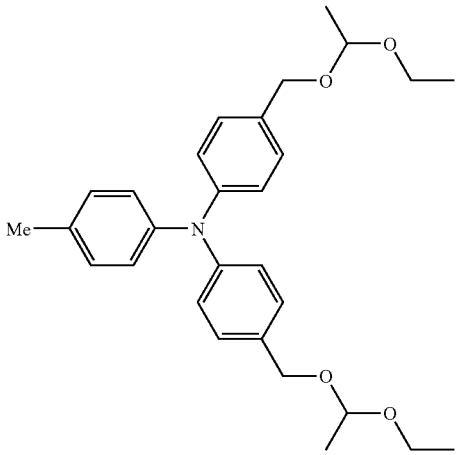
III-11
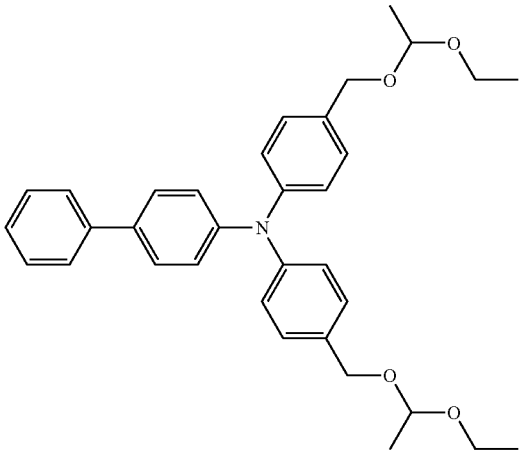
III-12
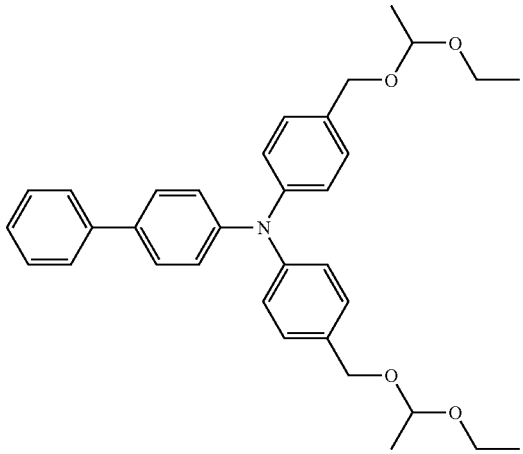

-continued
III-13
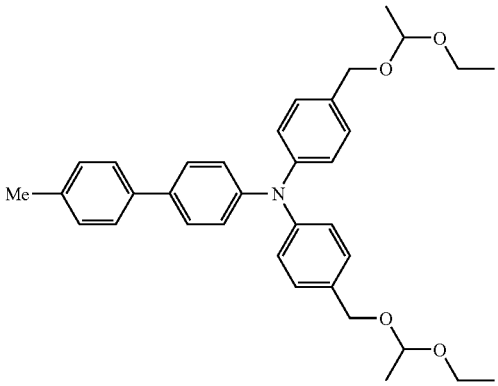
III-14
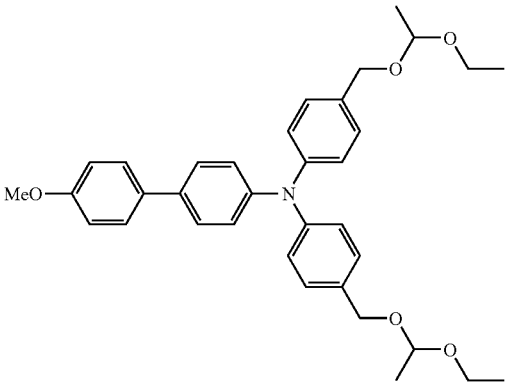
III-15
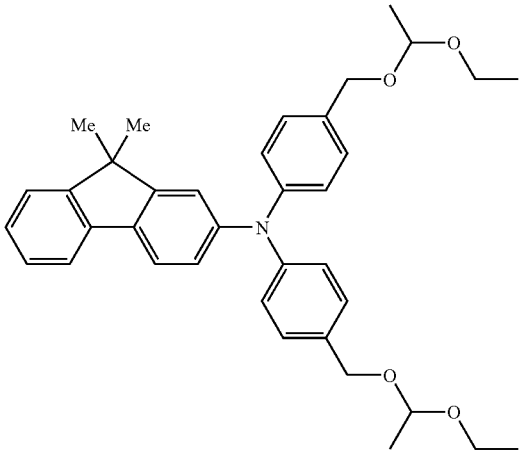
III-16
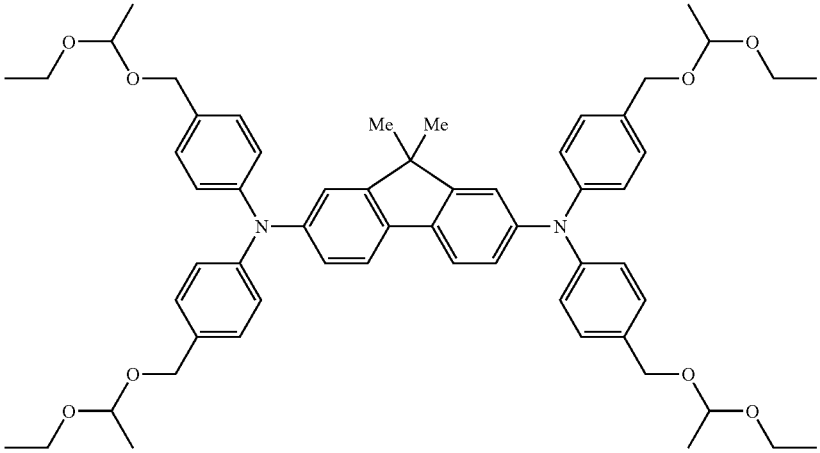
III-17
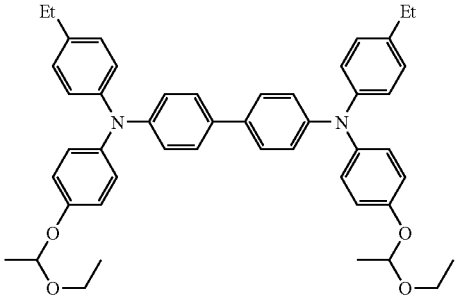
III-18
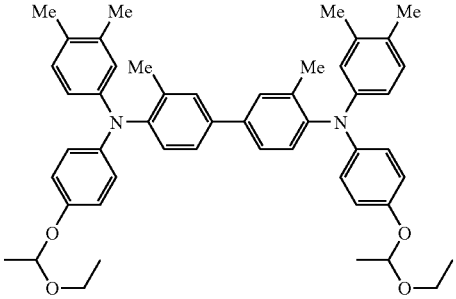

-continued
III-19
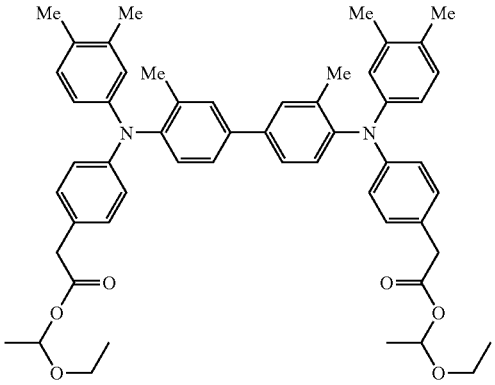
III-20
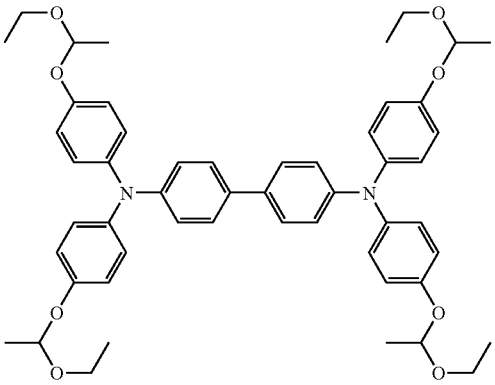
III-21
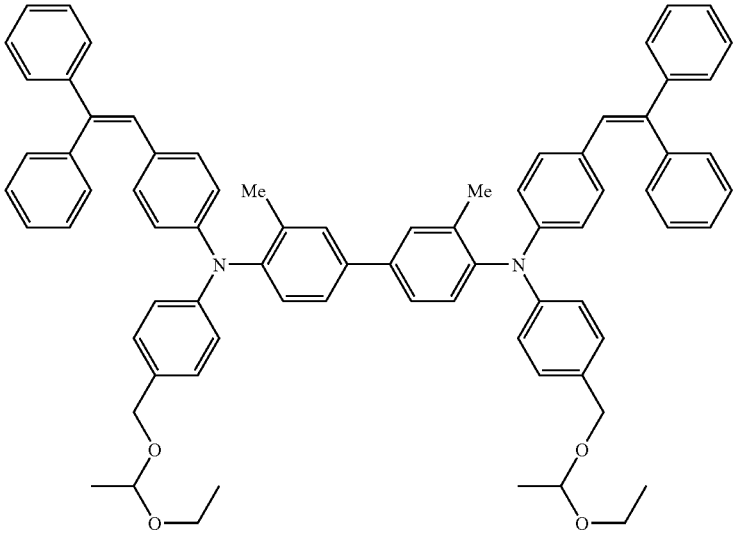
III-22
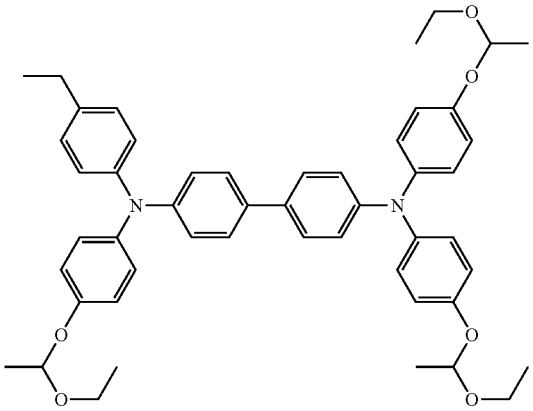

-continued
III-23
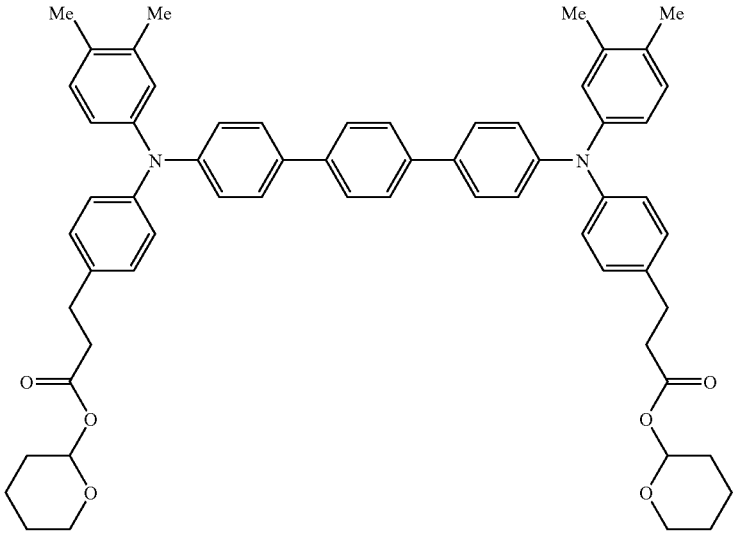
III-24
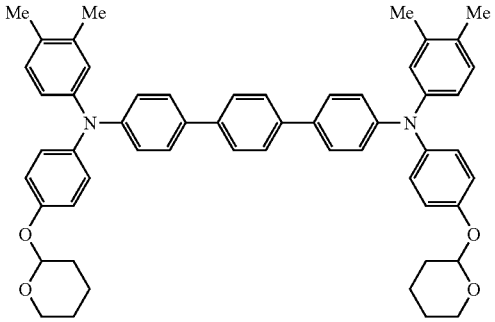
III-25
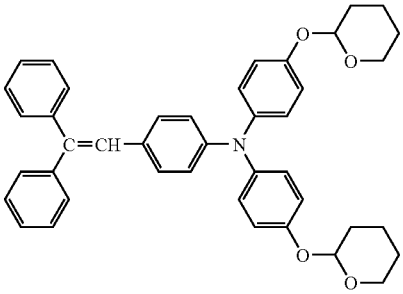
III-26
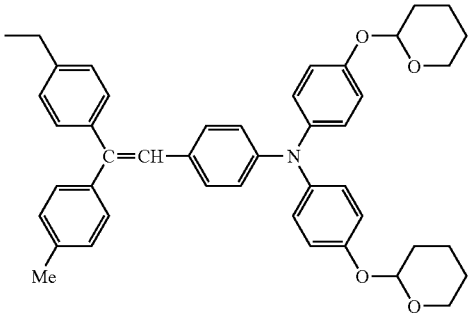
III-27
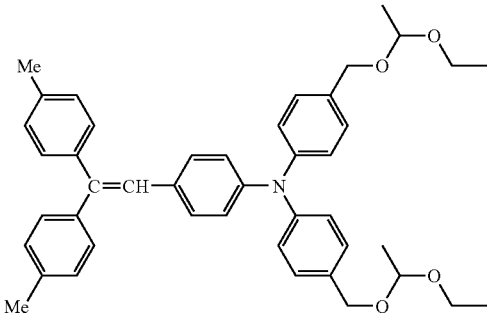
III-28
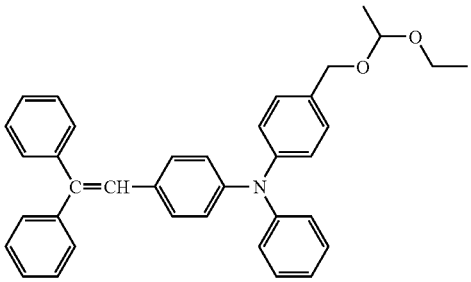
III-29
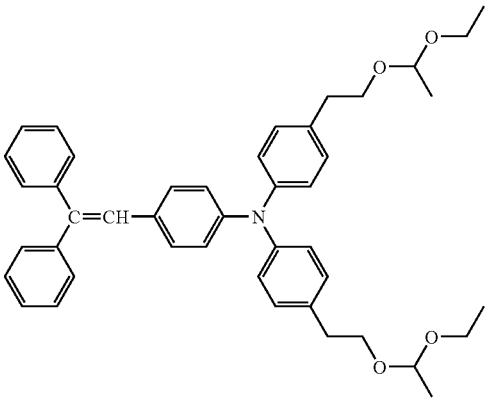

-continued
III-30
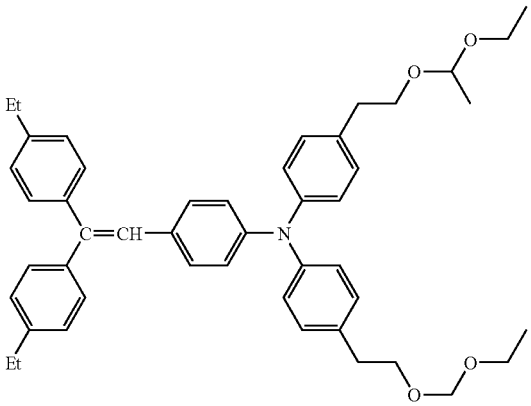
III-31
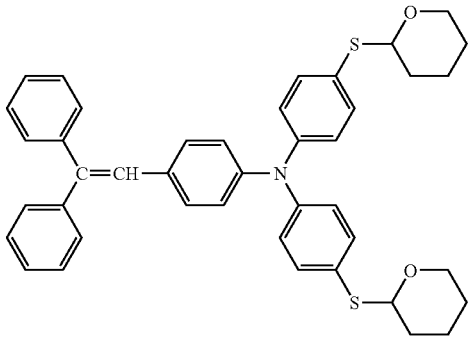
III-32
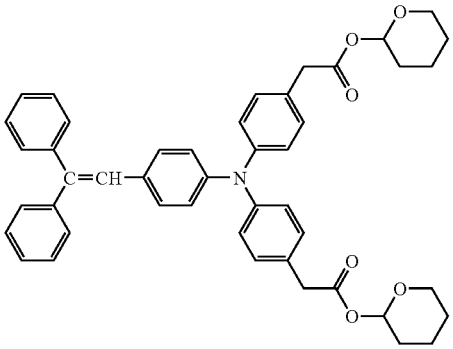
III-33
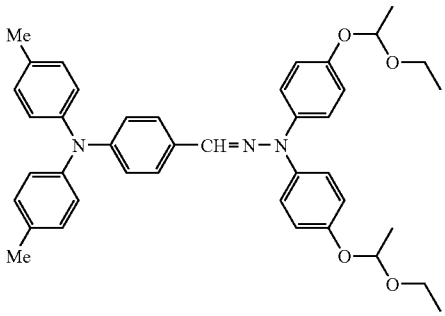
III-34
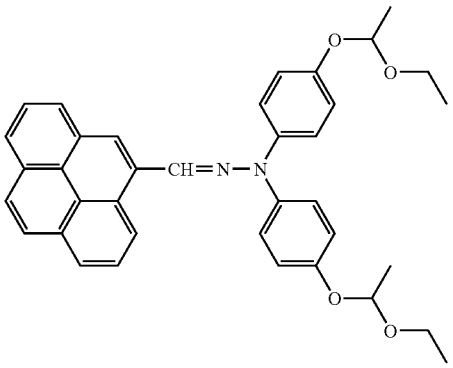
III-35
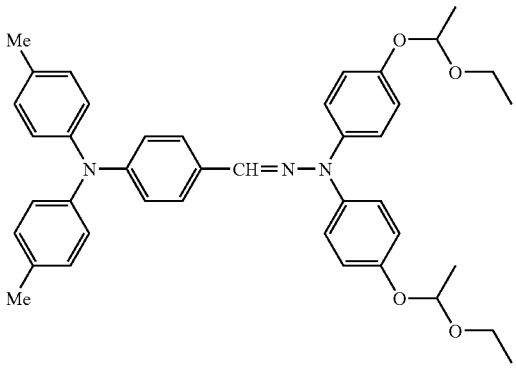
III-36
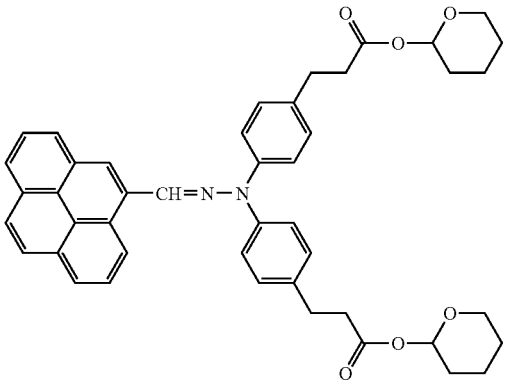
III-37
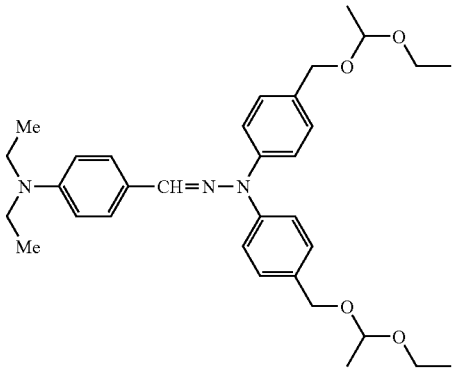

-continued
III-38
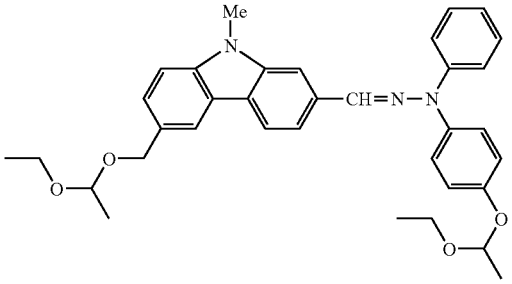
III-39
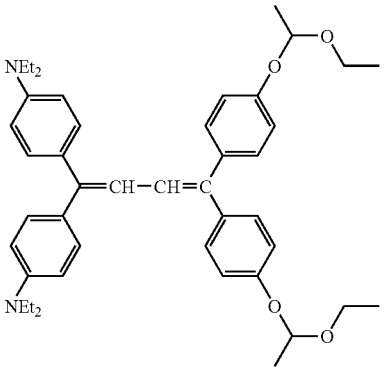
III-40
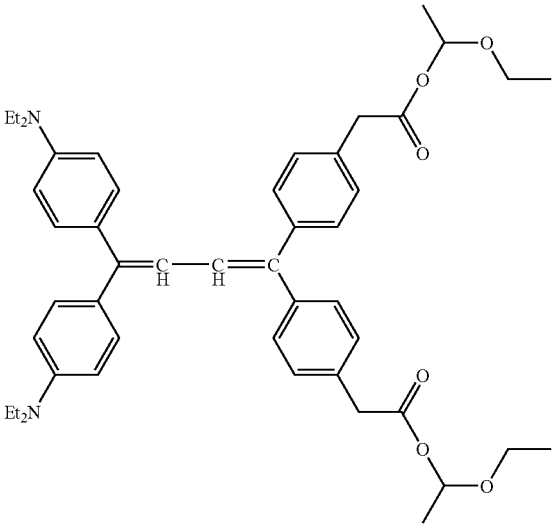
Specific Examples Represented by Formula (IV)
IV-1
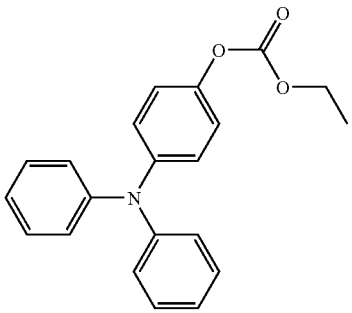
-continued
IV-2
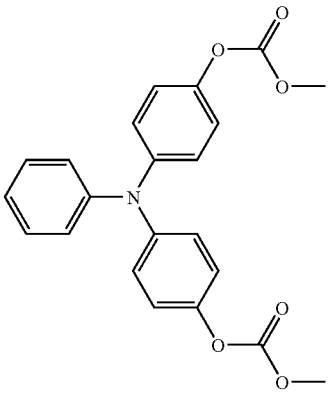

-continued
IV-3
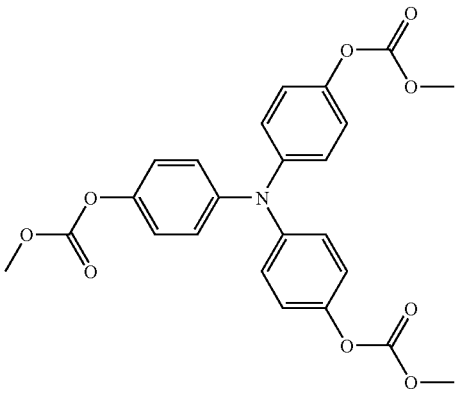
IV-4
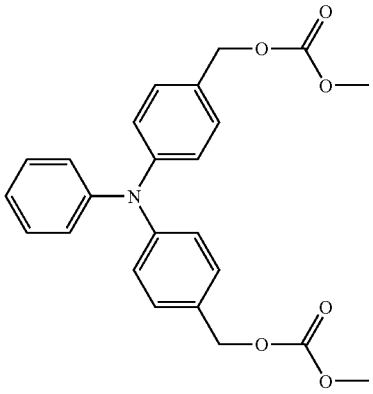
IV-5
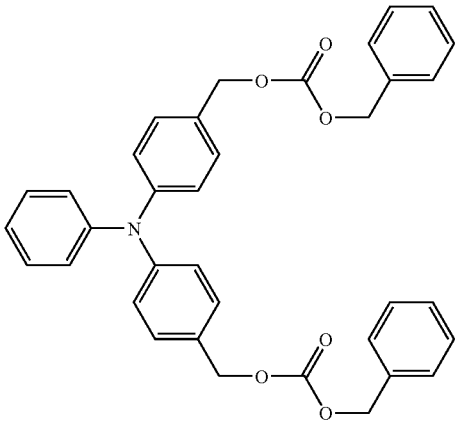
-continued
IV-6
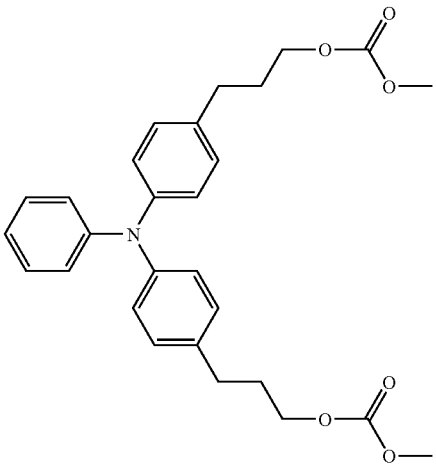
IV-7
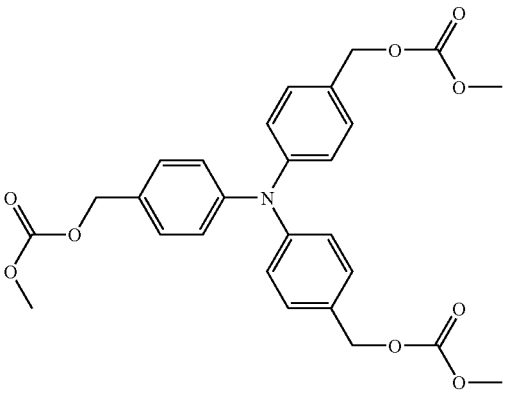
IV-8
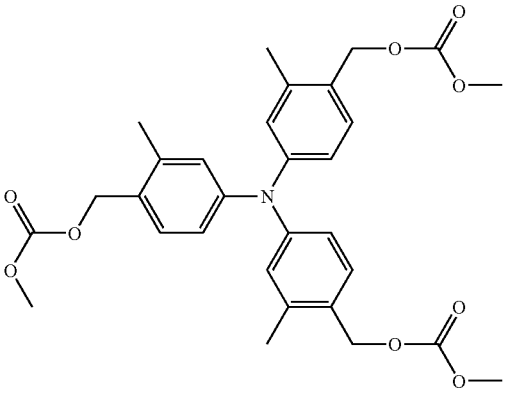

-continued
IV-9
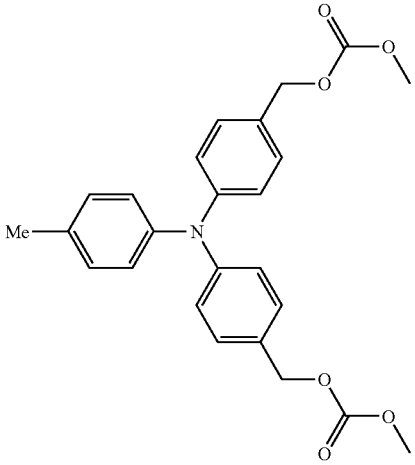
IV-10
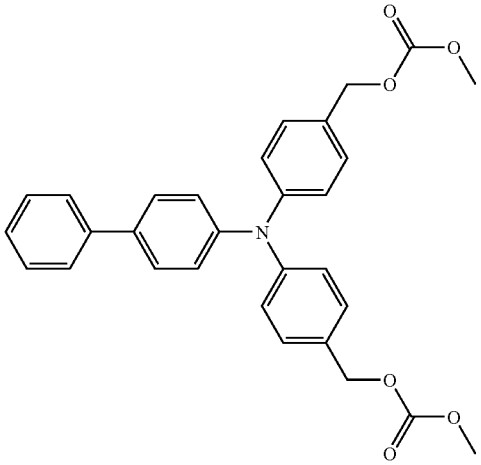
IV-11
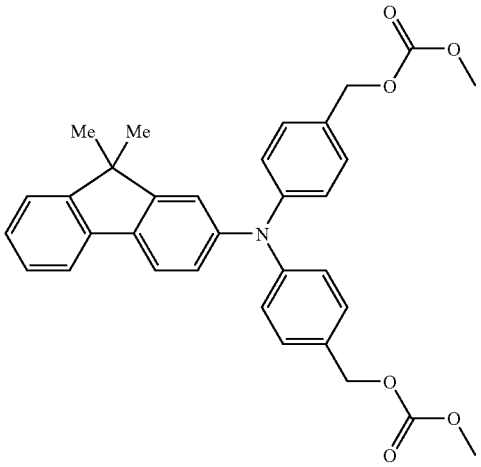
-continued
IV-12
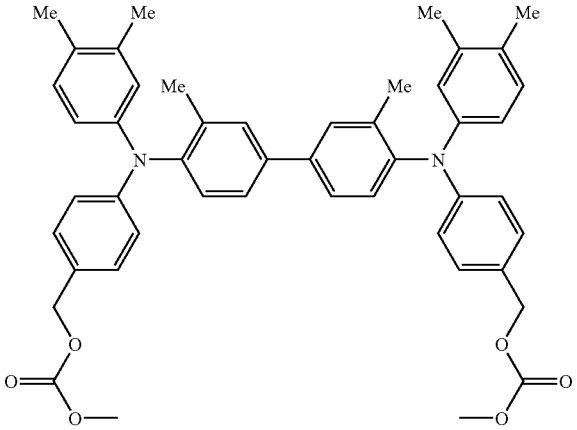
IV-13
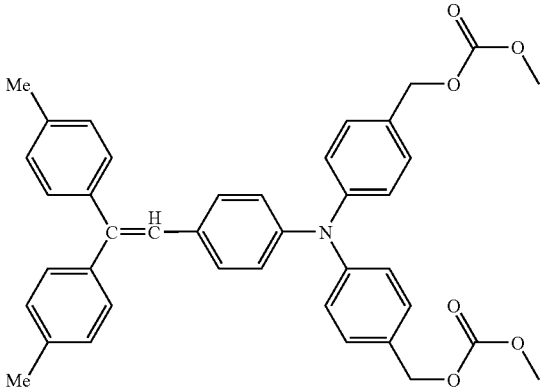
Specific Examples Represented by Formula (V)
V-1
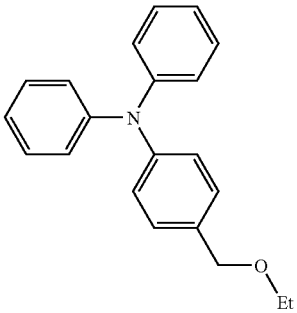
V-2
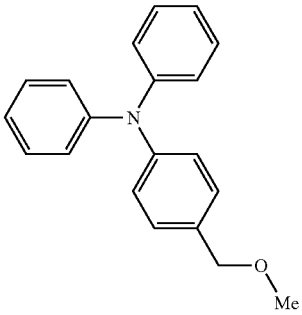

-continued
V-3
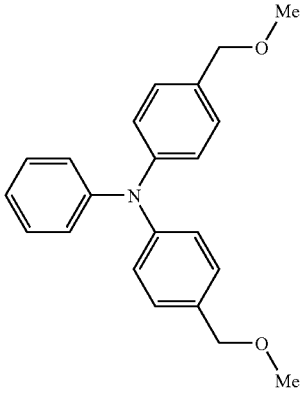
V-4
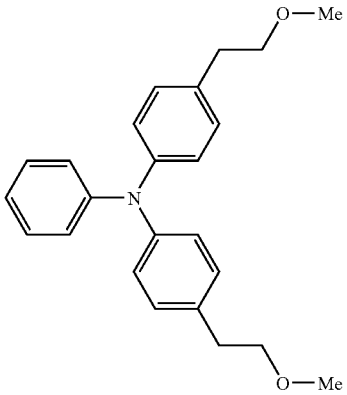
V-5
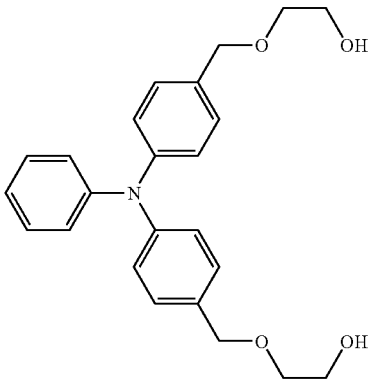
V-6
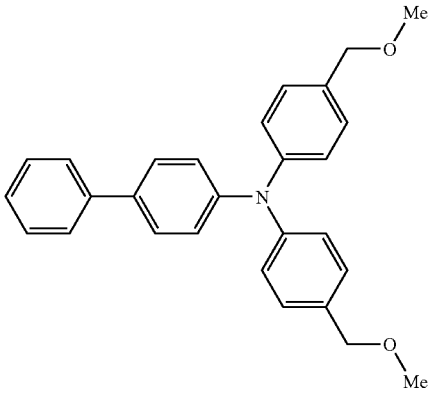
-continued
V-7
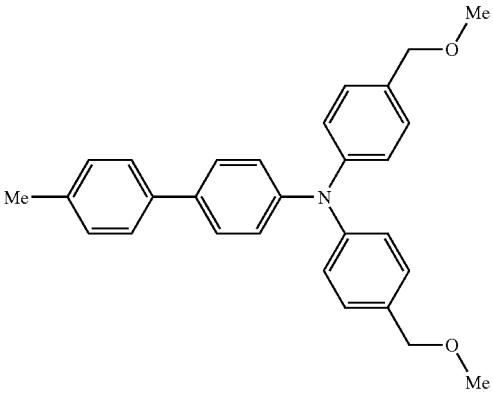
V-8
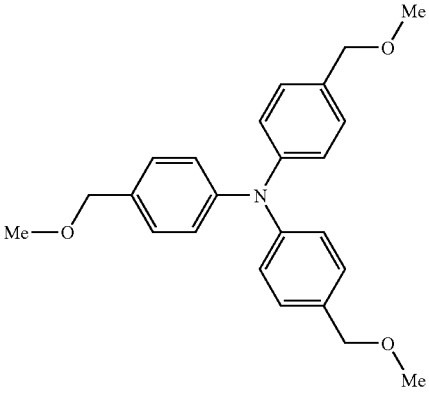
V-9
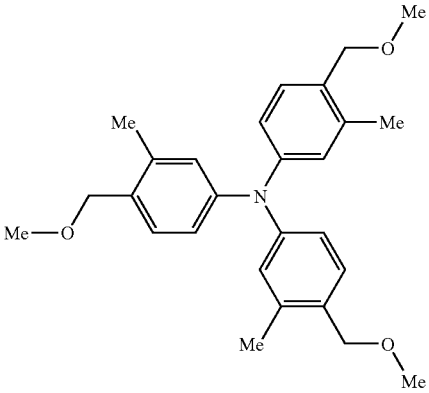
V-10
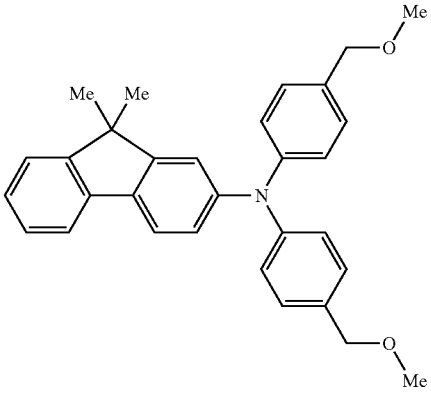

-continued

V-11

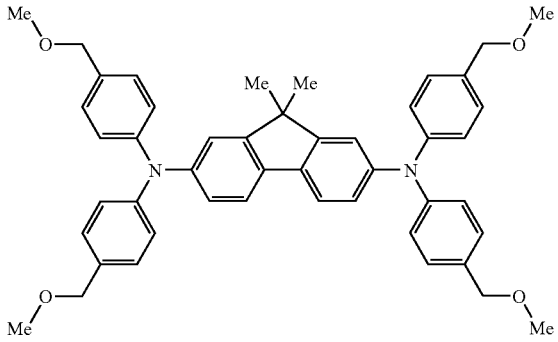

V-12

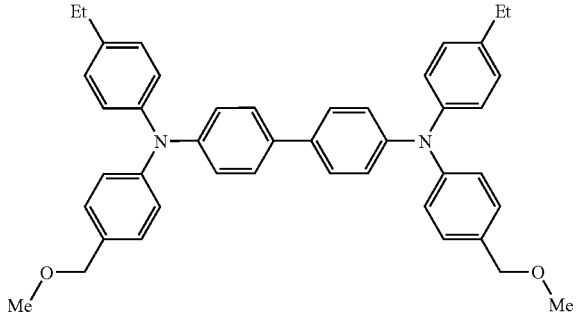

V-13

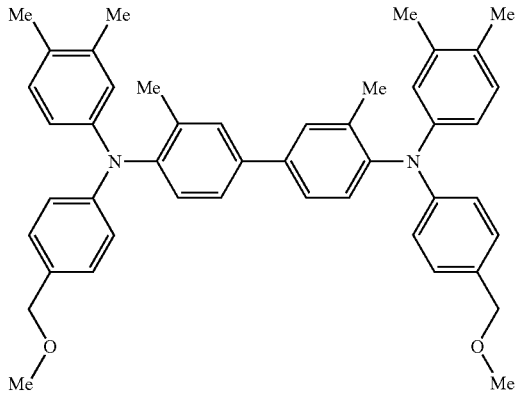

V-14

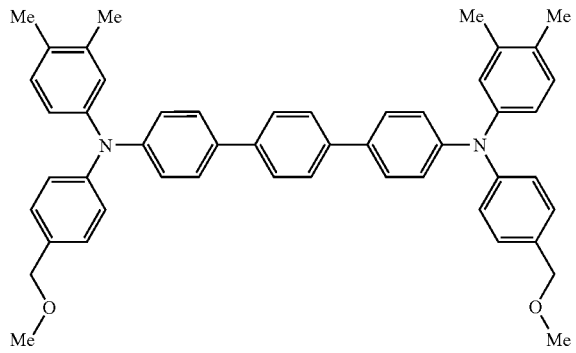

-continued

V-15

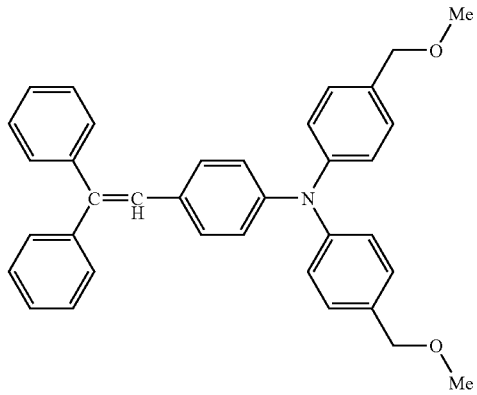

V-16

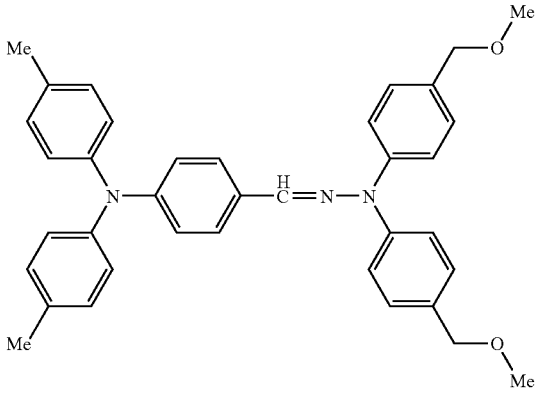

V-17

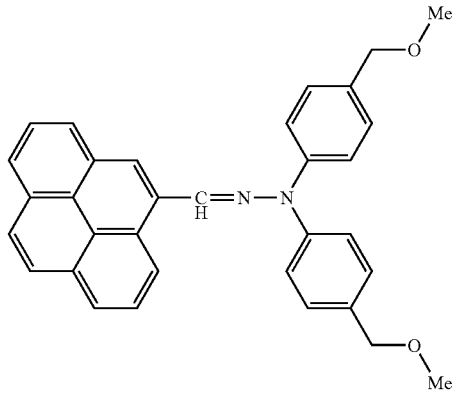

3. Other Aditives

Furthermore, mixtures of other coupling agents and fluorine compounds may also be use in the outermost surface layer 5. Specifically, various silane coupling agents and commercial silicone based hard coat agents may be used for these compounds.

Silane coupling agents include, for example, vinyl trichlorosilane, vinyl trimethoxy silane, vinyl triethoxy silane, γ-glycidoxy propyl methyl diethoxy silane, γ-glycidoxy propyl trimethoxy silane, γ-glycidoxy propyl triethoxy silane, γ-aminopropyl triethoxy silane, γ-aminopropyl trimethoxy silane, γ-aminopropyl methyl dimethoxy silane, N-β(aminoethyl) γ-aminopropyl triethoxy silane, tetramethoxy silane, methyl trimethoxy silane, dimethyl dimethoxy silane, or the like.

The commercial hard coating agents include, for example, KP-85, X-40-9740, X-40-2239 (manufactured by Shin-Etsu Chemical Co., Ltd), AY42-440, AY42-441 or AY49-208 (manufactured by Dow Corning Toray). For conferring water repellency etc., fluorine-containing compounds such as (tridecafluoro-1,1,2,2-tetrahydrooctyl) triethoxy silane, (3,3,3-trifluoropropyl) trimethoxy silane, 3-(heptafluoroisopropoxy) propyl triethoxy silane, 1H, 1H,2H,2H-perfluoroalkyl triethoxy silane, 1H, 1H,2H,2H-perfluorodecyl triethoxy silane and 1H, 1H,2H,2H-perfluoroctyl triethoxy silane may be added.

Although the amount contained of a fluorine containing compound in the outermost surface layer 5 is not particularly limited, it is preferable that the amount is 0.25 times by weight the amount of the non-fluorine containing compound or less.

Moreover, a resin that dissolves in an alcohol may also be added to the outermost surface layer 5. The following examples may be given of such alcohol soluble resins, for example, polyvinyl butyral resins, polyvinyl formal resins, polyvinyl acetal resins such as partially acetalized polyvinyl acetal resin, in which a portion of the butyral is denatured by formal, acetoacetal, or the like (for example, the S-LEC B, K manufactured by Sekisui Chemical Co., Ltd.), polyamide resins, cellulosic resins, polyvinyl phenol resins and the like. Polyvinyl acetal resins and polyvinyl phenol resins are particularly preferable in view of their electrical properties.

The weight average molecular weight of the resin is preferably 2,000 to 100,000 and more preferable from 5,000 to 50,000. It is preferable that the amount added of such a resin is from 1 wt % to 20 wt %, more preferably from 1 wt % to 15 wt %, and further preferably from 2 wt % to 20 wt % with respect to the amount of total solids of the outermost surface layer 5.

It is preferable that an antioxidant is added to the outermost surface layer 5. By raising the mechanical hardness of the surface of the photoreceptor, the life of the photoreceptor is extended, and, since the photoreceptor might be in contact with oxidizing gases for a long period of time, stronger resistance to oxidation than before has been required. As an antioxidant, a hindered phenol based or a hindered amine based antioxidant is preferable, and well-known organic sulfur based antioxidants, phosphite based antioxidants, dithiocarbamate based antioxidants, thiourea based antioxidants, benzimidazole based antioxidants, and the like may be used. It is preferable that the addition amount of an antioxidant is 20 wt % or less, with 10 wt % or less being more preferable.

For hindered phenolic antioxidants the following examples may be given, including, for example, 2,6-di-t-butyl-4-methyl phenol, 2,5-di-t-butylhydroquinone, N,N'-hexamethylene bis(3,5-di-t-butyl-4-hydroxyhydrocinnamide) 3,5-di-t-butyl-4-hydroxy-benzylphosphonate-diethylester, 2,4-bis [(octylthio)methyl]-o-cresol, 2,6-di-t-butyl-4-ethylphenol, 2,2'-methylenebis (4-methyl-6-t-butyl phenol) 2,2'-methylenebis (4-ethyl-6-t-butyl phenol), 4,4'-butylidenebis (3-methyl-6-t-butyl phenol) 2,5-di-t-amylhydroquinone, 2-t-butyl-6-(3-butyl-2-hydroxy-5-methylbenzyl)-4-methylphenylacrylate, 4,4'-butylidenebis (3-methyl-6-t-butyl phenol), and the like.

Furthermore, various particles may also be added to the outermost surface layer 5. Examples that may be given of such particles are particles that contain silicon. Silicon containing particles are particles which contain silicon in their constituent elements, and, specific examples thereof which may be given include colloidal silica, silicone particles or the like.

Colloidal silica used as the silicon containing particles may be suitably selected from silica particles, having a mean particle diameter of from 1 nm to 100 nm, and preferably from 10 nm to 30 nm, in acidic or alkali aqueous dispersions, or in organic solvent dispersions, such as alcohol, ketone, and esters, and generally available colloidal silicas may be used.

Although the solid content of the colloidal silica in the outermost surface layer 5 is not particularly limited, in view of the film forming ability, electrical properties, and hardness, the amount used is preferably in the range from 0.1 wt % to 50 wt % with respect to the amount of total solids of the outermost surface layer 5, and the amount used is more preferably from 0.1 wt % to 30 wt %.

As silicone particles used for the silicon containing particles, these may be selected from silicone resin particles, silicone rubber particles, and silicone-surface-treated silica particles, and generally available particles may be used therefore. These silicone particles are substantially spherical, and preferably have a mean particle diameter of from 1 nm to 500 nm, and more preferably from 10 nm to 100 nm.

The amount contained of the silicone particles in the outermost surface layer 5 is preferably 0.1 wt % to 30 wt % with respect to the amount of total solids of the outermost surface layer 5, and is more preferably from 0.5 wt % to 10 wt %.

Examples of other particles are fluorine-containing particles of ethylene tetrafluoride, ethylene trifluoride, propylene hexafluoride, vinyl fluoride or vinylidene fluoride; resin particles of a copolymer of fluororesin and hydroxyl group-containing monomer described in Preprint for 8th Polymer Material Forum Meeting, p. 89; and metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO or MgO.

Moreover, oils, such as silicone oils, may also be added to the outermost surface layer 5. Examples that may be given of silicone oils, include, for example: silicone oils, such as dimethylpolysiloxane, diphenylpolysiloxane, and phenylmethyl siloxane; reactive silicone oils, such as amino-denatured polysiloxane, epoxy-denatured polysiloxane, carboxyl-denatured polysiloxane, carbinol-denatured polysiloxane, methacryl-denatured polysiloxane, mercapto-denatured polysiloxane, and phenol-denatured polysiloxane; cyclic dimethylcyclosiloxanes, such as hexamethylcyclotrisiloxane, octamethylcyclotetrasiloxane, decamethylcyclopentasiloxane, dodecamethylcyclohexasiloxane; cyclic methylphenylcyclosiloxanes, such as 1,3,5-trimethyl-1,3,5-triphenylcyclotrisiloxane, 1,3,5,7-tetramethyl-1,3,5,7-tetraphenylcyclotetrasiloxane, 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes, such as (3,3,3-trifluoropropyl)methylcyclotrisiloxane; hydrosilyl group containing cyclosiloxanes, such as methylhydrosiloxane mixtures, pentamethylcyclopentasiloxane and phenylhydrocyclosiloxane; vinyl group containing cyclosiloxanes, such as pentavinylpentamethylcyclopentasiloxane. The silicone oils may be used alone or in combination of two or more thereof.

4. Method of Producing the Outermost Surface Layer 4-1 Coating Method

Since the outermost surface layer 5 of the present exemplary embodiment has a continuous gradient (concentration distribution) of the proportion of the content of the curable resin in the layer thickness direction within the single outermost surface layer 5, it is preferable to form the coating layer using an inkjet method.

In the liquid droplets ejected from a liquid droplet discharge head in an inkjet method, the solids concentration thereof increases during the flight as the liquid droplets reach the base material. The liquid droplets coalesce with each other on the base material and leveling occurs to form a liquid film, and a dry coating film is formed by further drying and solidifying. An indicator L showing the ease of leveling is a function of the surface tension of the coating film, the wet layer thickness, the viscosity and the wavelength. The contribution of the wavelength is the greatest, and the leveling properties are raised by increasing the resolution at the time of impact.

Therefore, by using an inkjet method, which may eject to the target position liquid droplets with a small variation in liquid droplet diameter, a thin layer may be formed with precisely controlled concentration distribution and layer thickness distribution.

For the ejecting method of an inkjet method, there are generally used continuous methods and intermittent methods (such as piezo-type (using piezo electric elements), thermal-type (using heat element), and electrostatic-type). A piezo continuous or intermittent method is preferable, and, from the point of view of forming a thin film and reducing the amount of waste liquid, a piezo intermittent method is more preferable.

The FIGS. 4 to 13 below, are explanatory diagrams of a scanning intermittent inkjet method, but the outermost surface layer 5 of the present exemplary embodiment is not limited to being formed by this method. A scanning method is a method in which liquid coating is carried out by ejecting liquid droplets while scanning a liquid droplet discharge head in a direction that is parallel to the axial direction of a cylindrical support.

Figure 4:
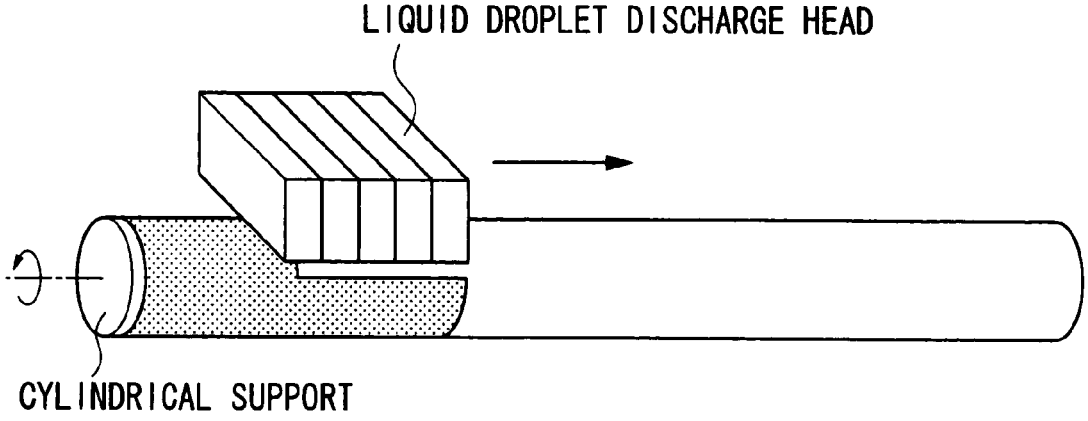
FIG. 4 is an illustration showing an example of an inkjet method in the case where two or more droplet discharge heads are arranged in a matrix.

FIG. 4 is an example of an inkjet method using a liquid droplet discharge head of a normal inkjet printer, and this liquid droplet discharge head has plural nozzles along the length direction thereof, with plural liquid droplet discharge heads arranged in a matrix. In the figure there is a simple syringe illustrated for supplying liquid. When the axis of a cylindrical support is placed in the horizontal, then coating is carried out of a normal cylindrical support while the support is being rotated. The resolution of the ejecting, which has an influence on the quality of the coating film, is determined by the angle of the nozzle rows to the scanning direction.

Figure 5:
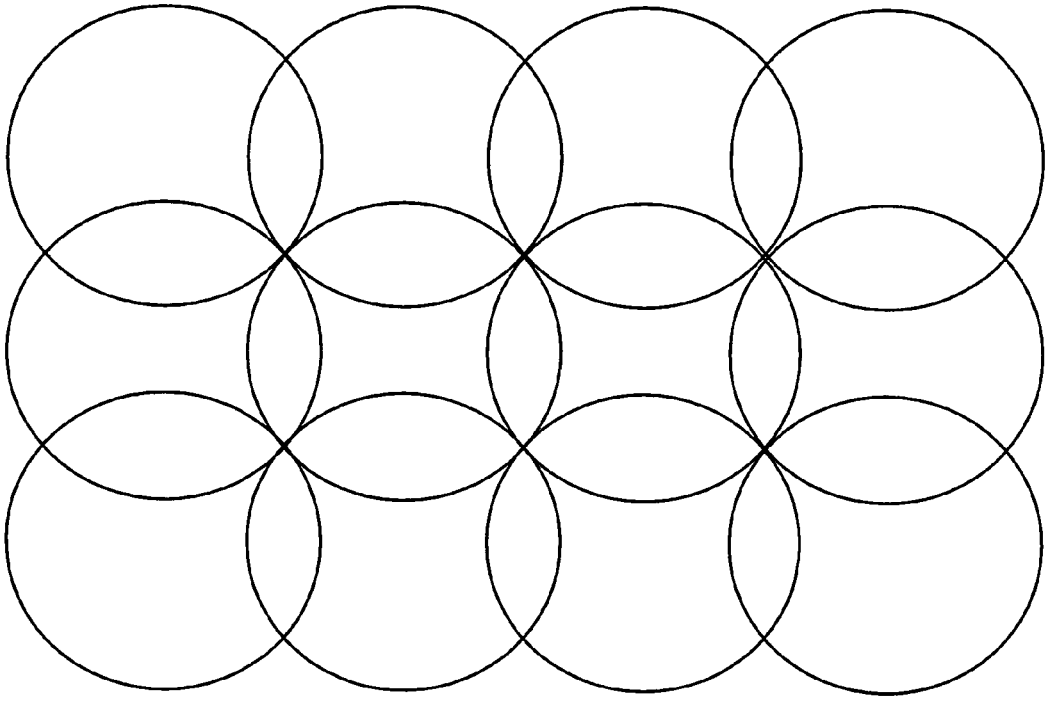
FIG. 5 is an explanatory diagram of the appearance of liquid droplets of application liquid on impact with an inkjet method.

It is preferable that the resolution of the ejecting liquid droplets (number of pixels of coating liquid per inch) is adjusted such that, as is shown in FIG. 5, after the liquid droplets have impacted, the liquid droplets spread out and neighboring liquid droplets touch each other, so that finally a film is formed. Coating may be carried out with consideration to the surface tension on the base material side, and way in which the liquid droplets spread out on impact, the size of the liquid droplets at ejecting, the concentration of coating solvent and the type of coating solvent medium, which are influences on the speed of solvent evaporation and the like. These conditions are determined according to the type of material and material composition of the coating liquid, and the physical properties of the surface to be coated, and it is preferable that they are adjusted.

Figure 6A:
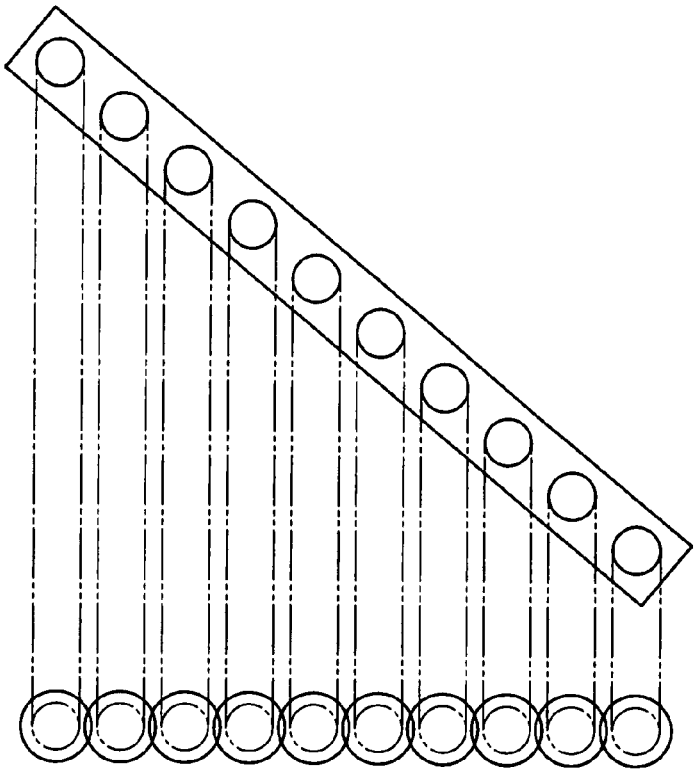
FIGS. 6A and 6B are illustrations showing methods of forming a charge-generating layer by an inkjet method.
Figure 6B:
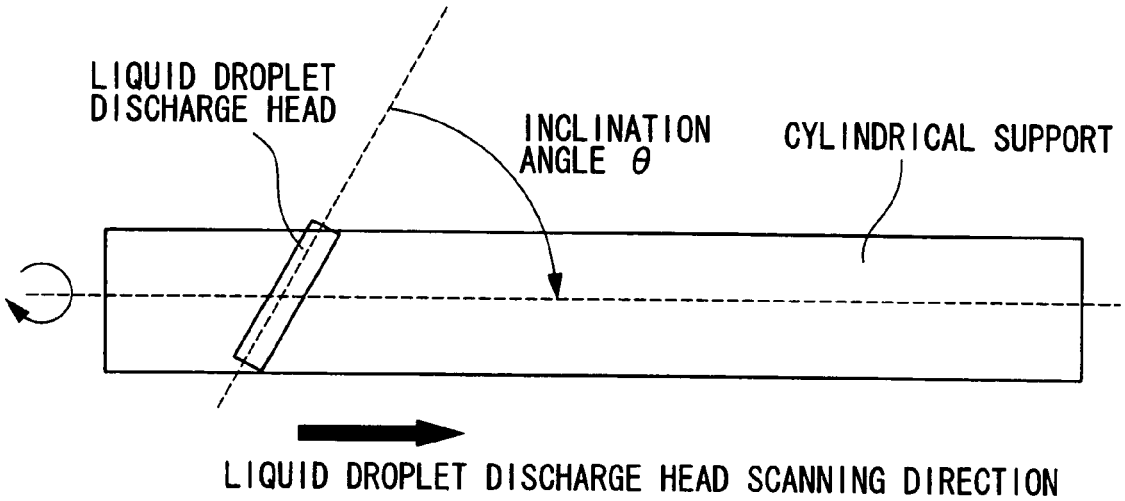

However, since it is difficult to reduce the nozzle separation distance in the above piezo-type inkjet liquid droplet discharge head and to raise the resolution, it is preferable that the nozzle arrangement spacing is considered, and each of the liquid droplet discharge heads are placed at an angle to the axis of the photoreceptor, as shown in FIGS. 6A and 6B, so that after liquid droplets have been ejected and impacted, neighboring liquid droplets touch each other, as shown in FIG. 5, this giving a higher resolution appearance. As is shown in FIG. 6A, the diameters of the liquid droplets on ejecting, shown by dotted lines, are of the same order as the diameter of the nozzles, but after impacting on the surface of the cylindrical support the liquid droplets spread out to touch neighboring liquid droplets, as shown by the solid lines, and form a layer.

Figure 7:
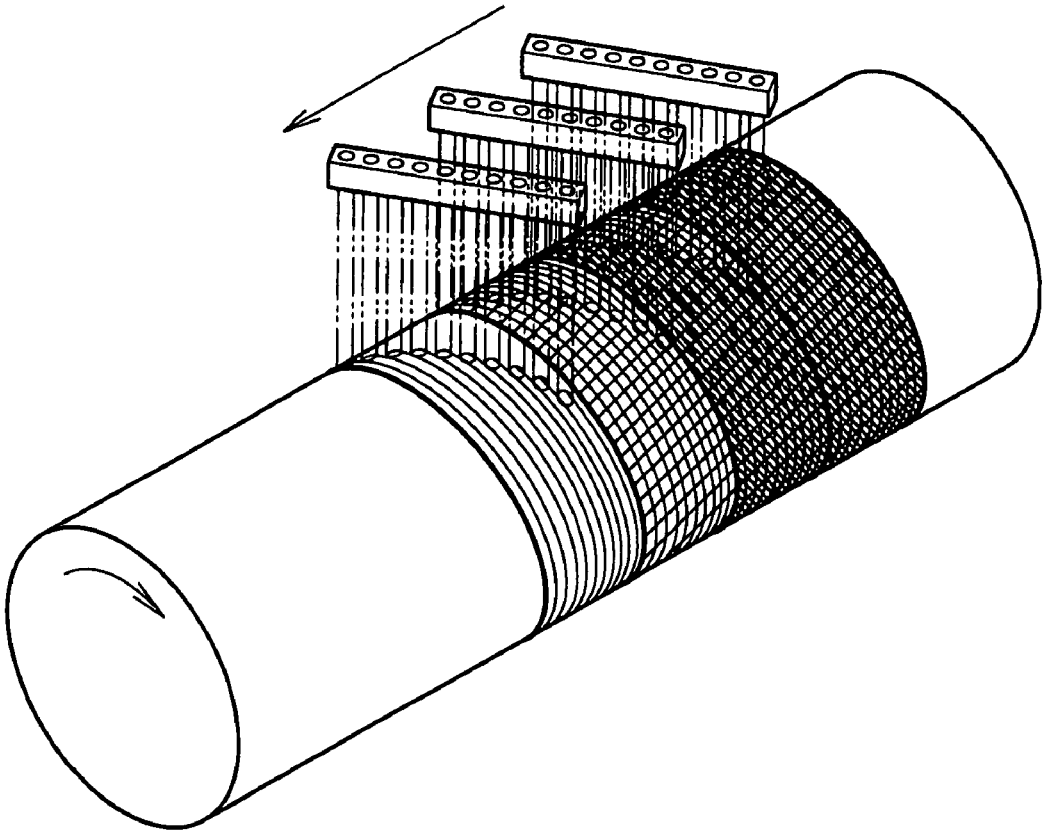
FIG. 7 is illustration showing a method of forming an outermost surface layer 5 by an inkjet method.

In this state, the cylindrical support is rotated, and coating liquid is ejected from the nozzles, and, as shown in FIG. 7, the liquid droplet discharge heads are horizontally moved from the one end portion of the cylindrical support to the opposite end portion thereof. Superimposed coating is carried out to make the thickness of the charge-transporting layer thicker.

Specifically, the cylindrical support is mounted in a device that is able to rotate the cylindrical support horizontally, and liquid droplet discharge heads that have been filled with charge-transporting layer coating liquid are disposed so that liquid droplets are ejected onto the cylindrical support. Since the radius of the cylinder on to which ejecting takes place is small, it is preferable that the nozzles that do not cause liquid droplets to impact onto the cylinder are closed off, from the point of view of reducing the amount of waste liquid.

In this case a base material to be coated that is in the shape of a cylinder has been shown, however, relative movement may be made of a base material and liquid droplet discharge heads for a base material to be coated that has a flat surface.

The concentration gradient of the curable resin in the layer thickness direction in the outermost surface layer 5 may be formed by changing the ejecting proportions of two or more outermost surface layer coating liquids that have different proportions of content of the curable resin, and ejecting the coating liquids from Liquid droplet discharge heads.

Figure 8:
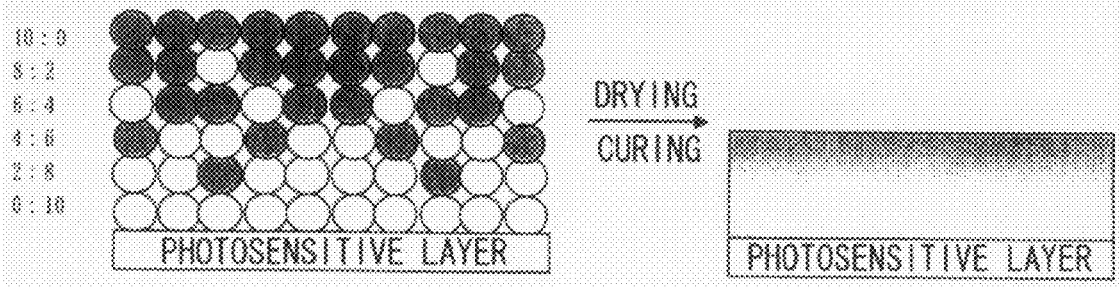
FIG. 8 is a representational diagram showing an exemplary embodiment when forming an outermost surface layer 5 according to the present invention by an inkjet method.

Specifically the gradient may be formed, for example, when there is a coating liquid A that has a high concentration of curable resin and a coating liquid B that has a low concentration of curable resin, by gradually changing the proportions ejected of coating liquid A and coating liquid B, for example from 0:5, to 1:4, to . . . 4:1, to 5:0, as shown in FIG. 8. With this method, a concentration gradient of the curable resin may be formed by a minimum of two coating liquids.

Furthermore, a concentration gradient of the curable resin in the layer thickness direction in the outermost surface layer 5 may be formed by coating in sequence and superimposing two or more outermost surface layer coating liquids with different proportions of content of the curable resin.

Figure 9:
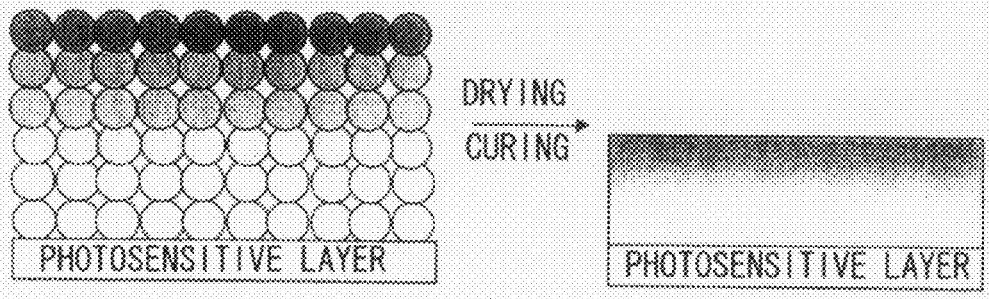
FIG. 9 is a representational diagram showing another exemplary embodiment when forming an outermost surface layer 5 according to the present invention by an inkjet method.

For example, by providing plural inkjet nozzles, arranged in order according to the concentration of plural coating liquids with different concentrations of curable resin, then, as shown in FIG. 9, an inclined concentration gradient layer may be formed by ejecting coating liquids in sequence such that the concentration of the curable resin increases. In this method, a concentration gradient of the curable resin may even be formed just by changing the kind of the coating liquid, without the need to change the control conditions such as the ejecting amount and ejecting position when ejecting.

FIGS. 8 and 9 are schematic images for explaining the pattern when the outermost surface layer 5 of the present exemplary embodiment is formed by an inkjet method, and, of course, the present exemplary embodiment is not limited to the schematic images, in which there is a continuous presence of the liquid droplet state at the photoreceptor layer.

In order to achieve the curved increases in the ratio contained of the curable resin in the layer thickness direction, as shown in FIGS. 3B and 3C, the ejecting proportions of two kinds of coating liquid that have different ratios of curable resin contained therein may by changed along the curved lines, or plural kinds of coating liquid may be prepared with different concentrations of curable resin to match the curved lines, and the these liquids ejected in order of concentration.

It is preferable to adjust the thickness of the outermost surface layer 5 in consideration of the resolution of the ejecting of the liquid droplets, the way in which the liquid droplets spread out on impact, the size of the liquid droplets on ejecting, and the solvent evaporation speed that stems from the concentration of coating solvent and the coating solvent medium and the like.

Figure 10:
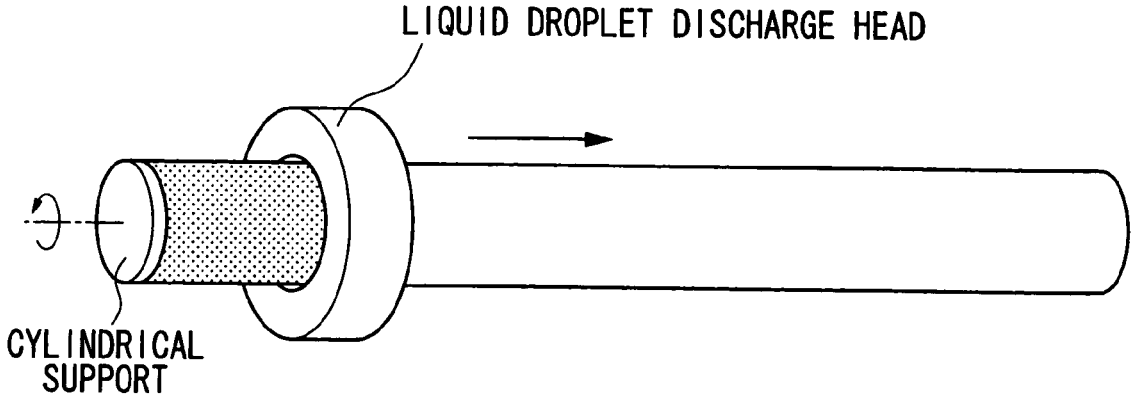
FIG. 10 is an example of an inkjet method by a liquid droplet discharge head designed so as to surround the circumference of a cylindrical support.

FIG. 10 shows a design such that a liquid droplet discharge head surrounds the circumference of a base material to be coated. Ejection nozzles are normally formed at a uniform spacing in the circumferential direction. By using a cylindrical liquid droplet discharge head, there is less unevenness of the layer thickness in the circumferential direction, and it is possible to form a layer without noticeable spiral stripes.

Figure 11:
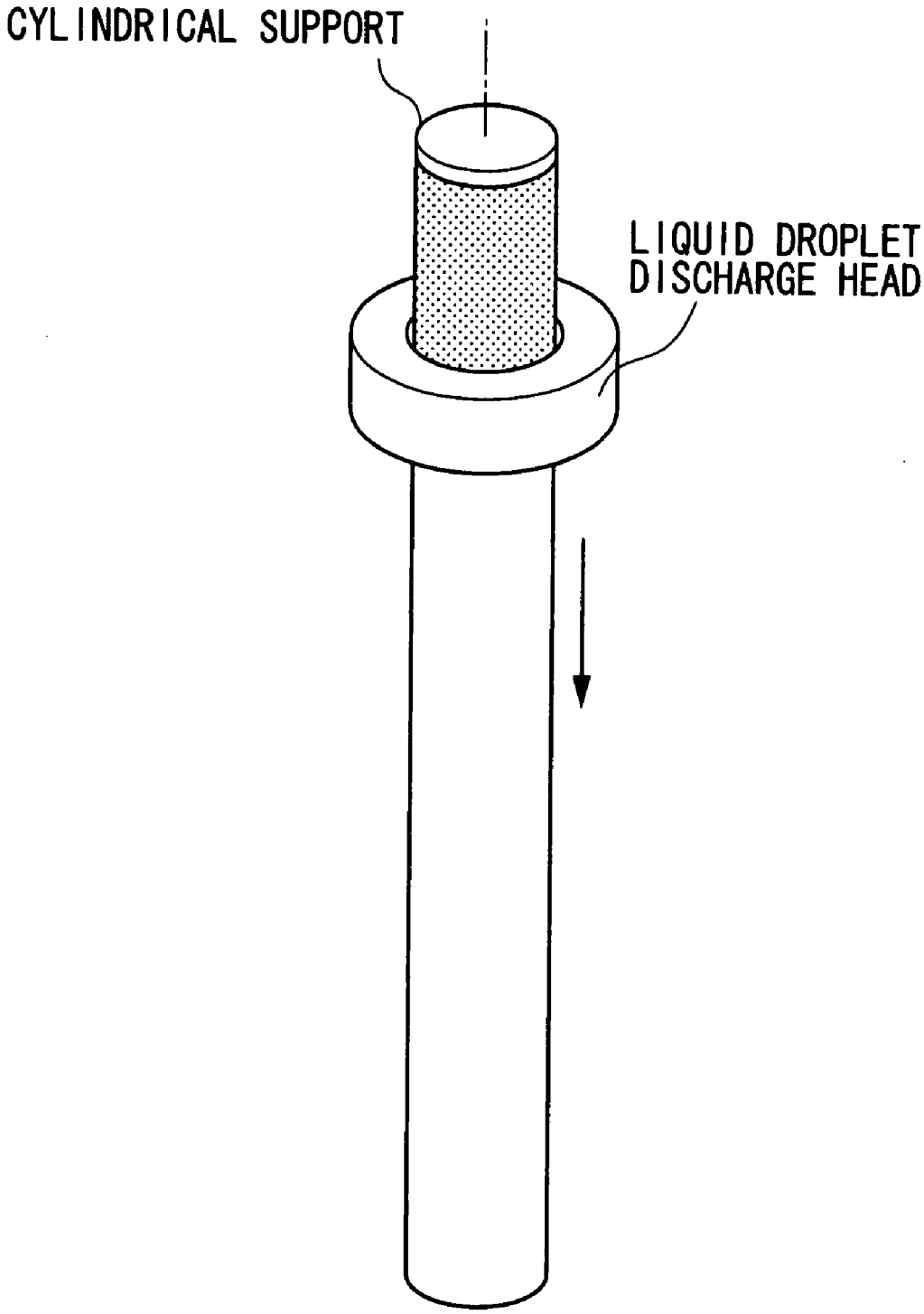
FIG. 11 is an example of an inkjet method in the case where the constitution of FIG. 10 is displaced in the vertical direction.

FIG. 11 is the configuration of FIG. 10 placed in an upright direction. Here, "upright" does not just mean at 90°, and the configuration may be at an angle to the 90°.

Figure 12:
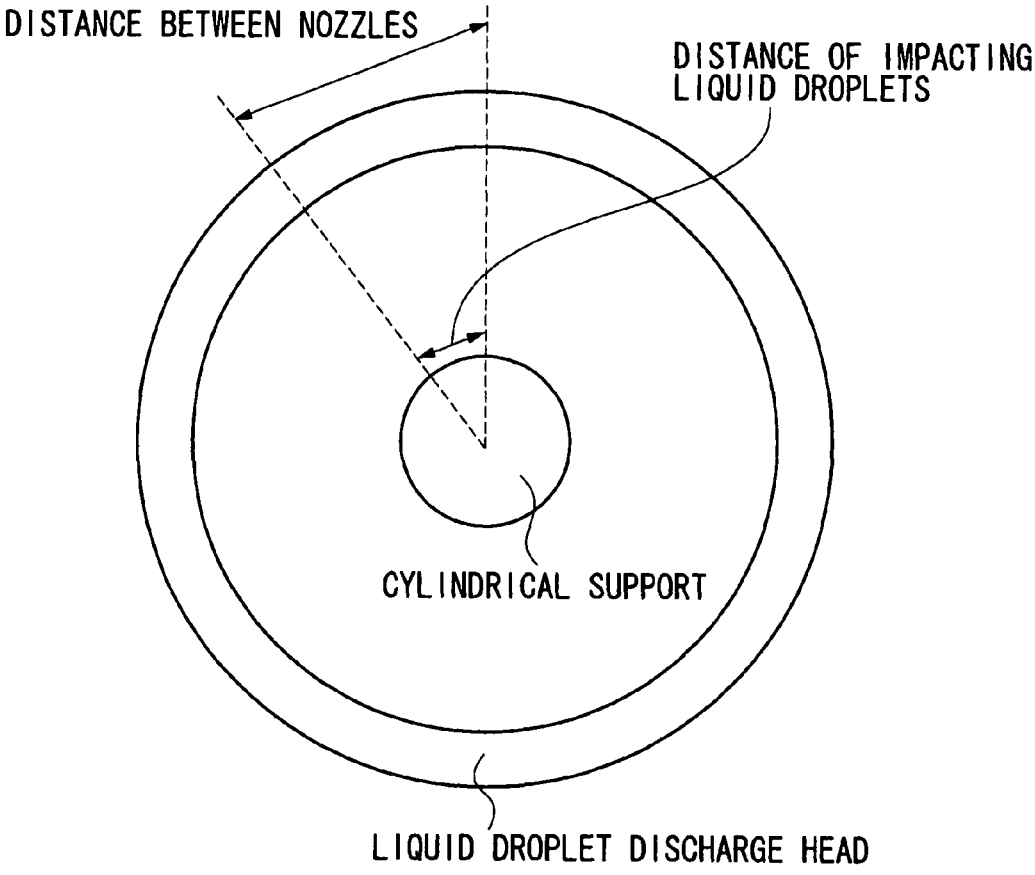
FIG. 12 is an illustration showing a method so that an apparent resolution is improved in case of a cylindrical Liquid droplet discharge head.

In FIG. 10 and FIG. 11, a layer may be formed without rotating the base material to be coated. However, it is not possible to apply this to the method shown in FIG. 6, in which the apparent resolution is raised by having the nozzle rows at an angle to the rotational axis. But, as shown in FIG. 12, in the case of a cylindrical liquid droplet discharge head, by making the diameter of the liquid droplet discharge head larger, the separation distance at liquid droplet impact is narrowed, and it is possible to increase the resolution on the base material. By doing so, a high quality layer may be formed using a cylindrical Liquid droplet discharge head.

Figure 13:
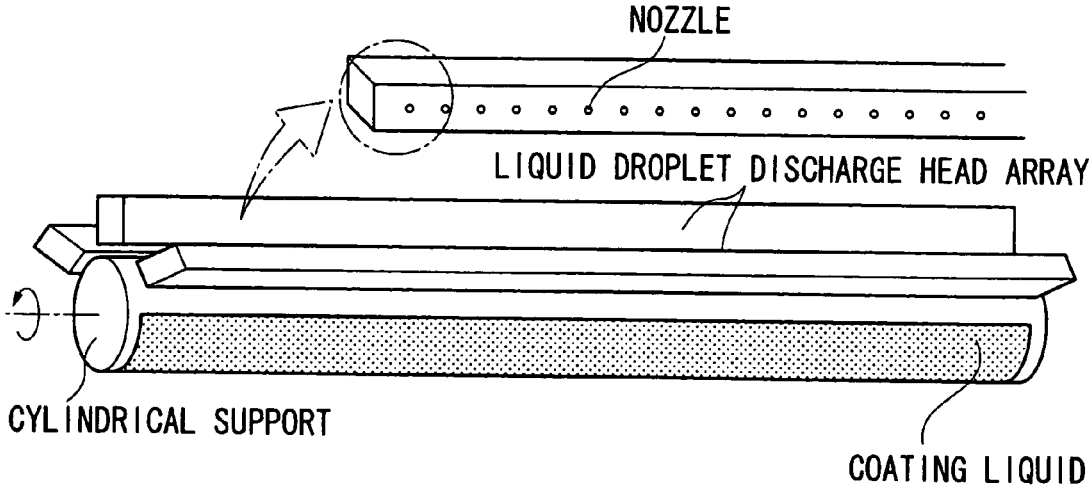
FIG. 13 is an illustration of an inkjet method in the case where a width of the droplet discharge head is equal to or longer than a length of a cylindrical support, and the droplet discharge head may coat the entire length of the cylindrical support at once.

FIG. 13 shows an example of an inkjet method in which Liquid droplet discharge heads are the same width or greater than the width of the cylindrical support, and the whole axial length of the cylindrical support is coated at once. When the axis of the cylindrical support is placed horizontally, normally coating is carried out as the cylindrical support is rotated. While it is difficult to shorten the separation distance of the nozzles of a piezo inkjet liquid droplet discharge head as above, the resolution may be increased by providing two or more liquid droplet discharge heads, as shown in FIG. 13. Furthermore, even with just a single liquid droplet discharge head, by scanning by a very small distance in the axial direction, and ejecting so that the spaces between the nozzles are filled in, continuous layer forming becomes possible.

When using a continuous type liquid droplet discharge head as the liquid droplet discharge head, control of the amount of coating liquid reaching the base material may be achieved by deflecting the direction of progression of the liquid droplets with an electric field. Liquid droplets that do not coat may be recovered through a gutter.

A continuous type inkjet liquid droplet discharge head that applies pressure to a coating liquid is suitable when using a high concentration coating liquid, that is to say a coating liquid that has a high viscosity. However, in intermittent type liquid droplet discharge heads, high viscosity materials may be used by providing a heater used in commercially available bar code printers for heating the coating liquid, and reducing the viscosity in the ejecting portion. Although a kind of coating solutions selected is limited, an electrostatic intermittent ink jet droplet discharge head may cope with a highly viscous coating solution.

4-2. Coating Liquid

The coating liquid for forming the outermost surface layer 5 includes charge transport material and curable resin.

Preparation of the coating liquid for the outermost surface layer 5 may be undertaken without using a solvent medium, or if required, an ordinary organic solvent may be used, such as, for example: methanol, ethanol, n-propanol, n-butanol, benzyl alcohol, methyl cellosolve, ethyl cellosolve, 3-hydroxy-3-methyl-2 butanone, diacetone alcohol, γ-ketobutanol, acetol, butylcarbitol, glycerin, acetone, methyl ethyl ketone, cyclohexanone, methyl acetate, n-butyl acetate, dioxane, tetrahydrofuran, methylene chloride, chloroform, chlorobenzene, and toluene. These organic solvents may be used singly, or in combinations of two or more.

In the present exemplary embodiment, for forming a construction with an inclined concentration gradient of the curable resin in the outermost surface layer 5, so that plural prepared coating liquids may be mixed together, it is preferable that the solvents of each of the coating liquids are either the same kind of solvent, or are closely related types of solvent.

Furthermore, when reacting the above components to obtain a coating liquid, the reaction may be carried out by simple mixing or dissolving, but raising of the temperature may be carried out to 20° C. to 100° C., preferably 30° C. to 80° C., for 10 minutes to 100 hours, preferably 1 hour to 50 hours. Furthermore, when doing so it is preferable to carryout ultrasound bombardment.

In the intermittent type inkjet liquid droplet discharge head it is preferable that the coating liquid has a viscosity within the range of 0.8 mPa·s to 20 mPa·s, and more preferably within the viscosity range of 1 mPa·s to 10 mPa·s.

The viscosity determined in the present exemplary embodiment is a value measured at 25° C., using an E-type viscometer (Trade Name: RE550L; manufactured by Toki Sangyo Co., Ltd., using a standard cone rotor, at a rotation speed of 60 rpm).

The surface tension of the coating liquid in the inkjet system is preferably 15 mN/m to 75 mN/m, and more preferably 25 mN/m to 65 mN/m.

The volume of the liquid droplets ejected in the intermittent type inkjet liquid droplet discharge head is preferably from 1 pL to 200 pL. When liquid droplets within the above size range are used to make successive layers, adjacent liquid droplets coalesce together, the boundaries of the liquid droplets disappear, and a single layer may be formed. Furthermore, if liquid droplets within the above size range are used then the precision of the ejecting positions may be maintained, and the outermost surface layer 5 may be formed within a practicable period of time, and a concentration gradient of the curable resin may be formed.

The preferable liquid droplet volume range is from 1 pL to 100 pL, more preferably from 1 pL to 60 pL, and particularly preferably from 2 pL to 50 pL. With liquid droplets within these size ranges blockages of the nozzles are not readily generated, and are also suitable from the view point of productivity. Furthermore, it is easy to adjust the density of liquid droplets at the time of reaching the base material.

In the present exemplary embodiment the size of the liquid droplets is measured by off-line visual inspection evaluation. LED is illuminated towards the liquid droplets in synchrony to the ejecting timing, and observations are made of images using a CCD camera.

Explanation is given of the layer forming method by an inkjet method, with the outermost surface layer 5 as the layer being formed, but an inkjet method may also be used for forming a charge-generating layer, a charge transport layer or other layer.

The liquid droplet discharge head of the present exemplary embodiment may have a cleaning function, in preparation for when coating liquid solidifies by drying, blocking the nozzles of the inkjet liquid droplet discharge head. For example, a head cleaning function is suitable and cleaning may be suitably carried out with an organic solvent that is used in the coating liquid. Furthermore, in preparation for blockages, there may be a suctioning mechanism and a mechanism for bombarding ultrasound.

<Electrophotographic Photoreceptor>

Next, each of the layers configuring an electrophotographic photoreceptor of the present exemplary embodiment will be explained.

(Cylindrical Support 4)

In this exemplary embodiment, a cylindrical support 4 is used as base material.

The cylindrical support 4 may be, for example, a metal plate, a metal drum or a metal belt formed of a metal such as aluminum, copper, zinc, stainless steel, chromium, nickel, molybdenum, vanadium, indium, gold or platinum, or their alloy, as well as paper, plastic films or belts coated, deposited or laminated with a polymer with a volume resistivity of $10^{-5}$ Ω·cm or less or indium oxide or with a metal such as aluminum, palladium or gold or their alloy.

The volume resistivity of the cylindrical support is preferably $10^{-5}$ Ω·cm or less.

The surface of the cylindrical support 4 may be roughened so that the central line average surface roughness Ra of the support is preferably from 0.04 μm to 0.5 μm in order to prevent interference fringes generated upon irradiation with a laser light.

For roughening the surface of the support, for example, employable is a wet-honing method of ejecting an abrasive suspension in water to a support; a centerless grinding method of pressing a support against a rotating grindstone for continuously grinding it; or a method of anodic oxidation, and it is also preferable to use a method wherein a layer in which a powder having a volume resistivity of $10^{-5}$ Ω·cm or less is dispersed in a resin layer is formed on the surface of the support without roughened, and the surface is roughed by the particles dispersed in the layer.

When non-interference light is used as a light source, roughening for prevention of interference fringes pattern may be not particularly necessary.

As one method of roughening the surface of the support, the anodic oxidation includes processing the aluminum surface of a support in an electrolytic solution in which the aluminum acts as an anode for anodic oxidation to form an oxide film on the aluminum surface. The electrolytic solution includes sulfuric acid solution, oxalic acid solution or the like. More preferably, the pores of the anodic oxidation film is sealed.

Preferably, the thickness of the oxide film by anodic oxidation is preferably from 0.3 μm to 15 μm for sealing the fine pores thereof.

The treatment with an acid solution, such as phosphoric acid, chromic acid and hydrofluoric acid, may be effected as follows. The blend ratio of phosphoric acid, chromic acid and hydrofluoric acid to form an acid solution is preferably as follows: Phosphoric acid is from 10 wt % to 11 wt %, chromic acid is from 3 wt % to 5 wt %, and hydrofluoric acid is from 0.5 wt % to 2 wt %. The total acid concentration of these is preferably from 13.5 wt % to 18 wt %. The processing temperature is preferably from 42° C. to 48° C.

Preferably, the thickness of the film is from 0.3 μm to 15 μm.

The boehmite treatment may be attained by dipping the support in pure water at 90° C. to 100° C. for 5 to 60 minutes, or by contacting the support with heated steam at 90° C. to 120° C. for 5 to 60 minutes. Preferably, the thickness of the film is from 0.1 μm to 5 μm. This may be further processed for anodic oxidation with an electrolytic solution having low film dissolution ability, such as a solution of adipic acid, boric acid, borate, phosphate, phthalate, maleate, benzoate, tartrate or citrate.

(Undercoat Layer 1)

An undercoat layer 1 may also be formed on the cylindrical support, or between a layer formed on the cylindrical support and the photosensitive layer. Particularly, the undercoat layer 1 that is an intermediate layer is preferably formed.

The material used in forming the undercoat layer 1 includes organozirconium compounds such as zirconium chelate compound, zirconium alkoxide compound and zirconium coupling agent; organotitanium compounds such as titanium chelate compound, titanium alkoxide compound and titanate coupling agent; organoaluminum compounds such as aluminum chelate compound and aluminum coupling agent; or organometallic compounds such as antimony alkoxide compound, germanium alkoxide compound, indium alkoxide compound, indium chelate compound, manganese alkoxide compound, manganese chelate compound, tin alkoxide compound, tin chelate compound, aluminum silicon alkoxide compound, aluminum titanium alkoxide compound and aluminum zirconium alkoxide compound. Among which the organozirconium compounds, organotitanium compounds or organoaluminum compounds are particularly preferably used.

Further, silane coupling agents such vinyl trichlorosilane, vinyl trimethoxy silane, vinyl triethoxy silane, vinyl tris-2-methoxy ethoxy silane, vinyl triacetoxy silane, γ-glycidoxy propyl trimethoxy silane, γ-methacryloxy propyl trimethoxy silane, γ-aminopropyl triethoxy silane, γ-chloropropyl trimethoxy silane, γ-2-aminoethyl aminopropyl trimethoxy silane, γ-mercaptopropyl trimethoxy silane, γ-ureidopropyl triethoxy silane and β-3,4-epoxy cyclohexyl trimethoxy silane may be used in the undercoat layer.

As another constituent component generally used in the undercoat layer 1, it is also possible to use known binder resins, for example polyvinyl alcohol, polyvinyl methyl ether, poly-N-vinylimidazole, polyethylene oxide, ethyl cellulose, methyl cellulose, ethylene-acrylic acid copolymer, polyamide, polyimide, casein, gelatin, polyethylene, polyester, phenol resin, vinyl chloride-vinyl acetate copolymer, epoxy resin, polyvinyl pyrrolidone, polyvinyl pyridine, polyurethane, polyglutamic acid and polyacrylic acid.

The resin may be used alone or in combination of two or more thereof, and the mixing ratio of these materials may be suitably established depending on necessity.

An electron transportable pigment may be mixed or dispersed in the undercoat layer 1. The electron transportable pigment include organic pigments such as perylene pigment described in JP-A No. 47-30330, bisbenzimidazole perylene pigment, polycyclic quinone pigment, indigo pigment and quinacridone pigment; organic pigments such as bisazo pigment and phthalocyanine pigment having an electron attractive substituent group such as a cyano group, a nitro group, a nitroso group and a halogen atom; and inorganic pigments such as zinc oxide and titanium oxide.

Among these pigments, perylene pigment, bisbenzimidazole perylene pigment, polycyclic quinone pigment, zinc oxide and titanium oxide are preferably used.

The surfaces of these pigments may be treated with the above-mentioned coupling agent, binder or the like. The electron transportable pigment is used in an amount of 95 wt % or less, and preferably 90 wt % or less.

As the method of mixing/dispersing the constituent component of the undercoat layer 1, a usual method of using a ball mill, a roll mill, a sand mill, an attritor or supersonic waves is used. Mixing/dispersion is carried out in an organic solvent. The organic solvent may be any organic solvent, as long as the organic solvent dissolves an organic metallic compound and resin and don't cause gelation or aggregation upon mixing/dispersion of the electron transportable pigment.

For example, the organic solvent includes an usual organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene or toluene. The organic solvent may be used alone or in combination of two or more thereof.

Various organic compound powder or inorganic compound powder may be added to the undercoat layer 1. In particular, white pigments such as titanium oxide, zinc oxide, zinc white, zinc sulfide, lead white or lithopone; inorganic pigments as body pigments such as alumina, calcium carbonate or barium sulfate; Teflon (trade name) resin particles, benzoguanamine resin particles or styrene particles are effective.

Preferably, the particle size of the additive powder is preferably from 0.01 μm to 2 μm in terms of volume-average particle diameter. The additive powder is optionally added to the layer. When the additive powder is added, its amount is preferably from 10 wt % to 90 wt %, and more preferably from 30 wt % to 80 wt %, with regard to the total solid content of the undercoat layer 1.

An electron-transporting substance, an electron-transporting pigment or the like may include in the undercoat layer 1.

The thickness of the undercoat layer 1 is preferably from 0.01 μm to 30 μm, and more preferably from 0.05 μm to 25 μm. A powdery substance, when added in preparing a coating solution for forming the undercoat layer 1, is added to and dispersed in a solution of the resin component.

As a dispersing method, any ordinary method may be employed by using, for example, a roll mill, a ball mill, a vibrating ball mill, an attritor, a sand mill, a colloid mill, a paint shaker or the like. The undercoat layer 1 may be formed by applying a coating solution for forming the undercoat layer 1 on or above the cylindrical support 4 and drying it.

The coating method may be any ordinary one, including, for example, a blade coating method, a wire bar coating method, a spraying method, a dip coating method, a bead coating method, an air knife coating method and a curtain coating method.

<Charge-Generating Layer 2>

The charge-generating layer 2 will be explained.

The charge-generating layer contains at least a charge-generating material and a resin.

The charge-generating materials used include those known in the art, for example azo pigments such as bisazo and trisazo; condensed ring aromatic pigments such as dibromoanthanthrone; organic pigments such as perylene pigment, pyrroropyrrole pigment and phthalocyanine pigment; and inorganic pigments such as triclinic selenium and zinc oxide. In particularly, metal or nonmetal phthalocyanine pigments, triclinic selenium, and dibromoanthanthrone are preferable when using an exposure wavelength of 380 nm to 500 nm.

Particularly preferable among these are hydroxy gallium phthalocyanine disclosed in JP-A Nos. 5-263007 and 5-279591, chlorogallium phthalocyanine in JP-A No. 5-98181, dichlorotin phthalocyanine in JP-A Nos. 5-140472 and 5-140473, and titanyl phthalocyanine in JP-A Nos. 4-189873 and 5-43813.

The resin may be selected from a wide variety of resins, and preferable resins include, but are not limited to, polyvinyl butyral resins, polyarylate resins (polycondensate product of bisphenol A and phthalic acid, etc.), polycarbonate resins, polyester resins, phenoxy resin, vinyl chloride-vinyl acetate copolymers, polyamide resins, acryl resins, polyacrylamide resins, polyvinyl pyridine resins, cellulose resins, urethane resins, epoxy resins, caseins, polyvinyl alcohol resins and polyvinyl pyrrolidone resins.

These resins may be used alone or in combination of two or more thereof

A material having both the function of the resin and the function of the charge-generating material, such as a poly-N-vinyl carbazole, a polyvinyl anthracene, a polyvinyl pyrene or a polysilane may also be used.

The compounding ratio (weight ratio) of the charge-generating material to the resin is preferably in a range of 10:1 to 1:10 (=charge-generating material:resin). As the method of dispersing them, usual methods such as a ball mill dispersion method, an attritor dispersion method or a sand mill dispersion method may be used.

In dispersion, it is effective for the size of the particle to be reduced to a size of 0.5 μm or less, preferably 0.3 μm or less, and more preferably 0.15 μm or less. As the solvent used in dispersion, an usual organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used. These solvents may be used alone or in combination of two or more thereof.

The thickness of the charge-generating layer 2 is generally preferably from 0.1 μm to 5 μm, and more preferably from 0.2 μm to 2.0 μm.

The coating method of the charge-generating layer 2 may be any ordinary one, including, for example, a blade coating method, a wire bar coating method, a spraying method, a dip coating method, a bead coating method, an air knife coating method and a curtain coating method.

<Charge Transport Layer 3>

Next, explanation will be given of the charge transport layer 3.

Known techniques may be employed for forming the charge transport layer 3. Such a charge transport layer 3 is formed containing a charge transport material and a resin, or formed containing a polymer charge transport material.

The charge transport material includes electron transport compounds, for example quinone compounds such as p-benzoquinone, chloranil, bromanil or anthraquinone; tetracyanoquinodimethane compounds; fluorenone compounds such as 2,4,7-trinitrofluorenone; xanthone compounds; benzophenone compounds; cyanovinyl compounds and ethylene compounds. The charge transport material includes hole transport compounds such as triaryl amine compounds, benzidine compounds, aryl alkanes compound, aryl-substituted ethylene compounds, stilbene compounds, anthracene compounds and hydrazone compounds.

These charge transport materials may be used alone or in combination of two or more thereof, and the charge transport material is not limited thereto. These charge transport materials are preferably those having structures represented by the following formulae:

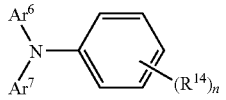

wherein $R^{14}$ represents a hydrogen atom or a methyl group; n indicates 1 or 2; $Ar^6$ and $Ar^7$ each independently represent a substituted or unsubstituted aryl group, $—C_6H_4—C(R^{18})=C(R^{19})(R^{20})$ or $—C_6H_4—CH=CH—CH=C(Ar)_2$, and the substituent for these is a halogen atom, an alkyl group having from 1 to 5 carbon atoms, an alkoxy group having from 1 to 5 carbon atoms, or a substituted amino group substituted with an alkyl group having from 1 to 3 carbon atoms; Ar represents a substituted or unsubstituted aryl group; and $R^{18}$, $R^{19}$ and $R^{20}$ each independently represent a hydrogen atom, a substituted or unsubstituted alkyl group, or a substituted or unsubstituted aryl group.

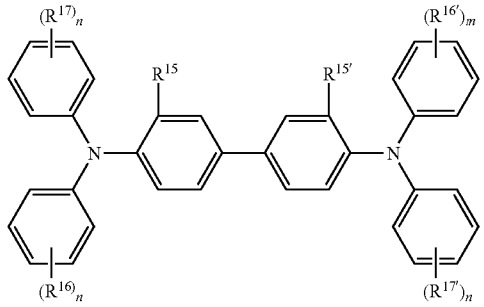

In the above formula, $R^{15}$ and $R^{15'}$, may be the same or different, and each independently represent a hydrogen atom, a halogen atom, an alkyl group having from 1 to 5 carbon atoms, or an alkoxy group having from 1 to 5 carbon atoms; $R^{16}$, $R^{16'}$, $R^{17}$ and $R^{17'}$ may be the same or different, and each independently represent a hydrogen atom, a halogen atom, an alkyl group having from 1 to 5 carbon atoms, an alkoxy group having from 1 to 5 carbon atoms, an amino group substituted with an alkyl group having 1 or 2 carbon atoms, a substituted or unsubstituted aryl group, $—C(R^{18})=C(R^{19})(R^{20})$, or $—CH=CH—CH=C(Ar)_2$; $R^{18}$, $R^{19}$ and $R^{20}$ each independently represent a hydrogen atom, a substituted or unsubstituted alkyl group, a substituted or unsubstituted aryl group; Ar represents a substituted or unsubstituted aryl group; and each of m and n each independently represent an integer of from 0 to 2.

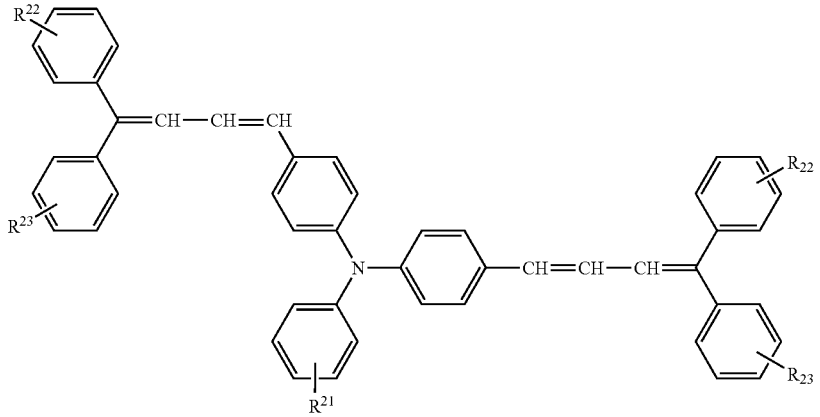

In the formula, $R^{21}$ represents a hydrogen atom, an alkyl group having from 1 to 5 carbon atoms, an alkoxy group having from 1 to 5 carbon atoms, a substituted or unsubstituted aryl group, or $—CH=CH—CH=C(Ar)_2$; Ar represents a substituted or unsubstituted aryl group; $R^{22}$ and $R^{23}$ may be the same or different and each independently represent a hydrogen atom, a halogen atom, an alkyl group having from 1 to 5 carbon atoms, an alkoxy group having from 1 to 5 carbon atoms, an amino group substituted with an alkyl group having 1 or 2 carbon atoms, or a substituted or unsubstituted aryl group.

Furthermore, the following may be used as the resin used in the charge transport layer 3: polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, and styrene-alkyd resins; and poly-N-vinylcarbazole, polysilanes, and the polyester based polymer charge transport materials described in JP-A Nos. 8-176293 and 8-208820. These resins may be used on singly, or in blends of two or more thereof.

The compounding ratio (ratio by weight) of the charge transport material to the resin is preferably from 10:1 to 1:5.

Also, polymer charge transport materials may be used alone.

As the polymer charge transport material, known materials with charge transport properties may be used, such as poly-N-vinylcarbazole, or polysilanes. The polyester based polymer charge transport materials described in JP-A Nos. 8-176293 and 8-208820 are particularly preferable. While the charge transport layer 3 may be formed by using polymer charge transport material(s) on its/their own, layer forming may be carried out using blends of the polymer charge transport material and the above resins.

A suitable thickness of the charge transport layer 3 used in the present exemplary embodiment is generally from 5 μm to 50 μm, and preferably from 10 μm to 40 μm.

Ordinary coating methods may be used for the coating method, such as, for example, blade coating methods, wire bar coating methods, spray coating methods, dip coating methods, bead coating methods, air knife coating methods, and curtain coating methods.

Ordinary organic solvents may be used for providing the charge transport layer 3, such as, for example: aromatic hydrocarbons such as benzene, toluene, xylene, chlorobenzene; ketones such as acetone, 2-butanones; halogenated aliphatic hydrocarbons such as methylene chloride, chloroform, and ethylene chloride; and cyclic or linear ethers such as tetrahydrofuran and ethyl ether. These organic solvents may be used singly, or in combinations of two or more.

Additives such as antioxidants, light stabilizers, heat stabilizers or the like may also be added to the photosensitive layer.

Examples that may be given of such antioxidants include, for example, hindered phenols, hindered amines, paraphenylenediamine, aryl alkanes, hydroquinones, spirochromans, spiroindanones or derivatives thereof, organosulfur compounds, organophosphorus compounds or the like. Examples of light stabilizers include, for example, derivatives, such as benzophenone, benzotriazol, dithiocarbamate, or tetramethylpiperidine.

Furthermore, at least one type of electron-accepting substance may be included. The following may be used as such an electro-accepting substance in the photoreceptor of the present exemplary embodiment, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitro anthraquinone, trinitro fluorenone, picric acid, o-nitrobenzoic acid, p-nitrobenzoic acid, phthalic acid, or the like. Among these, benzene derivatives, such as fluorenone based and quinone based derivatives, that have electron withdrawing substituents such as Cl, CN, or $NO_2$, are particularly preferable.

<Image-Forming Apparatus>

Figure 14:
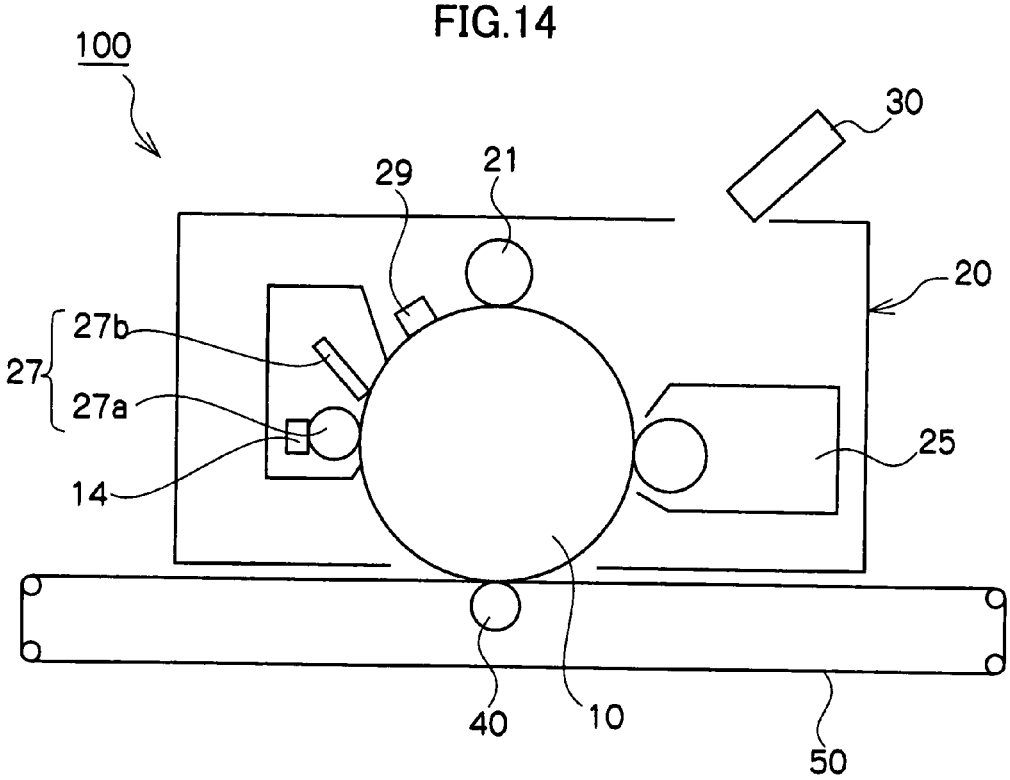
FIG. 14 is an illustration showing a preferred exemplary embodiment of an image-forming apparatus according to the present invention.

FIG. 14 is an illustration showing a preferable exemplary embodiment of the image-forming apparatus. The image-forming apparatus shown in FIG. 14 comprises, in the main body of an image-forming apparatus (not shown), a process cartridge 20 provided with the electrophotographic photoreceptor 10 described above, an exposure unit (latent image-forming unit) 30, a transfer unit 40, and an intermediate transfer medium 50. In the image-forming apparatus 100, the irradiating device 30 is arranged in such a position that the electrophotographic photoreceptor 10 can be irradiated with light through an opening of the process cartridge 20, and the transfer device 40 is arranged in a position opposed, via the intermediate transfer medium 50, to the electrophotographic photoreceptor 10, and the intermediate transfer medium 50 is arranged to be butted against, and contacted with, the electrophotographic photoreceptor 10.

The process cartridge 20 comprises, in a casing, the electrophotographic photoreceptor 10 integrated with a charger 21, a developer 25, a cleaner 27 and a fibrous member (flat brush) 29 and fitted via a fitting rail to the main body of the image-forming apparatus. The casing is provided with an opening for light exposure.

The charger 21 is to charge the electrophotographic photoreceptor 10 by a contact system, however, the charger 21 may be one of non-contact system. The developer 25 is to form a toner image by developing an electrostatic latent image on the photographic photoreceptor 10.

The cleaner 27 have a fibrous member (roll shape) 27*a* and a cleaning blade (blade member) 27*b*. In the cleaner 27 shown in FIG. 14, there are both a fibrous member 27*a* and a cleaning blade 27*b*. However, the cleaner may have any one of these. The fibrous member 27*a* may be a roll, a tooth brush-like member or the like. The fibrous member 27*a* may be fixed to the body of the cleaner, or may be rotatably supported by the body, or may be supported by it in such a manner that it may oscillate in the axial direction of the photoreceptor.

The cleaning blade and the cleaning brush of the cleaner 27 remove the adhered substances (e.g., discharged substances) from the surface of the photoreceptor, and it is desirable that a lubricant substance (lubricant component) 14 such as metal soap, higher alcohol, wax or silicone oil is contacted with the fibrous member 27*a*, to supply the lubricant component to the surface of the electrophotographic photoreceptor.

The cleaning blade 27*b* may be an ordinary rubber blade.

The process cartridge 20 described above is detachably fitted to the main body of the image-forming apparatus, and constitutes the image-forming apparatus, together with the main body of the image-forming apparatus.

The exposure unit 30 may be any one capable of exposing the charged electrophotographic photoreceptor 10 so as to form an electrostatic latent image thereon. The light source of the exposure unit 30 is preferably a multi-beam surface-emitting laser.

The transfer unit 40 is not limited insofar as it may transfer a toner image on the electrophotographic photoreceptor 10 onto a transfer medium (which may be a paper retained on a paper delivery belt (not shown) used in place of the intermediate transfer medium 50 as transfer medium shown in FIG. 14, or a paper for directly transferring an image thereon without using the intermediate transfer medium 50), and for example, a usual roll-shaped transfer material is used.

The intermediate transfer medium 50 has a volume resistivity of $10^2$ Ω·cm to $10^{11}$ Ω·cm, and is a belt-shaped medium (intermediate transfer belt) containing polyimide, polyamidimide, polycarbonate, polyarylate, polyester, rubber or the like as the constituent component. The intermediate transfer medium 50 may be in the form of a drum in addition to the form of a belt.

The transfer medium is not particularly limited insofar as it is a medium capable of transferring a toner image formed on the electrophotographic photoreceptor 10. For example, in the case where the electrophotographic photoreceptor 10 is transferred directly onto a paper, the paper is a transfer medium, and when the intermediate transfer medium 50 is used, the intermediate transfer medium is a transfer medium.

Figure 15:
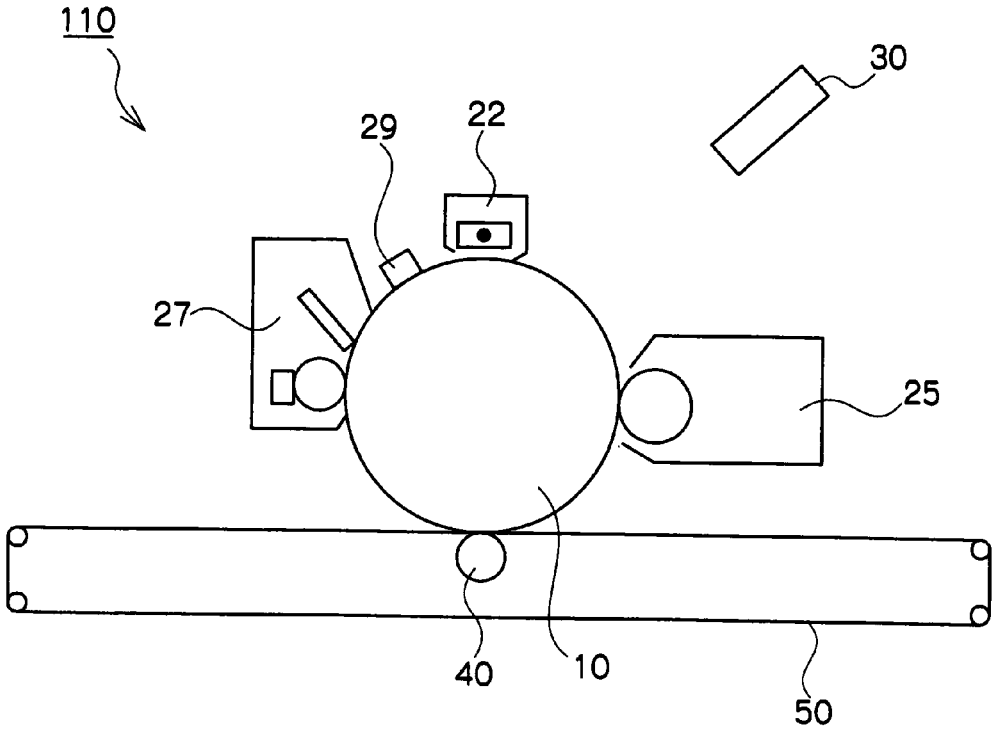
FIG. 15 is an illustration showing another preferred exemplary embodiment of an image-forming apparatus according to the present invention.

FIG. 15 is a schematic view showing another exemplary embodiment of the image-forming apparatus. In the image-forming apparatus 110 of FIG. 15, the electrophotographic photoreceptor 10 is fixed to the body of the image-forming apparatus, and a charger 22, a developer 25 and a cleaner 27 are fitted thereto independently of each other, to constitute a charging cartridge, a developing cartridge and a cleaning cartridge respectively. The charger 22 is a corona discharging charger in the exemplary embodiment, however, the charger 22 may be one of contact system.

In the image-forming apparatus 110, the electrophotographic photoreceptor 10 and the other units are separated from one another, and the charger 22, the developer 25 and the cleaner 27 may be detachably fitted to the body of the image-forming apparatus by leading or extrusion.

In the electrophotographic photoreceptor of this exemplary embodiment, formation of the cartridge is not necessary in some cases. Accordingly, the charger 22, the developer 25 and the cleaner 27 may be detachably fitted to the body of the image-forming apparatus by leading or extrusion, whereby the apparatus cost per one print with it may be reduced. Two or more of these units may be manufactured as one integrated cartridge to detachably fix to the body.

The image-forming apparatus 110 has the same structure as the image-forming apparatus 100 except that the charger 22, the developer 25 and the cleaner 27 are formed as cartridges respectively.

Figure 16:
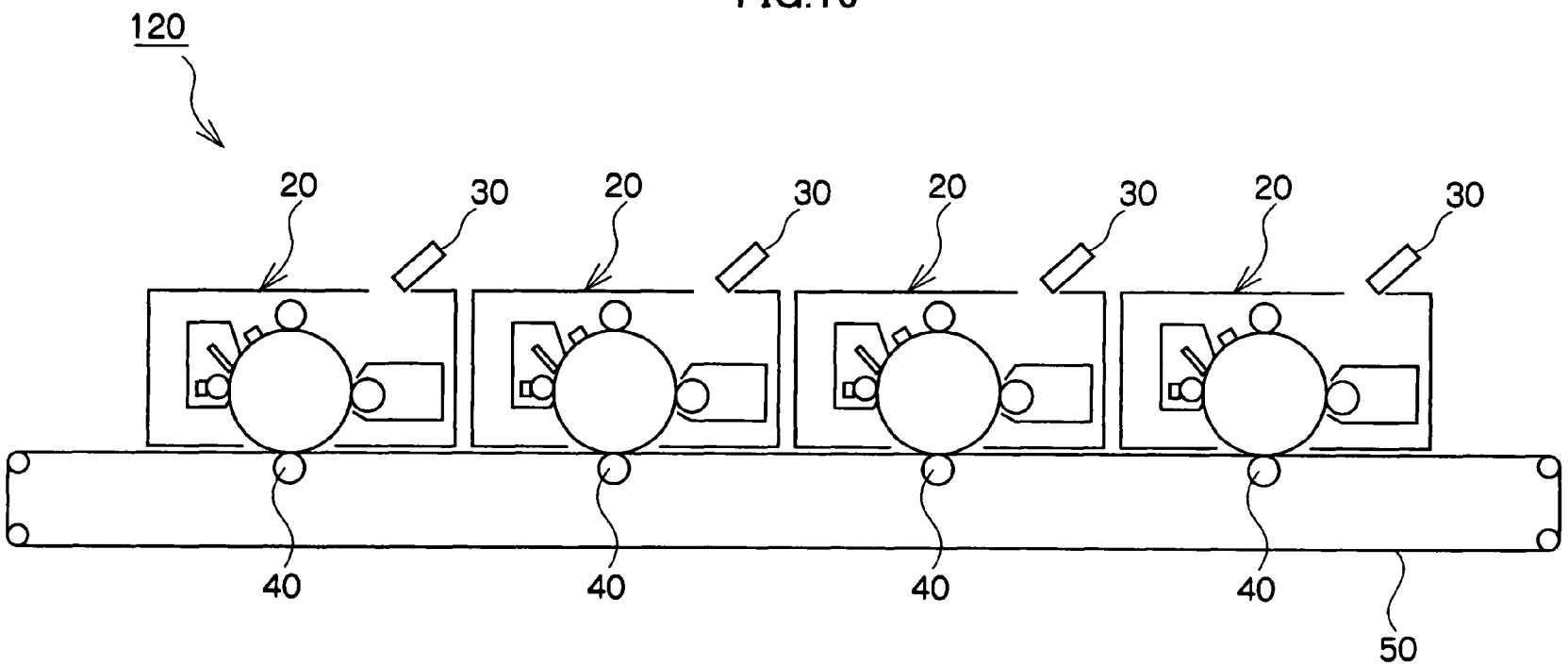
FIG. 16 is an illustration showing still another preferred exemplary embodiment of an image-forming apparatus according to the present invention.

FIG. 16 is a schematic view showing still another exemplary embodiment of the image-forming apparatus. The image-forming apparatus 120 is a tandem-type full-color image-forming apparatus equipped with four process cartridges 20. The image-forming apparatus 120 is so designed that four process cartridges 20 are disposed in parallel to each other on an intermediate transfer medium 50 and one electrophotographic photoreceptor is used for one color. Except that it is a tandem-system apparatus, the image-forming apparatus 120 has the same constitution as that of the image-forming apparatus 100.

EXAMPLES

Hereinafter, the exemplary embodiment of the present invention is described in more detail with reference to the Examples, to which, however, the present invention is not limited.

Example 1

<Production of Photoreceptor 1>

(Preparation of Photoreceptor A)

An undercoat layer having 0.1 μm of thickness is formed on a cylindrical Al substrate having outer diameter of 30 mm, which has had a honing process carried out thereof, by: dip coating in a solution containing 100 parts by weight of a zirconium compound (trade name: ORGATICS ZC540; manufactured by: Matsumoto Chemical Industry Co., Ltd.), 10 parts by weight of a silane compound (trade name: A 1100; manufactured by: Nippon Unicar Co., Ltd.), 400 parts by weight of isopropanol, and 200 parts by weight of butanol; and heat drying at 150° C. for 10 minutes.

The charge-generating layer of 0.15 μm thickness is then formed on this aluminum base material by: mixing 10 parts by weight of hydroxygallium phthalocyanine, having strong diffraction peaks of Bragg angles (2θ±0.2°) in an X-ray diffraction spectrum at 7.5°, 9.9°, 12.5°, 16.3°, 18.6°, 25.1°, and 28.3°, into 10 parts by weight of polyvinyl butyral (trade name: S-LEC BM-S; manufactured by Sekisui Chemical Co., Ltd.) and 1000 parts by weight of n-butyl acetate; and, after dispersing by processing for 1 hour in a paint shaker with the glass beads, dip coating onto the above undercoat with the obtained coating liquid; and heat drying for 10 minutes at 100° C.

A coating liquid of 2.5 parts by weight of the benzidine compound with the structure of compound 1 shown below, and 3 parts by weight of the polymer compound of compound 2 shown below, (viscosity average molecular weight 39,000) dissolved in 20 parts by weight of chlorobenzene is coated by dip coating onto the charge-generating layer, and then heating is carried out at 130° C. for 40 minutes to form a charge transport layer with a layer thickness of 20 μm. This is photoreceptor A.

Compound 1

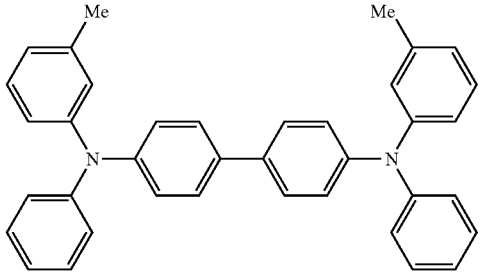

Compound 2

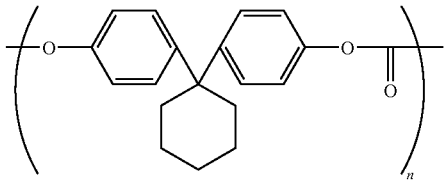

(Production of Photoreceptor 1)

100 parts by weight of phenol, 175 parts by weight of formalin, and 2 parts by weight of $Ba(OH)_2.8H_2O$ are placed in a side-arm flask, and heating and stirring is carried out for 100° C. for 3 hours under nitrogen atmosphere. The solvent is removed at reduced pressure. Phenol resin (1) is thus obtained.

Next, outermost surface layer coating liquids (1) to (7) are prepared by mixing the above charge transport material I-1, the phenol resin (1) as a thermosetting resin (curable resin), a catalyst, n-butanol, and cyclohexanone, as is shown below in Table 1.

TABLE 1

| | Charge transport material (A) (parts by weight) | Curable Resin (B) (parts by weight) | Proportion of the content of Curable Resin (B)/((A) + (B)) (% by weight) | *Catalyst (parts by weight) | n-Butanol (parts by weight) | Cyclohexanone (parts by weight) | Total (parts by weight) |
|---|---|---|---|---|---|---|---|
| Outermost surface layer coating liquid (1) | 3.9 | 1.1 | 22 | 0.1 | 12 | 2.9 | 20.0 |
| Outermost surface layer coating liquid (2) | 3.5 | 1.5 | 30 | 0.1 | 12 | 2.9 | 20.0 |

TABLE 1-continued

| | Charge transport material (A) (parts by weight) | Curable Resin (B) (parts by weight) | Proportion of the content of Curable Resin (B)/((A) + (B)) (% by weight) | *Catalyst (parts by weight) | n-Butanol (parts by weight) | Cyclohexanone (parts by weight) | Total (parts by weight) |
|---|---|---|---|---|---|---|---|
| Outermost surface layer coating liquid (3) | 3.3 | 1.7 | 34 | 0.1 | 12 | 2.9 | 20.0 |
| Outermost surface layer coating liquid (4) | 2.9 | 2.1 | 42 | 0.1 | 12 | 2.9 | 20.0 |
| Outermost surface layer coating liquid (5) | 2.6 | 2.4 | 48 | 0.1 | 12 | 2.9 | 20.0 |
| Outermost surface layer coating liquid (6) | 2.3 | 2.7 | 54 | 0.1 | 12 | 2.9 | 20.0 |
| Outermost surface layer coating liquid (7) | 1.9 | 3.1 | 62 | 0.1 | 12 | 2.9 | 20.0 |

*Catalyst: Nacure 2500 (from Kusumoto Chemicals, Ltd.)

Seven inkjet heads (trade name: PIXELJET 64; manufactured by Trident Co., Ltd.) are readied, corresponding to the types of prepared outermost surface layer coating liquids, and the outermost surface layer coating liquids (1) to (7) are filled therein. The cylindrical axis of the photoreceptor A is placed horizontal, and mounted in an apparatus that is able to rotate the photoreceptor A around this axis, and the seven liquid droplet discharge heads filled with the outermost surface layer coating liquids (1) to (7) are lined up so that liquid droplets are ejected directly downward, from directly above the photoreceptor A toward the photoreceptor A.

The coating liquids are ejected from 10 nozzles of one row from the 64 nozzles in the liquid droplet discharge heads, and the arrangement is made with each of the heads inclined at an angle θ=85° to the axial direction of the photoreceptor, as shown in FIGS. 6A and B, such that the liquid droplets, after being ejected from the nozzles and impacting, touch together with the adjacent liquid droplets as shown in FIG. 5. The diameters of the liquid droplets on ejecting, shown by dotted lines, are of the same order as the diameter of the nozzles, but after impacting on the surface of the photoreceptor A the liquid droplets spread out to touch neighboring liquid droplets, as shown by the solid lines, and form a layer. Furthermore, each of the liquid droplet discharge heads is set such that the separation distance from each of the liquid droplet discharge heads to the surface of the photoreceptor A is 10 mm.

The photoreceptor A is rotated at 180 rpm, coating liquid is ejected from the nozzles at 2000 Hz, and the heads are horizontally moved from one end portion of the photoreceptor A to the end portion at the opposite side at a linear velocity of 220 mm/min. By such a movement, as shown in FIG. 7, each of the nozzles of the liquid droplet discharge head filled with the coating liquid (1) may be made to face the portions where the outermost surface layer coating liquid (1) has not yet impacted.

In this way, the coating layer of the outermost surface layer is formed by ejecting the outermost surface layer coating liquids (1), (2), (3), (4), (5), (6) and (7), in this sequence from the charge-generating layer side, as shown in FIG. 7. It is to be noted that while FIG. 7 shows three inkjet heads, in the present exemplary embodiment there are seven types of outermost surface layer coating liquid used and so there are seven inkjet heads, as stated above.

Then the outermost surface layer having 5 μm thickness is formed by carrying out drying at 160° C. for 40 minutes, and the photoreceptor-1 is obtained.

<Measurement of the Proportions of the Content of the Curable Resin in the Outermost Surface Layer>

Layers are prepared, in advance, using the coating liquids of each of the outermost surface layer coating liquids (1) to (7) having known proportions of the curable resin contained therein. For these layers, the presence of Ba atoms in the outermost surface layer is detected using a Secondary Ion Mass Spectrometer (SIMS), and based on these detection results a calibration curve is produced showing the relationship between the proportion of the content of curable resin and the detected results of Ba atoms.

Next, the outermost surface layer of the photoreceptor of Example 1 is peeled off, and Ba atoms at the outer surface side of this outermost surface layer are detected using a Secondary Ion Mass Spectrometer (SIMS), and the proportion of the content of the curable resin in the outermost surface layer of the photoreceptor-1 is determined by converting the detection result into the proportion of the content of curable resin by comparing the result to the calibration curve produced in advance.

<Measurement of the Residual Potential>

Each of the electrophotographic photoreceptors is charged using a grid potential −700V scorotron charger at a temperature of 10° C. and 15% RH. Next, one second after charging, the photoreceptor 1 is irradiated with light at 10 mJ/m$^2$ using a 780 nm semi-conductor laser and electrical discharge is carried out, then three seconds after electrical discharging a red LED light is used to illuminate each of the photoreceptor 1 at 50 mJ/m$^2$ and charge removal is carried out, and the surface potential (V) is measured of the photoreceptor 1 at this time, with this value being the residual potential value. The evaluation results are shown in Table 5.

<Evaluation of Image Degradation>

The photoreceptor 1 is installed in a printer (trade name: DOCUCENTRE COLOR F450; manufactured by Fuji Xerox). Image quality of half-tone images at a density of 20% are output, under conditions of 30° C., 85% RH and 10° C., 20% RH, and, respectively, the first output sheet, the 10,000$^{th}$ output sheet, and a print output after leaving in the printer for one day (24 hours) are evaluated by visual inspection of the image density reduction. The results are shown in Table 5.

(Evaluation Criteria)

A: Good

B: Image Degradation is slightly visible

C: Image Degradation is clearly recognizable

<Evaluation of Ghosting)

The photoreceptor in a DOCUPRINT C1616 (trade name, manufactured by Fuji Xerox) is replace with the photoreceptor 1, and test images are formed on 100 sheets in conditions of high temperature and humidity (20° C., 50% RH), and ghosting is evaluated.

Figure 17A:
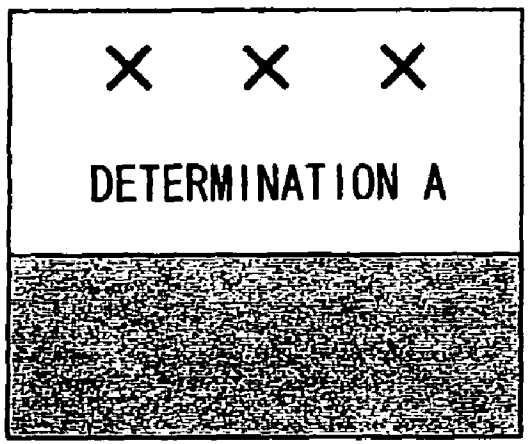
FIG. 17A to 17C are charts used for evaluating ghosting in the Examples.
Figure 17B:
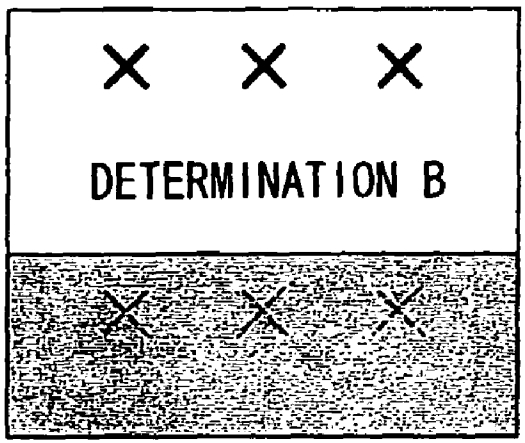
Figure 17C:
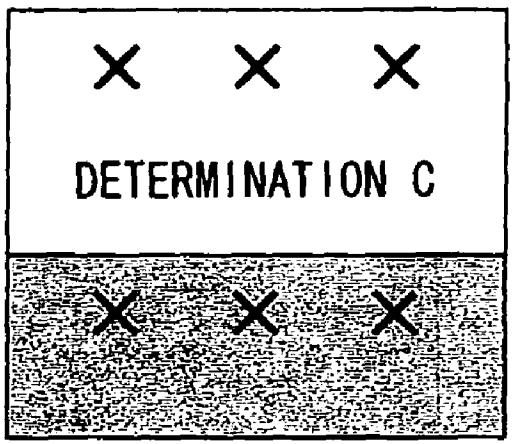

Ghosting is evaluated as shown below by printing charts of a 100% image output pattern and "X" characters, and, as shown in FIGS. 17A to 17C, by looking at the condition of the appearance of the character "X" in the 100% image output pattern. The results are shown in Table 5.

(Evaluation Criteria)

A: Good

B: Ghosting is slightly visible

C: Ghosting is clearly recognizable

<Evaluation of Delamination>

The adhesiveness is evaluated by forming, according to JIS K5400-1979, a grid pattern with a cutter of 100 areas of 1 mm by 1 mm in a 10 mm by 10 mm region on the surface of the photoreceptor after undertaking the above evaluation of image degradation, adhering pressure sensitive tape (trade name: Cellophane Tape CT-24; manufactured by Nichiban Co., Ltd.) thereto, and then separating the tape in a direction normal to the surface of the photoreceptor, and evaluating the number of areas remaining. The result is shown in Table 5.

The same evaluations are carried out on the photoreceptor 2 as are carried out in Example 1. The results are shown in Table 5.

Example 3

A photoreceptor 3 formed with an outermost surface layer with a thickness of 5 μm is obtained by the same method as that for producing the photoreceptor 1 of Example 1, except that, instead of the phenol resin (1), a resol-type phenol resin (trade name: PL-2207; manufactured by Gunei Chemical Industries Co., Ltd.) is used.

The same evaluations are carried out on the photoreceptor 3 as are carried out in Example 1. The results are shown in Table 5.

Example 4

A photoreceptor 4 is produced by the same method as that for producing the photoreceptor 1 of Example 1, except that the outermost surface layer coating liquids (1) to (7) are replaced by the outermost surface layer coating liquids (8) to (14) as shown in Table 2.

The same evaluations are carried out on the photoreceptor 4 as are carried out in Example 1. The results are shown in Table 5.

TABLE 2

| | Charge transport material (A) (parts by weight) | Curable Resin (B) (parts by weight) | Proportion of the Content of Curable Resin (B)/((A) + (B)) (% by weight) | *Catalyst (parts by weight) | n-Butanol (parts by weight) | Cyclohexanone (parts by weight) | Total (parts by weight) |
|---|---|---|---|---|---|---|---|
| Outermost surface layer coating liquid (8) | 3.9 | 1.1 | 22 | 0.1 | 12 | 2.9 | 20 |
| Outermost surface layer coating liquid (9) | 3.1 | 1.9 | 38 | 0.1 | 12 | 2.9 | 20 |
| Outermost surface layer coating liquid (10) | 2.8 | 2.2 | 44 | 0.1 | 12 | 2.9 | 20 |
| Outermost surface layer coating liquid (11) | 2.5 | 2.5 | 50 | 0.1 | 12 | 2.9 | 20 |
| Outermost surface layer coating liquid (12) | 2.3 | 2.7 | 54 | 0.1 | 12 | 2.9 | 20 |
| Outermost surface layer coating liquid (13) | 2.1 | 2.9 | 58 | 0.1 | 12 | 2.9 | 20 |
| Outermost surface layer coating liquid (14) | 1.9 | 3.1 | 62 | 0.1 | 12 | 2.9 | 20 |

*Catalyst: Nacure 2500 (from Kusumoto Chemicals, Ltd.)

<Evaluation of Abrasion Rate>

After using for 100,000 revolutions in conditions of low temperature and low humidity (10° C., 20% RH) the layer thickness of the outermost surface layer 5 is measured, and the abrasion rate per 1000 revolutions is determined. The results are shown in Table 5.

Example 2

A photoreceptor 2 with an outermost surface layer 5 of a thickness of 5 μm is obtained by the same method as that for producing the photoreceptor 1, except that, in the method of producing photoreceptor 1 of Example 1, the charge transport material I-1 is replaced by compound IV-9.

Example 5

A photoreceptor 5 is produced by the same method as that for producing the photoreceptor 1 of Example 1, except that the outermost surface layer coating liquids (1) to (7) are replaced by the outermost surface layer coating liquids (15) to (21) as shown in Table 3.

The same evaluations are carried out on the photoreceptor 5 as are carried out in Example 1. The results are shown in Table 5.

TABLE 3

| | Charge transport material (A) (parts by weight) | Curable Resin (B) (parts by weight) | Proportion of the Content of Curable Resin (B)/((A) + (B)) (% by weight) | *Catalyst (parts by weight) | n-Butanol (parts by weight) | Cyclohexzanone (parts by weight) | Total (parts by weight) |
|---|---|---|---|---|---|---|---|
| Outermost surface layer coating liquid (15) | 3.9 | 1.1 | 22 | 0.1 | 12 | 2.9 | 20.0 |
| Outermost surface layer coating liquid (16) | 3.8 | 1.2 | 24 | 0.1 | 12 | 2.9 | 20.0 |
| Outermost surface layer coating liquid (17) | 3.7 | 1.3 | 26 | 0.1 | 12 | 2.9 | 20.0 |
| Outermost surface layer coating liquid (18) | 3.4 | 1.6 | 32 | 0.1 | 12 | 2.9 | 20.0 |
| Outermost surface layer coating liquid (19) | 3.0 | 2.0 | 40 | 0.1 | 12 | 2.9 | 20.0 |
| Outermost surface layer coating liquid (20) | 2.5 | 2.5 | 50 | 0.1 | 12 | 2.9 | 20.0 |
| Outermost surface layer coating liquid (21) | 1.9 | 3.1 | 62 | 0.1 | 12 | 2.9 | 20.0 |

*Catalyst: Nacure 2500 (from Kusumoto Chemicals, Ltd.)

Example 6

A photoreceptor 6 is produced by the same method as that for producing the photoreceptor 1 of Example 1, except that the outermost surface layer coating liquids (1) to (7) are replaced by the outermost surface layer coating liquids (22) to (28) as shown in Table 4.

The same evaluations are carried out on the photoreceptor 6 as are carried out in Example 1. The results are shown in Table 5.

TABLE 4

| | Charge transport material (A) (parts by weight) | Curable Resin (B) (parts by weight) | Proportion of the Content of Curable Resin (B)/((A) + (B)) (% by weight) | *Catalyst (parts by weight) | n-Butanol (parts by weight) | Cyclohexzanone (parts by weight) | Total (parts by weight) |
|---|---|---|---|---|---|---|---|
| Outermost surface layer coating liquid (22) | 3.0 | 2.0 | 40 | 0.1 | 12 | 2.9 | 20 |
| Outermost surface layer coating liquid (23) | 2.7 | 2.3 | 46 | 0.1 | 12 | 2.9 | 20 |
| Outermost surface layer coating liquid (24) | 2.3 | 2.7 | 54 | 0.1 | 12 | 2.9 | 20 |
| Outermost surface layer coating liquid (25) | 2.0 | 3.0 | 60 | 0.1 | 12 | 2.9 | 20 |
| Outermost surface layer coating liquid (26) | 1.7 | 3.3 | 66 | 0.1 | 12 | 2.9 | 20 |
| Outermost surface layer coating liquid (27) | 1.3 | 3.7 | 74 | 0.1 | 12 | 2.9 | 20 |
| Outermost surface layer coating liquid (28) | 1.0 | 4.0 | 80 | 0.1 | 12 | 2.9 | 20 |

*Catalyst: Nacure 2500 (from Kusumoto Chemicals, Ltd.)

Example 7

A photoreceptor A is prepared in the same way as in Example 1. Furthermore, the outermost surface layer coating liquid (1) and outermost surface layer coating liquid (7) are prepared.

Two inkjet liquid droplet discharge heads (trade name: PIXELJET 64; manufactured by Trident Co., Ltd.) are readied, and they are respectively filled with the outermost surface layer 5 coating liquids (1) and (7). The cylindrical axis of the photoreceptor A is placed horizontal, and mounted in an apparatus that is able to rotate the photoreceptor A the axis, and the liquid droplet discharge heads filled with the outermost surface layer coating liquids (1) and (7) are lined up so that they jet liquid droplets directly downward, from directly above the photoreceptor A toward the photoreceptor A, with the distance between each of the liquid droplet discharge heads and the surface of the photoreceptor A being set at 10 mm.

The arrangement is made such that coating liquid is ejected from 10 nozzles of the 64 nozzles of each of the liquid droplet discharge heads, and the proportions ejected of the outermost surface layer coating liquid (1) to the outermost surface layer coating liquid (7) are varied for each layer as follows: 0:5, 1:4, 2:3, 3:2, 4:1, 5:0.

The photoreceptor A is rotated at 180 rpm and liquid droplets of coating liquid are ejected from the nozzles at 2000 Hz, while horizontally moving the Liquid droplet discharge heads from one end portion of the photoreceptor A to the end portion at the other side at a velocity of 220 mm/min.

Then, by drying for 40 minutes at 160° C., the outermost surface layer is formed with a thickness of 5 μm, and the photoreceptor 7 is obtained. The same evaluations are carried out on the photoreceptor 7 as are carried out in Example 1. The results are shown in Table 5.

Comparative Example 1

The Comparative Example photoreceptor 1 is produced by the same method as the photoreceptor 1 of Example 1, except that only the outermost surface layer coating liquid (4) is filled into the Liquid droplet discharge head (trade name: PIXELJET 64; manufactured by Trident Co., Ltd.) and the Liquid droplet discharge head is arranged so that they eject liquid droplets directly downward, from directly above the photoreceptor A toward the photoreceptor A, and the photoreceptor A is rotated at 65 rpm, while the Liquid droplet discharge head is moved horizontally from one end portion of the photoreceptor A to the end portion at the opposite side of the photoreceptor A at a movement velocity of 32 mm/min, forming an outermost surface layer with a thickness of 5 μm.

Evaluation of the Comparative Example photoreceptor 1 is carried out by the same methods as in Example 1. The results are shown in Table 5.

Comparative Example 2

The outermost surface layer coating liquids (1) to (7) are coated in sequence onto the charge transport layer of the photoreceptor A using a dip coating apparatus, so as to be form a step gradient in the proportion of curable resin. Then, by drying for 40 minutes at 160° C. a outermost surface layer having 5 μm thickness is formed and the Comparative Example photoreceptor 2 is obtained. The Comparative Example photoreceptor 2 is evaluated by the same methods as in Example 1. The results are shown in Table 5.

Figure 18:
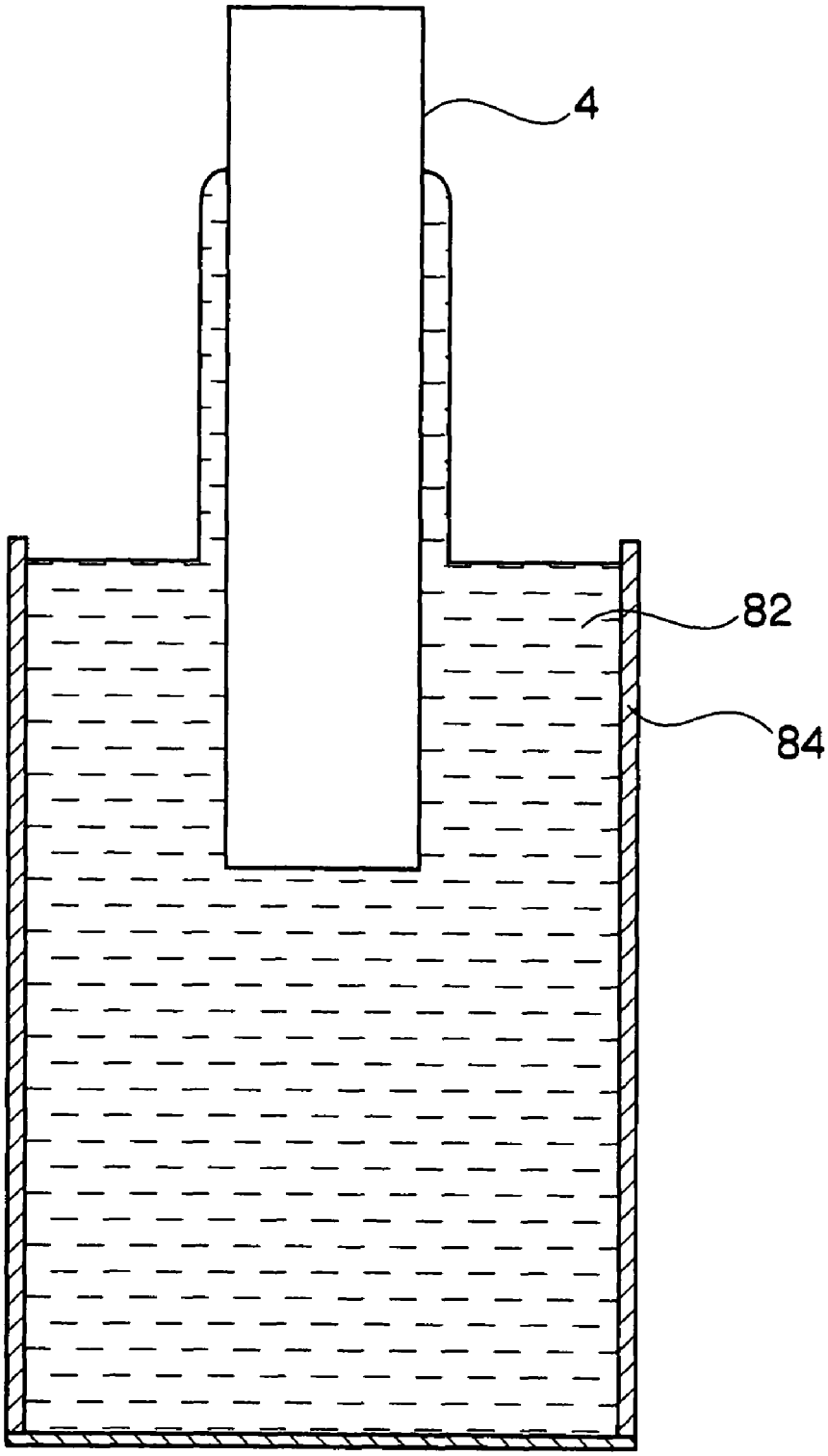
FIG. 18 is an outline diagram of a dip coating apparatus used for manufacturing photoreceptors of the Comparative Examples.

The dip coating apparatus used in Comparative Example 2 is configured as shown in FIG. 18, and is an apparatus in which coating is carried out by coating liquid 82 being placed in the coating tank 84, and the cylindrical support 4 being immersed therein and then withdrawn, pulled up out of, the tank. In the Comparative Example 2, the outermost surface layer coating liquids (1) to (7) are exchanged in sequence for the coating liquid 82 in the coating tank 84, and coating is carried out. The outermost surface layer of the Comparative Example 2 is formed by arranging the cylindrical support that is obtained in the same way as in Example 1 in a vertical orientation, as shown in FIG. 18, and the cylindrical support 4 is immersed in the outermost surface layer coating liquid, and then withdrawn, maintaining a velocity of 150 mm/minute.

In the outermost surface layer of the Comparative Example photoreceptor 2, when dip coating, the coated film of the outermost surface layer that has already been coated is eluted when dipped in the dipping tank, and so a gradient is not achieved in the proportion of the content of the curable resin in the layer thickness direction.

Comparative Example 3

The Comparative Example photoreceptor 3 is obtained by dip coating in the same method as Comparative Example photoreceptor 2, except that only the outermost surface layer coating liquid (4) is used in the production method of the photoreceptor 2 of Comparative Example 2.

Evaluation of the Comparative Example photoreceptor 3 is carried out by the same methods as in Example 1. The results are shown in Table 5.

Comparative Example 4

The Comparative Example photoreceptor 4 is obtained by dip coating in the same method as Comparative Example photoreceptor 2, except that only the outermost surface layer coating liquid (1) is used in the production method of the photoreceptor 2 of Comparative Example 2.

Evaluation of the Comparative Example photoreceptor 4 is carried out by the same methods as in Example 1. The results are shown in Table 5.

Comparative Example 5

The Comparative Example photoreceptor 5 is obtained by dip coating in the same method as Comparative Example photoreceptor 2, except that only the outermost surface layer coating liquid (7) is used in the production method of the photoreceptor 2 of Comparative Example 2.

Evaluation of the Comparative Example photoreceptor 5 is carried out by the same methods as in Example 1. The results are shown in Table 5.

TABLE 5

| | | Evaluation Result | | | | | | | | | |
|---|---|---|---|---|---|---|---|---|---|---|---|
| | | | Image Degradation (High Temp/ High Humidity) | | | Image Degradation (Low Temp/ Low Humidity) | | | | Delamination | Abrasion Rate |
| | Photoreceptor | Residual Potential (V) | 1st sheet | 10,000th sheet | After 1 day | 1st sheet | 10,000th sheet | After 1 day | Ghosting | [number of areas remaining] | [nm/1000 revolutions] |
| Example 1 | Photoreceptor 1 | 115 | A | A | A | A | A | A | A | 100 | 1.4 |
| Example 2 | Photoreceptor 2 | 98 | A | A | A | A | A | A | A | 99 | 1.1 |
| Example 3 | Photoreceptor 3 | 87 | A | A | A | A | A | A | A | 97 | 1.5 |
| Example 4 | Photoreceptor 4 | 102 | A | A | A | A | A | A | A | 99 | 1.0 |
| Example 5 | Photoreceptor 5 | 95 | A | A | A | A | A | A | A | 96 | 1.3 |
| Example 6 | Photoreceptor 6 | 122 | A | A | A | A | A | A | A | 98 | 1.4 |
| Example 7 | Photoreceptor 7 | 108 | A | A | A | A | A | A | A | 98 | 1.6 |
| Comparative Example 1 | Comp. Example Photoreceptor 1 | 135 | A | A | A | A | A | A | B | 85 | 1.6 |
| Comparative Example 2 | Comp. Example Photoreceptor 2 | 145 | A | A | A | A | A | A | B | 80 | 1.4 |
| Comparative Example 3 | Comp. Example Photoreceptor 3 | 128 | A | A | A | A | A | A | C | 74 | 1.2 |

TABLE 5-continued

| | | Evaluation Result | | | | | | | | | |
|---|---|---|---|---|---|---|---|---|---|---|---|
| | | | Image Degradation (High Temp/ High Humidity) | | | Image Degradation (Low Temp/ Low Humidity) | | | | Delamination | Abrasion Rate |
| | Photoreceptor | Residual Potential (V) | 1st sheet | 10,000th sheet | After 1 day | 1st sheet | 10,000th sheet | After 1 day | Ghosting | [number of areas remaining] | [nm/1000 revolutions] |
| Comparative Example 4 | Comp. Example Photoreceptor 4 | 96 | A | B | C | A | B | B | A | 95 | 2.8 |
| Comparative Example 5 | Comp. Example Photoreceptor 5 | 182 | A | A | A | A | A | A | C | 77 | 0.9 |

When the composition of the phenol resin within the outermost surface layer 5 is made to change, as in the Examples 1 to 7, then the residual potential is low, and the results of the evaluation for Image Degradation and ghosting are good, and the abrasion rate result is also good.

In contrast, when the outermost surface layer 5 is layered as in the Comparative Example 1, there is an interface between the layers, and sometimes delamination occurs and ghosting is seen. Furthermore, when there is a single composition of the outermost surface layer 5, as in the Comparative Examples 2 to 5, it is not possible to both improve the Image Degradation and ghosting, at the same time as improving the abrasion rate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor having a cylindrical support, a photosensitive layer and an outermost surface layer that are layered on or above the cylindrical support in this sequence;

the outermost surface layer comprising a charge transport material and a curable resin;

the charge transport material comprising a cross-linkable substance having a charge transport function; and the proportion of the content of the curable resin in the outermost surface layer increasing toward a surface, which is a far side from the photosensitive layer, of the outermost surface layer, the outermost surface layer being formed by ejecting an outermost surface layer coating liquid comprising at least the charge transport material and the curable resin by an inkjet method.

2. The electrophotographic photoreceptor according to claim 1, wherein, when the total amount by weight of the curable resin and the charge transport material is defined as 100%, the proportion of the content of the curable resin in the outermost surface layer at the interface with the photosensitive layer is 45 wt % or less.

3. The electrophotographic photoreceptor according to claim 1, wherein, when the total amount by weight of the curable resin and the charge transport material is defined as 100%, the proportion of the content of the curable resin in the outermost surface layer at the interface with the photosensitive layer is from 10 wt % to 45 wt %.

4. The electrophotographic photoreceptor according to claim 1, wherein, when the total amount by weight of the curable resin and the charge transport material is defined as 100%, the proportion of the content of the curable resin in the outermost surface layer at the surface of the outermost surface layer on the far side from the photosensitive layer is 55 wt % or more.

5. The electrophotographic photoreceptor according to claim 1, wherein, when the total amount by weight of the curable resin and the charge transport material is defined as 100%, the proportion of the content of the curable resin in the outermost surface layer at the surface of the outermost surface layer on the far side from the photosensitive layer is from 55 wt % to 90 wt %.

6. The electrophotographic photoreceptor according to claim 1, wherein, the difference between the proportion of the content of the curable resin in the outermost surface layer at the surface of the outermost surface layer on the far side from the photosensitive layer and the proportion of the content of the curable resin in the outermost surface layer at the interface with the photosensitive layer is 10 wt% to 80 wt %.

7. The electrophotographic photoreceptor according to claim 1, wherein the curable resin is a curable resin having a phenolic hydroxyl group.

8. The electrophotographic photoreceptor according to claim 1, wherein the photosensitive layer comprises a polycarbonate resin.

9. A process cartridge comprising:

the electrophotographic photoreceptor according to claims 1; and at least one of a charger that charges the electrophotographic photoreceptor, a latent image formation unit that forms a latent image on the charged electrophotographic photoreceptor, a developer that develops the latent image with a toner, or a cleaner that cleans a surface of the developed electrophotographic photoreceptor.

10. An image-forming apparatus comprising:

the electrophotographic photoreceptor according to claim 1;

a charger that charges the electrophotographic photoreceptor;

a latent image formation unit that forms a latent image on the charged electrophotographic photoreceptor;

a developer that develops the latent image with a toner; and a transfer unit that transfers the toner image onto a recording medium.

11. A method of producing the electrophotographic photoreceptor according to claim 1, the method comprising:

preparing two or more of outermost surface layer coating liquids that have different proportions of the curable resin contained therein;

ejecting the two or more outermost surface layer coating liquids from a liquid droplet discharge head to form, on or above the surface of the photosensitive layer on or above the cylindrical support, the outermost surface layer such that in the layer thickness direction there are different proportions of content of the curable resin by controlling ejecting proportions of the two or more outermost surface layer coating liquids, or by superimposing in a sequence the two or more outermost surface layer coating liquids.

12. The method of producing the electrophotographic photoreceptor according to claim 11, wherein the outermost surface layer coating liquids are ejected from the liquid droplet discharge head by an inkjet method.

13. The method of producing the electrophotographic photoreceptor according to claim 12, wherein the inkjet method is a method that uses a piezoelectric element.

14. The method of producing the electrophotographic photoreceptor according to claim 11, wherein a plurality of the liquid droplet discharge heads is disposed.

* * * * *